US007131555B2

(12) United States Patent
Maruyama et al.

(10) Patent No.: US 7,131,555 B2
(45) Date of Patent: Nov. 7, 2006

(54) METHOD AND DEVICE FOR DISCHARGING FLUID

(75) Inventors: Teruo Maruyama, Hirakata (JP); Takashi Inoue, Higashiosaka (JP); Ryoji Hyuga, Kadoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 296 days.

(21) Appl. No.: 10/673,495

(22) Filed: Sep. 30, 2003

(65) Prior Publication Data

US 2004/0118865 A1 Jun. 24, 2004

(30) Foreign Application Priority Data

Sep. 30, 2002 (JP) ..... 2002-286741

(51) Int. Cl.
*H01J 9/227* (2006.01)

(52) U.S. Cl. ..... 222/1; 417/203; 417/205; 417/417

(58) Field of Classification Search ..... 222/1, 222/333; 417/205
See application file for complete search history.

(56) References Cited

U.S. PATENT DOCUMENTS 4,787,332 A 11/1988 Geisel et al.
6,558,127 B1 * 5/2003 Maruyama et al. ..... 417/44.1
6,565,333 B1 * 5/2003 Maruyama ..... 417/417
6,679,685 B1 * 1/2004 Maruyama et al. ..... 417/374
2001/0043864 A1 * 11/2001 Maruyama et al. ..... 417/44.1
2002/0017238 A1 2/2002 Shinozaki et al.
2002/0025260 A1 2/2002 Maruyama
2003/0012667 A1 * 1/2003 Maruyama et al. ..... 417/374
2004/0081759 A1 * 4/2004 Maruyama et al. ..... 427/256
2004/0084549 A1 * 5/2004 Maruyama et al. ..... 239/4
2004/0118865 A1 * 6/2004 Maruyama et al ..... 222/1
2004/0228970 A1 * 11/2004 Maruyama et al. ..... 427/256

FOREIGN PATENT DOCUMENTS

JP 11-10866 1/1999
JP 2000-167467 6/2000
JP 2002001192 1/2002
WO 98/16323 4/1998

* cited by examiner

*Primary Examiner*—J. Casimer Jacyna
(74) *Attorney, Agent, or Firm*—Wenderoth, Lind & Ponack, L.L.P.

(57) ABSTRACT

A method for discharging fluid, includes while keeping two members relatively moving to each other along a gap direction of a gap formed by two opposing surfaces of the two members, feeding fluid from a fluid supply device to the gap, and intermittently discharging the fluid by utilizing a pressure change made by changing the gap, and controlling a fluid discharge amount per dot depending on pressure and flow rate characteristics of the fluid supply device.

21 Claims, 30 Drawing Sheets

METHOD AND DEVICE FOR DISCHARGING FLUID

BACKGROUND OF THE INVENTION

The present invention relates to fluid discharging method and device for very small flow rates required in such fields as information/precision equipment, machine tools, and FA (Factory Automation), or in various production processes of semiconductors, liquid crystals, displays, surface mounting, and the like.

For liquid discharging devices (dispensers), which have hitherto been used in various fields, there has arisen a growing demand for a technique of feeding and controlling very small amounts of fluid material with high precision and high stability, against the background of recent years' needs for smaller-size electronic components and higher recording density. For example, in the fields of plasma displays, CRTs, organic EL, or other displays, there has been a great demand for direct patterning of fluorescent material or electrode material on the panel surface without any mask instead of conventional screen printing, photolithography, or other like methods.

Issues of dispensers for those purposes can be summarized as follows:

① Scale-down of application amount,

② Higher accuracy of application amount, and

③ Reduction of application time.

The machining accuracy in machining work has been moving from micron into submicron orders. Whereas the submicron machining is commonly used in the field of semiconductor and electronic components, the demand for ultraprecision machining has been rapidly increasing also in the field of machining work that has been making progress along with mechatronics. In recent years, along with the introduction of the ultraprecision machining technique, electromagnetostriction devices typified by ultra-magnetostriction devices and piezoelectric devices have been coming to be applied to micro actuators. With one of these electromagnetostriction devices used as a generation source for fluid pressure, there has been proposed an injection device for injecting very small amounts of droplets at high speed. For example, a method of injecting one arbitrary droplet with an ultra-magnetostriction device is disclosed in Unexamined Japanese Patent Publication No. 2000-167467. Referring to FIG. 24, reference numeral 502 denotes a cylinder made of a nonmagnetic material such as glass pipe or stainless pipe. At one end portion of this cylinder 502 is formed an injection nozzle 504 having a liquid storage portion 503 and a minute injection port. Inside the cylinder 502, an actuator 505 made of a bar-shaped ultra-magnetostriction material is accommodated so as to be movable. A piston 506 is contactably and separably provided at an end portion of the actuator 505 suited for the injection nozzle 504.

Between the other end portion of the actuator 505 and a stopper 507 of the one end portion of the cylinder 502, a spring 508 is interposed so that the actuator 505 is biased by the spring 508 so as to be moved forward. Also, a coil 509 is wound at a position near the piston 506 on the outer periphery of the cylinder 502.

In the injection device having the above construction, a current is instantaneously passed through the coil 509 so that an instantaneous magnetic field acts on the ultra-magnetostriction material, by which an instantaneous transient displacement due to an elastic wave is generated at an axial end portion of the ultra-magnetostriction material. By the action, it is described, the liquid filled in the cylinder 502 can be injected from the nozzle 504 as one minute droplet.

As the dispenser, conventionally, such a dispenser employing the air pulse system as shown in FIG. 25 has been widely used, and this technique is introduced, for example, in "Jidoka-Gijutsu (Mechanical Automation), Vol. 25, No. 7, '93" etc.

A dispenser of this system applies a constant mount of air supplied from a constant-pressure source into the interior 601 of a vessel 600 (cylinder) in a pulsed manner and then discharges from a nozzle 602 a certain amount of liquid corresponding to a pressure increase in the cylinder 600.

With an aim of high-speed intermittent application, such a dispenser as shown in FIG. 26 (hereinafter, referred to as "jet system" for convenience' sake) has already been put into practice. Reference numeral 550 denotes a micrometer, 551 denotes a spring, 552 denotes a seal member of the piston, 553 denotes a piston chamber, 554 denotes a heater, 555 denotes a needle, 556 denotes an application material flowing toward a sheet portion, and 557 denotes a dot-shaped application material which flies from the dispenser. FIGS. 27A and 27B are model views showing a discharge portion proximity 558 of FIG. 26, where FIG. 27A shows a suction process and FIG. 27B shows a discharge process. Numeral 559 denotes a spherical-shaped convex portion 559 formed at a discharge-side end portion of the needle 555, 560 denotes a discharge tip portion, 561 denotes a spherical-shaped concave portion formed at this discharge tip portion 560, and 562 denotes a discharge nozzle. Numeral 563 denotes a pump chamber formed by the spherical-shaped convex portion 559 and concave portion 561.

Referring to FIG. 27A, which shows a suction process, when the feed air pulse of the piston chamber 553 is ON, the needle 555 moves up against the spring 551. In this case, a suction portion 564 formed between the spherical-shaped convex portion 559 and concave portion 561 is opened, an application material 556 is filled from the suction portion 564 into the pump chamber 563. Referring to FIG. 27B, which shows a discharge stroke, when the air pulse is OFF, i.e., when no air pressure is applied to the piston chamber 553, the needle 555 is moved down by the force of the spring 551. In this case, the suction portion 564 is shielded, and the fluid within the pump chamber 563 is compressed by the tightly closed space excluding the discharge nozzle 562, thus generating a high pressure and making the fluid fly and flow out.

There has been being made development for applying the ink jet system, which has been widely used as consumer printers, to application devices for industrial use. Referring to FIG. 28, which shows a prior art example of a head portion in an ink jet recording device (Unexamined Japanese Patent Publication No. 11-10866), numeral 651 denotes a base, 652 denotes an oscillation plate, 653 denotes a stacked-type piezoelectric element, 654 denotes an ink chamber, 655 denotes a common ink chamber, 656 denotes an ink flow passage (throttle portion), 657 denotes a nozzle plate, and 658 denotes a discharge nozzle. When a voltage is applied to the piezoelectric element 653, which is a pressure applying means, the piezoelectric element 653 makes the oscillation plate 652 deformed thicknesswise, causing the ink chamber 654 to be decreased in capacity. As a result, the fluid is compressed so that the pressure of the ink chamber 654 increases, causing a part of the fluid to pass through the ink passage 656 and reversely flow toward the common ink chamber 655 while the rest of the fluid is discharged out to the atmosphere from the discharge nozzle 658.

In the field of circuit formation, or in the fields of electrodes, ribs, and fluorescent-screen formation of PDP, CRT, or other image tubes, and manufacturing processes of liquid crystals, optical disks, organic EL, or the like, where higher precision and higher micro-fineness have been increasingly demanded for those fields in recent years, the fluid material to be micro-finely applied is high-viscosity powder and granular material in many cases. For replacement of conventional methods with a direct patterning method using dispensers, the greatest issue is how it can be practicable that very small amounts of high-viscosity powder and granular material containing fine particles having mean outside diameters of several microns to several tens of microns, exemplified by fluorescent material, electrically conductive capsules, solder, and electrode material, are micro-finely applied onto the object substrate at high speed and high precision and without causing clogging of flow passages and moreover with high reliability.

With regard to the fluorescent material-layer forming process of plasma display panels as an example, issue of the prior art are described below.

<1> Issues of Screen Printing Method and Photolithography Method

<2> Issues in Direct Patterning of Fluorescent Material Layer by Conventional Dispenser Technique First, the issue <1> is explained.

(1) Construction of Plasma Display Panel

FIG. 29 shows an example of the construction of a plasma display panel (hereinafter, referred to as PDP). The PDP is composed roughly of a front side plate 800 and a rear side plate 801. A plurality of sets of linear transparent electrodes 803 are formed on a first substrate 802, which is a transparent substrate forming the front side plate 800. Also, on a second substrate 804 forming the rear side plate 801, a plurality of sets of linear electrodes 805 are provided parallel to one another so as to be perpendicular to the linear transparent electrodes. These two substrates are opposed to each other with interposition of barrier ribs 806 on which the fluorescent material layer is formed, and then discharge gas is sealed into the barrier ribs 806. When a voltage not lower than the threshold is applied to between the two substrates, electric discharge occurs at the positions where the electrodes perpendicularly cross each other, causing discharge gas to emit light, where the light emission can be observed through the transparent first substrate 802. Then, by controlling the discharge positions (discharge points), it becomes possible to display an image on the first substrate side. For color display by PDP, fluorescent materials which emit light of desired colors by ultraviolet rays radiated upon discharge at individual discharge points are formed at positions corresponding to the discharge points (partition walls of barrier ribs), respectively. For full-color display, fluorescent materials for R, G, and B, respectively, are formed.

The constitution of the front side plate 800 and the rear side plate 801 is explained in more detail.

As to the front side plate 800, a plurality of sets of linear transparent electrodes 803, each one set comprising two electrodes, are formed from ITO or the like, parallel to each another, on the inner surface side of the first substrate 802 formed of a transparent substrate such as a glass substrate. Bus electrodes 807 for reducing the line resistance value are formed on the inner-side surfaces of these linear transparent electrodes 803. A dielectric layer 808 for covering those transparent electrodes 803 and bus electrodes 807 is formed all over the inner surface of the front side plate 800, and a MgO layer 809 serving as a protective layer is formed all over the surface of the dielectric layer 808.

On the other hand, on the inner surface side of the second substrate 804 of the rear side plate 801, a plurality of linear address electrodes 805 which perpendicularly cross the linear transparent electrodes 803 of the front side plate 800 are formed in parallel from silver material or the like. Also, a dielectric layer 810 for covering those address electrodes 805 is formed all over the inner surface of the rear side plate 801. On the dielectric layer 810, the address electrodes 805 are isolated and moreover the barrier ribs (partition walls) 806 of a specified height are formed so as to protrude between the individual address electrodes 805 for the purpose of maintaining the gap distance between the front side plate 800 and the rear side plate 801 constant. With these barrier ribs 806, cells 811 are formed along the individual address electrodes 805, and fluorescent materials 812 of respective R, G, and B colors are formed one by one in the inner surfaces of the cells 811. The PDP in cell structure comes in two types, one in which such discharge points as shown in FIG. 29 are provided one in each one independent cell and the other in which the discharge points are partitioned by partition walls on an array basis (not shown). In recent years, the "independent cell system" has been drawing attention as a system that allows performance improvement of PDPs. The reason of this is that enclosing the cell with four-side barrier ribs in a waffle-like state makes it possible to prevent optical leakage between adjoining cells as well as to increase the area of the light emitter. As a result, the luminous efficiency and the emission amount (brightness) are increased so that a high-contrast image can be implemented, which is regarded as a characteristic of the "independent cell system". The fluorescent material layer formed on the cell wall surfaces is deposited generally to a thickness of about 10–40 μm with a view to better coloring property. For the formation of the R, G, and B fluorescent material layers, a fluorescent-material use coating liquid is filled into each cell and thereafter dried, thereby making volatile components removed, by which a thick fluorescent material is formed on the cell inner surface while a space for filling the discharge gas is formed at the same time. In order to form such a thick-film fluorescent-material pattern, the coating material containing a fluorescent material is prepared as a reduced-in-solvent-quantity paste fluid (fluorescer-member use paste) having a high viscosity of several thousands of mPas to several tens of thousands of mPas and, conventionally, applied to the substrate by screen printing or photolithography.

(2) Issues of Conventional Screen Printing Method

With the conventional screen printing method adopted, a large-scaled screen size would cause a large elongation of the screen plate due to tensile force, making it harder to achieve high-precision alignment of the screen printing plate for the whole screen. Also, in filling the fluorescent material, the material might be placed even on the top portions of the partition walls, which would lead to crosstalk between barrier ribs as a problem in the case of the "independent cell system". As a result of this, it has been necessary to take measures such as introduction of a polishing process for removing the material deposited on the top portion. Further, since the amount of filled fluorescent material varies depending on the difference in squeegee pressure, pressure control therefor is extremely subtle work, which largely depends on the degree of the skill of the operator. Thus, it is quite hard to obtain a constant filling amount for every independent cell over the entire rear side plate.

(3) Issues of Conventional Photolithography

The conventional photolithography PDP method has had the following issue. In this method, a photosensitive fluorescent-material use paste is press-fitted into the cells between the ribs, and then only the photosensitive composition that has been press-fitted into specified cells is left through exposure and development processes. Thereafter, through a baking process, organic matters in the photosensitive composition are dissipated, by which a fluorescent material-layer pattern is formed. In this method, in which the paste in use contains fluorescent-material powder so that the method is low in sensitivity to ultraviolet rays, there has been a difficulty in obtaining a 10 μm or more film thickness of the fluorescent material layer. Thus, the method has had an issue that enough brightness cannot be obtained.

Also, in the case where photolithography is adopted, exposure and development processes are essential for each color. However, since the fluorescent material is contained in the paste coating layer at high concentration, the loss of the fluorescent material due to the development removal is such large that the effective utilization ratio of the fluorescent material is a little less than 30% at most. Thus, there has been a large issue in terms of cost.

<2> Issues in Direct Patterning of Fluorescent Material Layer by Conventional Dispenser Technique (1) Issues of Air Nozzle Type Dispenser Conventionally, an attempt is made that coating of the imaging tube is performed by using an air nozzle-type dispenser (FIG. 25) which is widely used in the fields of circuit mounting and the like. Since continuous application with high-viscosity fluid at high speed is difficult to do with the air nozzle-type dispenser, fine particles are diluted with a low-viscosity fluid before applied. In the case of fluorescent-material application on PDP, CRT, or other image tubes, the particle size of fine particles is 3 to 9 μm as an example and their specific gravity is about 4 to 5. In this case, there has been an issue that when the fluid flow is stopped, the fine particles would be immediately deposited inside the flow passage due to the weight of a single particle. Furthermore, the dispenser of the air type has had a drawback of poor responsivity. This drawback is due to the compressibility of air entrapped in the cylinder as well as to the nozzle resistance during the passage of air through narrow gaps. That is, in the case of the air type, the time constant of the fluid circuit that depends on cylinder capacity and nozzle resistance is such a large one that a time delay of about 0.07 to 0.1 second has to be allowed for after an input pulse is applied until the fluid is started being dispensed and further transferred onto the substrate.

The discharging device using as the drive source a piezoelectric material or ultra-magnetostriction material as described before in FIG. 24 is a proposal targeted for application of fluid containing no powder, and it is predicted to be difficult to respond to the aforementioned challenge related to the application process of powder and granular material. Also, in the case where a fluid is applied by using instantaneous transient displacement due to elastic waves, the liquid storage portion 503 has to be normally filled with the fluid without gaps, where the capacity is constant. There is no description as to, for example, how the fluid is supplied to the liquid storage portion 503 in order to replenish the fluid that is consumed on and on as time elapses.

(2) Issues of Jet Type Dispenser

The dispenser shown in FIG. 26 is enough fast in application speed, as compared with the air type, the thread groove type, and the like which are a prior art, and also capable of treating high-viscosity fluid. Also, this type of dispenser is capable of letting the fluid flown from the nozzle and intermittently applied while a sufficient distance is kept between the nozzle and its opposing surface. Such an application method that the fluid is let to fly from the nozzle is difficult to do with the air type and the thread groove type, both of which are incapable of producing an abrupt pulsed pressure.

This type of dispenser, as described before, is a method that a spherical-shaped convex portion formed at an end portion of the needle 555 and a spherical-shaped concave portion formed on the dispensing side are engaged with each other, thereby creating a tightly closed space 563 excluding the discharge nozzle 562, and this tightly closed space is compressed so that a high pressure is generated to let the fluid fly and flow.

In this case, in the compression process, the gap at the suction portion 564 between the relatively moving members (convex and concave portions) becomes zero, so that the fluorescent-material fine particles having mean particle sizes of 3 to 9 μm undergo a mechanical squeezing action, thereby broken. Because of various failures that would result therefrom, such as the clogging of the flow passage and deterioration of the sealing performance of the suction portion 564 due to wear of the members, it is difficult, in many cases, to apply this dispenser to powder and granular material application such as fluorescent material.

Another issue of this type of dispenser is to ensure application absolute-quantity precision per dot on a precondition of long-time continuous use. On the assumption that the fluorescent material is intermittently applied into the "independent cells" of the foregoing PDP, several tens of heads are necessary in consideration of the production cycle time in mass production. In this dispenser, the application quantity per dot is determined by the capacity of the tightly closed space, i.e. the stroke of the needle 555, and the sealing performance of the suction portion 564. However, it is predicted to be extremely difficult from the viewpoint of practical use to maintain the strokes and the absolute positions of individual needles 555 of the dispensers, Which are provided in a quantity of several tens, as well as the sealing performance of the suction portions 564 that is subject to wear, at a constant state for long time without variations.

(3) Issues of Ink Jet Type Dispenser

The ink jet type dispenser shown in FIG. 28, for which the viscosity of the fluid is limited to 10 to 50 mPas from the restrictions of drive method and structure, is incapable of treating high-viscosity fluids. Also, the particle size of the powder contained in the fluid is about 0.1 μm at most from the viewpoint of clogging.

In order to draw a fine pattern by using the ink jet type dispenser, there has been developed a low-viscosity nano-paste in which particles having a mean particle size of about 5 nm and covered with a dispersant are independently dispersed. Here is assumed a case in which a fluorescent material layer is formed on the inner wall of the barrier rib (partition wall) of the aforementioned PDP "independent cell" with the use of this nano-paste. However, in order that a 10 to 40 μm thick fluorescent material layer is deposited in the process of filling the fluorescent-material use coating liquid into the individual cells and thereafter drying the liquid, originally, a high-viscosity pasty fluid with a reduced amount of solvent is used as the coating material containing the fluorescent material, as described before. For a low-viscosity nano-paste that allows only a dilute content of fluorescent material to be contained therein, it is impossible to form a fluorescent material layer of a specified thickness because of its insufficient absolute quantity of fluorescent material. Also, whereas fluorescent-material fine particles having a micron-order particle size is commonly considered most suitable for the display to obtain high brightness, the ink jet type dispenser is incapable of easily changing the fluorescent-material particle size for the present stage, which is also a great issue of the ink jet type.

In summary of the above discussions, there cannot be found, for the present stage, a technical method having a capability of substituting for the screen printing method and the photolithography method, which is exemplified by a direct patterning method that implements the formation of an independent-cell fluorescent material layer for PDPs.

Now, proposals in the past relating to the intermittent-application dispensers by the present inventor are briefly explained. In order to meet the recent years' various requests related to the minute-flow-rate application, the present inventor has proposed and applied for patent a method for controlling the discharge amount of fluid, "Fluid Feeding Device and Fluid Feeding Method" (Japanese Patent Application No. 2000-188899, corresponding U.S. Pat. No. 6,558,127 and U.S. patent application Ser. No. 10/118,156), in which, with relative linear motion and rotational motion given to between a piston and a cylinder, fluid transporting means is implemented by the rotational motion while a relative gap between the fixed side and the rotation side is changed by using the linear motion.

This proposal is intended to control the interruption of the fluid by a dynamic sealing effect based on the arrangement that a thrust hydrodynamic seal is formed on a discharge-side end face of the piston and a relatively moving surface of its opposing surface, where the effect is produced when the gap between the opposing surfaces are narrowed.

In Japanese Patent Application No. 2000-208072 (corresponding U.S. Pat. No. 6,565,333), the present inventor has proposed a dispenser in which a piston and a cylinder for accommodating therein the piston are driven independently of each other by using two independent linear motion means, respectively, by which a positive displacement pump is implemented.

Also, the present inventor has proposed intermittent discharge method and apparatus (Japanese Patent Application No. 2001-110945, corresponding U.S. patent application Ser. No. 10/118,156) which uses a squeeze pressure generated by abruptly changing the gap between a piston end face and its relative-movement face based on theoretical analysis performed on the dispenser structure disclosed in Japanese Patent Application No. 2000-188899. Whereas this squeeze pressure is known as a dynamic effect of hydrodynamic bearings, it is necessary for use of this squeeze pressure that the gap between the piston end face and its opposing surface be set to a narrow one, e.g., 20 to 30 μm or less.

SUMMARY OF THE INVENTION

The present invention proposes an application principle based on a novel idea that has not been disclosed in the aforementioned proposals. That is, as a result of forwarding strict theoretical analysis on the assumption that the coating fluid is a viscous fluid, the present inventor has found that even when the gap between the piston end face and its opposing surface is sufficiently wide, a high generated pressure equivalent to or more than that of the squeeze effect (i.e., secondary squeeze pressure) can be obtained by the interaction of pump characteristics of the fluid supply source and flow-rate changes due to abrupt changes in piston position.

Thus, the present invention proposes fluid discharging method and device using this secondary squeeze pressure. With the use of this discharge principle, control of the gap between piston end face and its opposing surface becomes simple, the structure becomes simple, and moreover the total discharge amount per dot can be set by, for example, the number of rotations of the fluid-supply-source pump. Accordingly, an object of the present invention is to provide method and device for discharging fluid which can implement intermittent fluid discharging of ultra-high speed and ultra-micro (small) amount which is easy to handle in practical use, high in flow-rate precision per dot, and high in reliability to powder and granular material.

In accomplishing these and other aspects, according to a first aspect of the present invention, there is provided a method for discharging fluid, comprising:

while keeping two members relatively moving to each other along a gap direction of a gap formed by two opposing surfaces of the two members, feeding fluid from a fluid supply device to the gap; and intermittently discharging the fluid by utilizing a pressure change made by changing the gap, and controlling a fluid discharge amount per dot depending on pressure and flow rate characteristics of the fluid supply device.

According to a second aspect of the present invention, there is provided the method for discharging fluid according to the first aspect, wherein the pressure and flow rate characteristics of the fluid supply device are set by changing a number of rotations of the fluid supply device.

According to a third aspect of the present invention, there is provided the method for discharging fluid according to the first aspect, wherein assuming that a minimum value or a mean value of the gap is $h_0$, the intermittent discharge is performed with the gap $h_0$ set to a range of $h_0>h_x$, where a setting range of the gap $h_0$ over which an intermittent discharge amount per dot is generally proportional to the gap $h_0$ is $0<h_0<h_x$, and where a setting range of the gap $h_0$ over which the intermittent discharge mount is generally constant independent of the gap $h_0$ is $h_0>h_x$, and where $h_x$ is an intersection point between an envelope of the intermittent discharge amount per dot relative to $h_0$ in a region $0<h_0<h_x$, and a value of a portion of the region $h_0>h_x$ over which the intermittent discharge amount per dot is generally constant independent of $h_0$.

According to a fourth aspect of the present invention, there is provided the method for discharging fluid according to the first aspect, wherein assuming that a fluid pressure generated in inverse proportion to a size of the gap between the opposing surfaces of the two members and in proportion to time differential of the gap is a primary squeeze pressure, and that a fluid pressure generated in proportion to the time differential of the gap and in proportion to an internal resistance of the fluid supply device is a secondary squeeze pressure, and further that a minimum value or a mean value of the gap is $h_0$, the intermittent discharge is performed by action of the secondary squeeze pressure with the gap $h_0$ set to a range of $h_0>h_x$, a setting range of the gap $h_0$ over which an intermittent discharge amount per dot is generally proportional to the gap $h_0$ is $0<h_0<h_x$, and where a setting range of the gap $h_0$ over which an intermittent discharge amount is generally constant independent of the gap $h_0$ is $h_0>h_x$, and where $h_x$ is an intersection point between an envelope of the intermittent discharge amount per dot relative to $h_0$ in a region $0<h_0<h_x$, and a value of a portion of the region $h_0>h_x$ over which the intermittent discharge amount per dot is generally constant independent of $h_0$.

According to a fifth aspect of the present invention, there is provided a The method for discharging fluid according to the first aspect, wherein assuming that a fluid pressure generated in inverse proportion to a size of the gap between the opposing surfaces of the two members and in proportion to time differential of the gap is a primary squeeze pressure, and that a fluid pressure generated in proportion to the time differential of the gap and in proportion to an internal resistance of the fluid supply device is a secondary squeeze pressure, and further that a minimum value or a mean value of the gap is $h_0$, the intermittent discharge is performed with the gap $h_0$ set to a value of $h_0 \approx h_x$ or to a range of $0<h_0<h_x$, where a setting range of the gap $h_0$ over which an intermittent discharge amount per dot is generally proportional to the gap $h_0$ is $0<h_0<h_x$, and where a setting range of the gap $h_0$ over which the intermittent discharge amount is generally constant independent of the gap $h_0$ is $h_0>h_x$, and where $h_x$ is an intersection point between an envelope of the intermittent discharge amount per dot relative to $h_0$ in a region $0<h_0<h_x$, and a value of a portion of the region $h_0>h_x$ over which the intermittent discharge amount per dot is generally constant independent of $h_0$.

According to a sixth aspect of the present invention, there is provided the method for discharging fluid according to the third aspect, wherein $h_x$ is a value of an intersection point between an envelope of a curve relative to $h_0$ in a region $0<h_0<h_x$, and a portion of the region $h_0>h_x$ over which the curve is generally constant independent of $h_0$.

According to a seventh aspect of the present invention, there is provided a The method for discharging fluid according to the third aspect, wherein assuming that a fluid internal resistance of the fluid supply device is $R_s$ (kgsec/mm$^5$), a radial fluid internal resistance of the opposing surfaces of the relatively moving two members that depends on the gap $h_0$ of the opposing surfaces of the two members is $R_p$ (kgsec/mm$^5$) a fluid resistance of the discharge port is $R_n$ (kgsec/mm$^5$), and if a function $\phi$ is defined as $$\phi = \frac{1}{R_n + R_p + R_s},$$

then $h_x$ is a value of an intersection point between an envelope of a curve $\phi$ relative to h in a region $0<h<hx$, and a portion of the region $h_0>hx$ over which the curve $\phi$ is independent of $h_0$ and generally constant.

According to an eighth aspect of the present invention, there is provided the method for discharging fluid according to the first aspect, wherein if a maximum value of time differential of the gap is $V_{max}$, a mean radius of outer peripheries of the two members is $r_0$ (mm), a mean radius of a discharge opening for connecting the gap and outside of the device is $r_i$ (mm), and if a maximum flow rate of the fluid supply device is $Q_{max}$, then $$Q_{max} < \pi(r_0^2 - r_i^2)v_{max}.$$

According to a ninth aspect of the present invention, there is provided the method for discharging fluid according to the first aspect, wherein the two members that are relatively moved to each other along a gap direction by independent axial direction drive devices are provided in a plurality of sets, and the fluid is supplied by one set of fluid supply device in branches to gaps between these sets of two members.

According to a 10th aspect of the present invention, there is provided the method for discharging fluid according to the 9th aspect, wherein each discharge amount is controlled by setting the gap between opposing surfaces of respective two members to a proximity to $h_0 \approx h_x$ or to a range of $0<h_0<h_x$.

According to an 11th aspect of the present invention, there is provided the method for discharging fluid according to the first aspect, wherein an equal discharge amount per dot of fluid is intermittently discharged for coating periodically at equal time intervals while discharge nozzles and a substrate are kept relatively running to each other by making use of a property that a coating-object surface of the substrate is geometrically symmetrical.

According to a 12th aspect of the present invention, there is provided the method for discharging fluid according to the 11th aspect, wherein the coating-object surface is a surface of a display panel.

According to a 13th aspect of the present invention, there is provided the method for discharging fluid according to the first aspect, wherein fluid is supplied to opposing surfaces of two members that are relatively moved to each other along a gap direction by a fluid supply device, and wherein given a gap h (mm) of the two opposing surfaces, time differential dh/dt of the gap h, a mean radius $r_0$ (mm) of outer peripheries of the two opposing surfaces, a mean radius $r_i$ (mm) of a discharge opening for connecting the gap and outside, a viscosity coefficient $\mu$ (kgsec/mm$^2$) of the fluid, a fluid internal resistance $R_s$ (kgsec/mm$^5$) of the fluid supply device, a radial fluid resistance $R_P$ (kgsec/mm$^5$) of the two opposing surfaces, a fluid resistance $R_n$ (kgsec/mm$^5$) of the discharge opening, a sum $P_{s0}$ of a maximum pressure and a supply pressure of the fluid supply device, and given a frequency f (1/sec) of intermittent discharge, it holds that $P_{S0}+P_{squ10}+P_{squ20}<0$, where a primary squeeze pressure $P_{squ1}$ and a secondary squeeze pressure $P_{squ2}$ are defined as $$P_{squ1} = -\frac{3\mu}{h^3}\frac{dh}{dt}\left\{(r_0^2 - r_i^2) + 2r_i^2 \ln\frac{r_i}{r_0}\right\}$$

$$P_{squ2} = -R_s\pi\frac{dh}{dt}(r_0^2 - r_i^2)$$

and where a primary squeeze pressure $P_{squ1}$ and a secondary squeeze pressure $P_{squ2}$ resulting when the time differential dh/dt of the gap h has a maximum value are $P_{squ1}=P_{squ10}$ and $P_{squ2}=P_{squ20}$, respectively.

According to a 14th aspect of the present invention, there is provided the method for discharging fluid according to the first aspect, wherein in an application process in which coating is performed as the discharge while a coating-object surface and a discharge nozzle for connecting to the gaps are being relatively moved to each other, given a displacement input signal Sh that gives the gap between the two opposing surfaces, relative positions of the coating-object surface and the discharge nozzle and a timing of the displacement input signal Sh are adjusted by taking into consideration that a phase of coating is advanced by generally $\Delta\theta=\pi/2$ over the displacement input signal Sh.

According to a 15th aspect of the present invention, there is provided the method for discharging fluid according to he first aspect, wherein the two members are relatively moved by an electro-magnetostriction element.

According to a 16th aspect of the present invention, there is provided the method for discharging fluid according to the first aspect, wherein an amplitude immediately before a halt of coating of the two members that are relatively moved to each other along the gap direction is larger than an amplitude of steady intermittent application.

According to a 17th aspect of the present invention, there is provided the method for discharging fluid according to the first aspect, wherein while a dispenser for discharging the fluid through the gap is being relatively moved to a substrate on which independent ribs each surrounded by a barrier rib are formed geometrically symmetrical, fluorescent-material paste is intermittently discharged so that the fluorescent-material paste is applied to interiors of the independent cells one by one, by which a fluorescent-material layer of a plasma display panel is formed.

According to an 18th aspect of the present invention, there is provided the method for discharging fluid according to the 17th aspect, wherein the fluorescent-material paste is flown from the discharge nozzle so as to be applied while a distance H between a crest of the barrier rib and a tip end portion of the discharge nozzle is maintained at 0.5 mm or more.

According to a 19th aspect of the present invention, there is provided the method for discharging fluid according to the 18th aspect, wherein the distance H is 1.0 mm or more.

According to a 20th aspect of the present invention, there is provided the method for discharging fluid according to the first aspect, wherein the two opposing surfaces of the two members that are relatively moved to each other along a gap direction by independent axial direction drive devices are provided in a plurality of sets, and the fluid is supplied by one set of fluid supply device in branches to gaps between these sets of two members, and wherein each discharge amount is controlled by a flow-rate compensation device which is provided on a flow passage that connects the fluid supply device and the two opposing surfaces of the relatively moving two members to each other and which is capable of changing a flow passage resistance.

According to a 21st aspect of the present invention, there is provided the method for discharging fluid according to the first aspect, further comprising: in a coating process of intermittent application performed while the gap between the opposing surfaces of the relatively moving two members is varied at an amplitude $h_1$, increasing the gap between the opposing surfaces of the two members at an amplitude $h_2$ larger than the amplitude $h_1$ to interrupt the discharge; and thereafter performing intermittent application a plurality of times at the amplitude $h_1$ so that a central value of the gap after the interruption becomes gradually equal to a central value of the gap immediately before the interruption.

According to a 22nd aspect of the present invention, there is provided the method for discharging fluid according to the first aspect, wherein assuming that a time at an end of an (n−1)th application from a start of an application is $T_{n-1}$, a time at a start of an n-th application is $T_n$, and a time interval is $\Delta T=T_n-T_{n-1}$, then an n-th application quantity per dot is controlled by setting a value of the $\Delta T$.

According to a 23rd aspect of the present invention, there is provided a device for discharging fluid, comprising:

two members for relatively moving to each other along a gap direction with a discharge chamber formed by these two members; and a fluid supply device for supplying fluid to the discharge chamber with a suction port provided on an upstream side of the fluid supply device and a discharge port that communicates the discharge chamber and outside with each other, wherein the fluid is intermittently discharged from the discharge port by utilizing a pressure change due to a change of the gap formed by the two members, while a discharge amount per dot of the fluid is controlled by setting of pressure and flow-rate characteristics of the fluid supply device.

According to a 24th aspect of the present invention, there is provided the device for discharging fluid according to the 23rd aspect, wherein assuming that a fluid pressure generated in inverse proportion to a size of the gap between opposing surfaces of the relatively moving two members and in proportion to time differential of the gap is a primary squeeze pressure, and that a fluid pressure generated in proportion to the time differential of the gap and in proportion to an internal resistance of the fluid supply device is a secondary squeeze pressure, and further that a minimum value or a mean value of the gap is $h_0$, the intermittent discharge is performed by action of the secondary squeeze pressure with the gap $h_0$ set to a range of $h_0>h_x$, where a setting range of the gap $h_0$ over which an intermittent discharge amount per dot is generally proportional to the gap $h_0$ is $0<h_0<h_x$, and where a setting range of the gap $h_0$ over which an intermittent discharge amount is generally constant independent of the gap $h_0$ is $h_0>h_x$, and where $h_x$ is an intersection point between an envelope of the intermittent discharge amount per dot relative to $h_0$ in a region $0<h_0<h_x$, and a value of a portion of the region $h_0>h_x$ over which the intermittent discharge amount per dot is generally constant independent of $h_0$.

According to a 25th aspect of the present invention, there is provided the device for discharging fluid according to the 23rd aspect, wherein assuming that a fluid pressure generated in inverse proportion to a size of the gap between opposing surfaces of the relatively moving two members and in proportion to time differential of the gap is a primary squeeze pressure, and that a fluid pressure generated in proportion to the time differential of the gap and in proportion to an internal resistance of the fluid supply device is a secondary squeeze pressure, the discharge amount is controlled with the gap $h_0$ set to a value of $h_0 \approx h_x$ or to a range of $0<h_0<h_x$, where a setting range of a minimum value or a mean value $h_0$ of the gap is $0<h_0<h_x$, and where a setting range of the gap $h_0$ over which the intermittent discharge amount is generally constant independent of the gap $h_0$ is $h_0>h_x$, and where $h_x$ is an intersection point between an envelope of the intermittent discharge amount per dot relative to $h_0$ in a region $0<h_0<h_x$, and a value of a portion of the region $h_0>h_x$ over which the intermittent discharge amount per dot is generally constant independent of $h_0$.

According to a 26th aspect of the present invention, there is provided the device for discharging fluid according to the 23rd aspect, wherein the two members for relatively moving to each other along a gap direction by an independent axial direction drive device are provided in a plurality of sets, and the fluid is supplied by one set of fluid supply device in branches to gaps between opposing surfaces of these sets of two members.

According to a 27th aspect of the present invention, there is provided the device for discharging fluid according to the 25th aspect, wherein the two members for relatively moving to each other along a gap direction by an independent axial direction drive device are provided in a plurality of sets, and the fluid is supplied by one set of fluid supply device in branches to gaps between opposing surfaces of these sets of two members, and wherein each discharge amount is controlled by setting a minimum value or a mean value of the gap between each two members to a proximity to $h_0 \approx h_x$ or to a range of $0<h_0<h_x$, respectively.

According to a 28th aspect of the present invention, there is provided the device for discharging fluid according to the 23rd aspect, wherein the fluid supply device is a pump which can change a flow rate of the fluid by its number of rotations.

According to a 29th aspect of the present invention, there is provided the device for discharging fluid according to the 28th aspect, wherein the fluid supply device is a thread groove pump.

According to a 30th aspect of the present invention, there is provided the device for discharging fluid according to the 23rd aspect, wherein assuming that a minimum value or a mean value of the gap between opposing surfaces of the relatively moving two members is $h_0$, then $h_0>0.05$ mm.

According to a 31st aspect of the present invention, there is provided a device for discharging fluid, comprising:

a sleeve for housing a shaft;

a housing for housing the shaft and the sleeve;

a device for rotating the sleeve relative to the housing;

an axial direction drive device for giving the shaft an axial-direction relative displacement relative to housing, a discharge chamber being defined by a discharge-side end face of the shaft and the housing;

a fluid supply device for supplying a fluid to the discharge chamber by utilizing relative rotation of the sleeve and the housing, a suction port and a discharge port of the fluid communicating the discharge chamber and outside with each other; and a device for pressure-feeding the fluid, which has flowed into the discharge chamber, toward the discharge port side with the axial direction drive device, wherein a continuous flow of the fluid fed from the fluid supply device is converted into an intermittent flow by utilizing a pressure change due to a change of a gap of the discharge chamber, and moreover an intermittent discharge amount per dot of the fluid is controlled by setting of number of rotations.

According to a 32nd aspect of the present invention, there is provided the device for discharging fluid according to the 31st aspect, wherein the shaft and the sleeve are structurally integrated together.

According to a 33rd aspect of the present invention, there is provided a device for discharging fluid, comprising:

an axial direction drive device for giving an axial-direction relative displacement to between a shaft and a housing, a discharge chamber being defined by a shaft end face of the shaft and the housing; and a fluid supply device for supplying a fluid to the discharge chamber, a flow passage communicating the discharge chamber and the fluid supply device with each other, a suction port being formed in the fluid supply device, and a discharge port communicating the discharge chamber and outside with each other, wherein a continuous flow of the fluid fed from the fluid supply device is converted into an intermittent flow by utilizing a pressure change due to a change of a gap of the discharge chamber, and moreover an intermittent discharge amount per dot of the fluid is controlled by setting of number of rotations or a gap of an interval leading from the flow passage to the discharge port.

According to a 34th aspect of the present invention, there is provided the device for discharging fluid according to the 33rd aspect, wherein the fluid is supplied to a plurality of sets of the discharge chambers via flow passages branched from one set of the fluid supply device.

According to a 35th aspect of the present invention, there is provided the device for discharging fluid according to the 33rd aspect, wherein the flow passage is an easy-to-deform flexible pipe.

According to a 36th aspect of the present invention, there is provided the device for discharging fluid according to the 23rd aspect, wherein the device for relatively moving the two members is an electro-magnetostriction element.

According to a 37th aspect of the present invention, there is provided a method for discharging fluid, comprising: while keeping two members for relatively moving to each other along a gap direction, feeding fluid from a fluid supply device to the gap; and controlling interruption and release of fluid discharge by utilizing a pressure change made by changing the gap, and assuming that a minimum value or a mean value of the gap is $h_0$, performing the fluid discharge with the gap $h_0$ is set to a range of $h_0>h_x$, where a setting range of the gap $h_0$ over which a steady-state discharge amount Q of the fluid is generally proportional to the gap $h_0$ is $0<h_0<h_x$, and where a setting range of the gap $h_0$ over which the discharge amount is generally constant independent of the gap $h_0$ is $h_0>h_x$.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
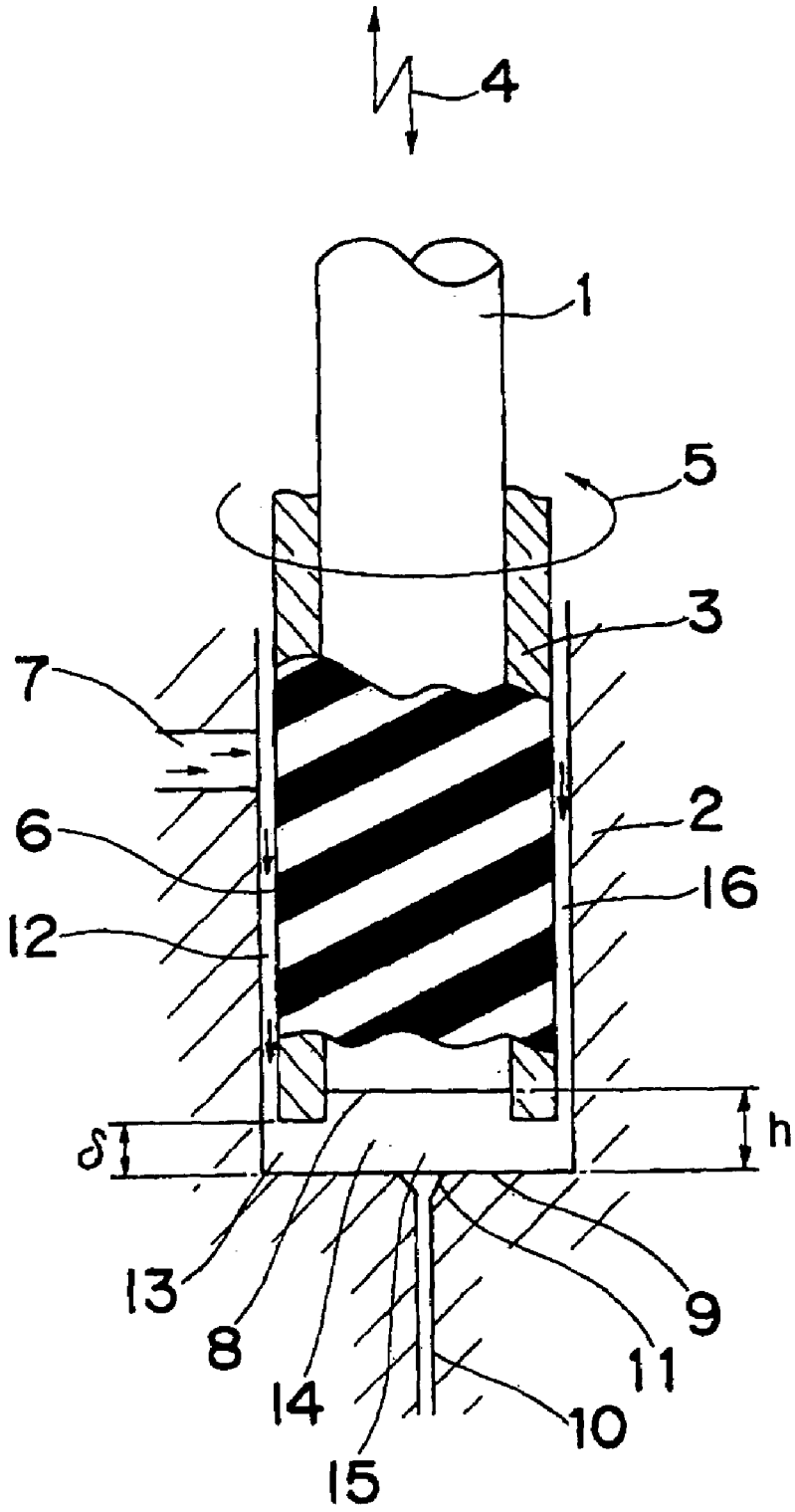
FIG. 1 is a partially sectional view of an example model to which the present invention is applied.

Before the description of the present invention proceeds, it is to be noted that like parts are designated by like reference numerals or like names throughout the accompanying drawings.

FIG. 1 is a model view showing a first embodiment of the present invention. Reference numeral 1 denotes a piston, which is housed in a housing 2 so as to be movable in an axial direction. Numeral 3 denotes a sleeve 3 for housing an outer peripheral portion of the piston 1, the sleeve 3 being housed in the housing 2 so as to be not movable in the axial direction but movable in a rotational direction, relative to the housing 2 on the fixed side.

The piston 1 and the sleeve 3 are driven by an axial direction drive device (arrow 4) and a rotation transfer device (arrow 5), respectively. Numeral 6 denotes a thread groove (black solid portions in FIG. 1) formed in relatively moving surfaces of the sleeve 3 and the housing 2, and 7 denotes a suction port of a fluid. In this embodiment, a thread groove pump is used as the fluid supply device.

Numeral 8 denotes an end surface of the piston 1, and 9 denotes its fixed-side opposing surface. Numeral 10 denotes a discharge nozzle formed in the central portion of the fixed-side opposing surface 9, and 11 denotes an opening of the discharge nozzle 10 formed in the fixed-side opposing surface 9. The piston end surface 8 and the fixed-side opposing surface 9 serve as the two surfaces that relatively move to each other along the gap direction.

Numeral 12 denotes a coating fluid fed between the sleeve 3 and the housing 2. Numeral 13 denotes a discharge-chamber end portion (outer periphery of the piston) formed between a lower end portion of the sleeve 3 and the housing 2. The fluid is fed in this discharge-chamber end portion 13 by a thread groove pump, which is a fluid supply device, at all times.

The axial direction drive device 4 is provided between the piston 1 and the housing 2 and changes relative positions of these two members 1, 2 in the axial direction. This axial direction drive device 4 is implemented, for example, by a piezoelectric actuator (indicated by 100 in FIG. 9) or the like as will be described later in the first embodiment. A gap "h" between the piston end surface 8 and its opposing surface 9 can be changed by this axial direction drive device 4.

In this embodiment, constituent conditions differ from those of the preceding proposal (Japanese Patent Application No. 2001-110945) as follows.

① If the minimum value of the gap "h" between the piston end face and its opposing surface is assumed as $h=h_{min}$, then $h_{min}$ is enough large in one working example of the embodiment, for example, $h_{min}=150$ μm ② The thread groove pump is designed so as to be close to a constant rate pump, its internal resistance $R_s$ being enough large.

When the gap "h" is changed by a high frequency, a fluctuating pressure is generated to a discharge chamber 14 (piston end face portion), which is a gap portion between the piston end surface 8 and its opposing surface 9, by the later-described secondary squeeze effect newly found in this proposal.

In the central portion of the piston end surface 8, a portion positioned at an indication of numeral 15 is referred to as upstream side of the discharge nozzle 10, and a gap portion formed by the thread groove and the housing 2 is referred to as a thread groove chamber 16. A constant amount of fluid is fed to the discharge chamber 14 by the thread groove pump.

This example to which the present invention is applied is based on the concept that performing analog-to-digital conversion of a continuous flow (analog) fed from the pump into an intermittent flow (digital) by using the secondary squeeze effect makes it implementable to intermittently apply the fluid at high speed while the gap "h" between the piston end face and its opposing surface is maintained enough large.

<1> Theoretical Analysis (1) Deriving Fundamental Equations

In order to reveal principles and effects of the present invention, fundamental equations of the squeeze pump (tentative name) are derived.

A fluid pressure when a viscous fluid is placed in a narrow gap between planes opposed to each other and the gap size changes with time can be obtained by solving the following Reynolds equation including a term of a squeeze action in polar coordinates.

$$\frac{1}{r}\frac{d}{dr}\left(r\frac{h^3}{12\mu}\frac{dP}{dr}\right)=\frac{dh}{dt} \tag{1}$$

Figure 2:
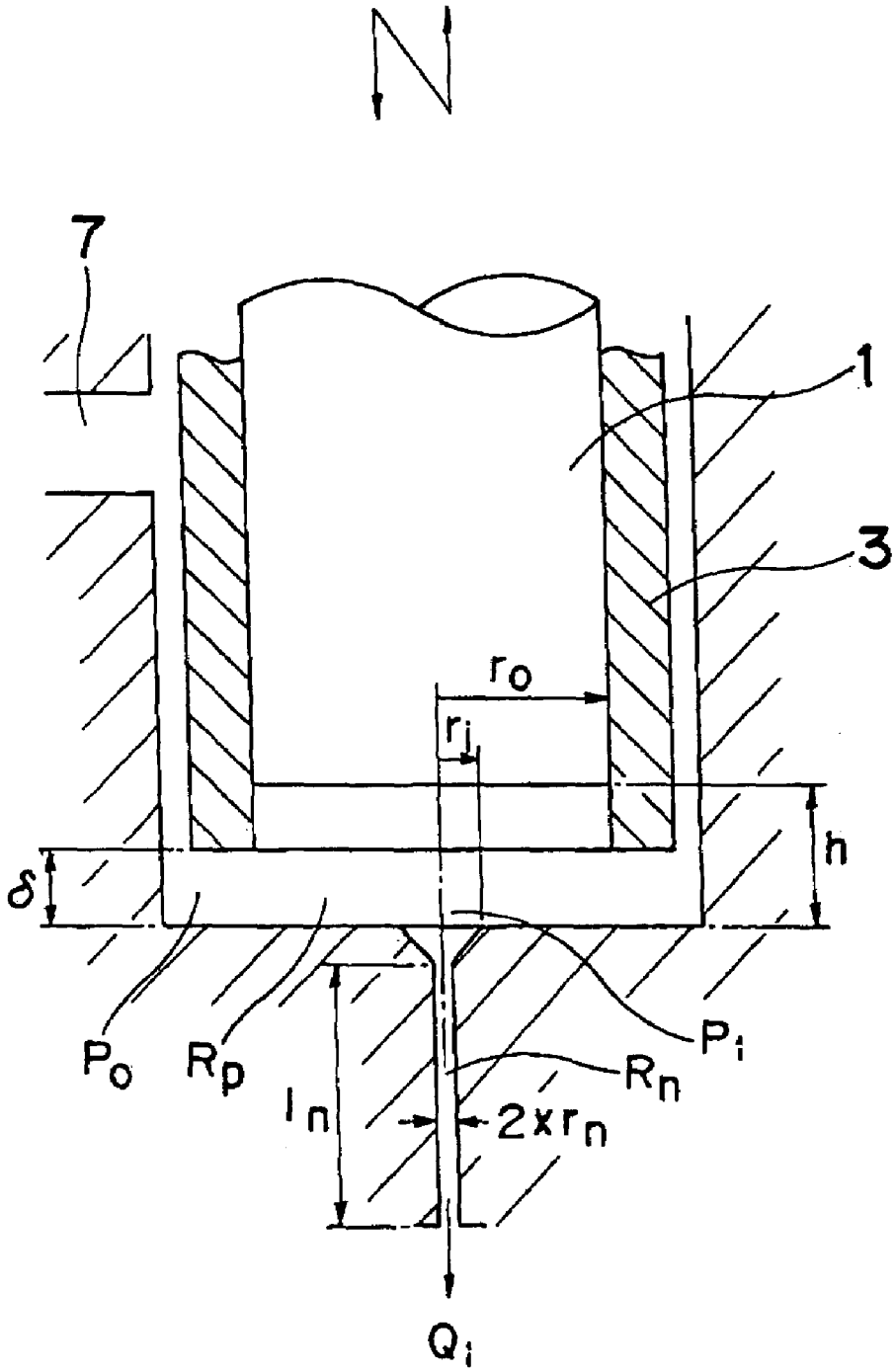
FIG. 2 is a partially sectional view showing a dimensional relation among individual constitute members.

In Equation (1), 'P' represents a pressure, 'μ' represents a viscosity coefficient of a fluid, 'h' represents a gap between the opposing surfaces, 'r' represents a position in the radial direction, and 't' represents time. Also, the right side is a term for producing a squeeze action effect generated when the gap changes. FIG. 2 shows a relationship among dimensions of the squeeze pump. In addition, a suffix 'i' added to symbols shows that the value is one at the position of the opening 11 of the discharge nozzle in FIG. 1, and a suffix '0' shows that the value is one at the discharge-chamber end portion 13 (outer periphery of the piston).

Assuming that $\dot{h}=dh/dt$, both sides of Equation (1) are integrated.

$$\frac{dP}{dr}=\frac{12\mu}{h^3}\left(\frac{1}{2}\dot{h}r+\frac{c_1}{r}\right) \tag{2}$$

$$P=\frac{12\mu}{h^3}\left(\frac{1}{4}\dot{h}r^2+c_1\ln r\right)+c_2 \tag{3}$$

Subsequently, undetermined constants $c_1$, $c_2$ are determined. The relationship between pressure gradient and flow rate is:

$$\frac{dP}{dr}=Q\frac{6\mu}{h^3\pi r} \tag{4}$$

Assuming that flow rate $Q=Q_i$ at $r=r_i$ (see FIG. 2), $c_1$ is determined from Equations (2) and (4):

$$c_1=\frac{Q_i}{2\pi}-\frac{\dot{h}}{r}r_i^2 \tag{5}$$

When the fluid resistance $R_s$ between the discharge-chamber end portion 13 and the fluid suction port 7 is not negligible, a pressure $P=P_0$ in the discharge-chamber end portion 13 (the position of $r=r_0$ in FIG. 2) is $$P_0=P_{s0}-R_sQ_0 \tag{6}$$

When a thread groove pump is used as the fluid supply device, the fluid resistance $R_s$ equals to the internal resistance of the thread groove pump. In the above equation, $P_{S0}$ represents the supply-source pressure, which corresponds to a sum of a maximum generated pressure $P_{max}$ of the thread groove pump and a supply pressure $P_{sup}$ by the air for supplying the material to the thread groove ($P_{S0}=P_{sup}+P_{max}$). From Equation (4), $Q_0$ representing the flow rate at $r=r_0$ is determined:

$$Q_0=\frac{h^3\pi r_0}{6\mu}\left(\frac{dP}{dr}\right)_{r=r0}=\pi\dot{h}r_0^2+2\pi c_1 \tag{7}$$

From Equation (3) and Equations (5) to (7), the undetermined constant $c_2$ is determined:

$$c_2=P_{s0}-R_sQ_0-\frac{6\mu}{h^3}\left\{\frac{1}{2}\dot{h}r_0^2+\left(\frac{Q_i}{\pi}-\dot{h}r_i^2\right)\ln r_0\right\} \tag{8}$$

Now assume that a pressure P at an arbitrary position r is set as:

$$P=A+BQ \tag{9}$$

where $$A=P_{S0}-R_S\pi\dot{h}(r_0^2-r_i^2)-\frac{3\mu\dot{h}}{h^3}\left\{(r_0^2-r^2)+2r_i^2\ln\frac{r}{r_0}\right\} \tag{10}$$

$$B=\frac{6\mu}{h^3\pi}\ln\frac{r}{r_0}-R_S$$

In the opening of the discharge nozzle, where $r=r_i$ (indicated by numeral 11 in FIG. 1), it is assumed that $P_i=A+BQ_i$. When the fluid resistance of the discharge nozzle is $R_n$, the flow rate of the fluid passing through the discharge nozzle is obtained as $Q_n=P_i/R_n$. From the continuity of flow, it holds that $Q_i=Q_n$, and the pressure $P_i$ of the discharge-nozzle upstream side (pressure at the portion 15 in FIG. 1) is determined as:

$$\begin{aligned}P_i&=\frac{A_iR_n}{R_n-B_i}\\&=\frac{R_n}{R_n+R_p+R_S}\left[P_{S0}-R_S\pi\dot{h}(r_0^2-r_i^2)-\frac{3\mu\dot{h}}{h^3}\left\{(r_0^2-r_i^2)+2r_i^2\ln\frac{r_i}{r_0}\right\}\right]\end{aligned} \tag{11}$$

where $A_i$ and $B_i$ are the values of A and B, respectively, when $r=r_i$ in Equation (10). Hereinafter, the discharge nozzle upstream-side pressure $P_i$ will be referred to as discharge pressure $P_i$.

Here, a primary squeeze pressure $P_{squ1}$ and a secondary squeeze pressure $P_{squ2}$ are defined as follows:

$$P_{squ1}=-\frac{3\mu\dot{h}}{h^3}\left\{(r_0^2-r_i^2)+2r_i^2\ln\frac{r_i}{r_0}\right\} \tag{12}$$

$$P_{squ2}=-R_S\pi\dot{h}(r_0^2-r_i^2)$$

The primary squeeze pressure $P_{squ1}$ is attributed to the known squeeze effect that is generated between piston end face 8 and its relatively-moving surface 9 by abruptly changing the gap between the piston end surface 8 and its relatively-moving surface 9, where the narrower the gap "h", the larger the generated pressure.

A method for generating the secondary squeeze pressure $P_{squ2}$, and a method for applying this action to, for example, ultra-high speed intermittent application are those that the present invention has found, and their principles are as follows. When the gap between the piston end face and its relatively-moving surface is abruptly changed, there occurs a flow rate change between the piston end face and the fluid supply source. This flow rate change corresponds to a capacity change of the discharge chamber 14 (piston end face portion) resulting when the gap is changed. For example, in the case where the capacity has decreased, if the flow resistance of the discharge nozzle is large, the fluid, which cannot find any escape place on the discharge side, flows back toward the thread groove pump side. As a result, a pressure $P_{squ2}$ proportional to the internal resistance $R_s$ of the thread groove pump is generated.

From Equations (11) and (12), the pressure $P_i$ on the discharge-nozzle upstream side can be reduced as follows:

$$P_i = \frac{R_n}{R_n + R_p + R_S}(P_{S0} + P_{squ1} + P_{squ2}) \tag{13}$$

The flow rate $Q_i$ of the fluid passing through the discharge nozzle is $$Q_i = \frac{1}{R_n + R_p + R_S}(P_{S0} + P_{squ1} + P_{squ2}) \tag{14}$$

If the radius of the discharge nozzle is set as $r_n$ and the nozzle length is $l_n$, then the discharge nozzle resistance is $$R_n = \frac{8\mu l_n}{\pi r_n^4} \tag{15}$$

Furthermore, $R_p$ is the fluid resistance between the discharge nozzle opening (indicated by 11 in FIG. 1) and the outer periphery of the piston (discharge-chamber end portion 13 in FIG. 1).

$$R_p = \frac{6\mu}{h^3\pi}\ln\frac{r_0}{r_i} \tag{16}$$

As described before, $R_s$ is the fluid resistance (internal resistance in the case of the thread groove pump) between the outer periphery of the piston (discharge-chamber end portion 13 in FIG. 1) and the flow passage on the supply source side (suction port 7).

(2) Equivalent Circuit Model

Figure 3:
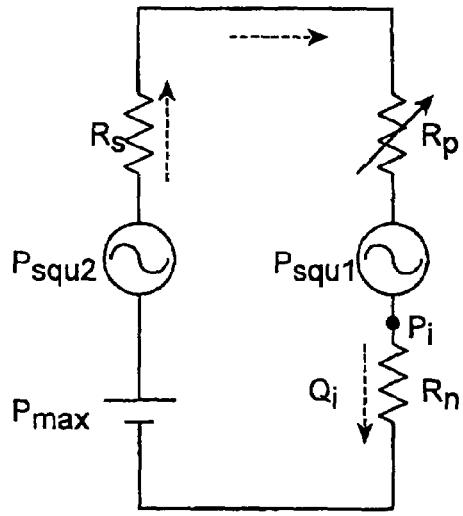
FIG. 3 is an equivalent electric circuit model view of an example to which the present invention is applied.

Based on the above-described analysis results, the relationship between the pressure generation source and the load resistance can be expressed with an equivalent electric circuit model as shown in FIG. 3.

Figure 4:
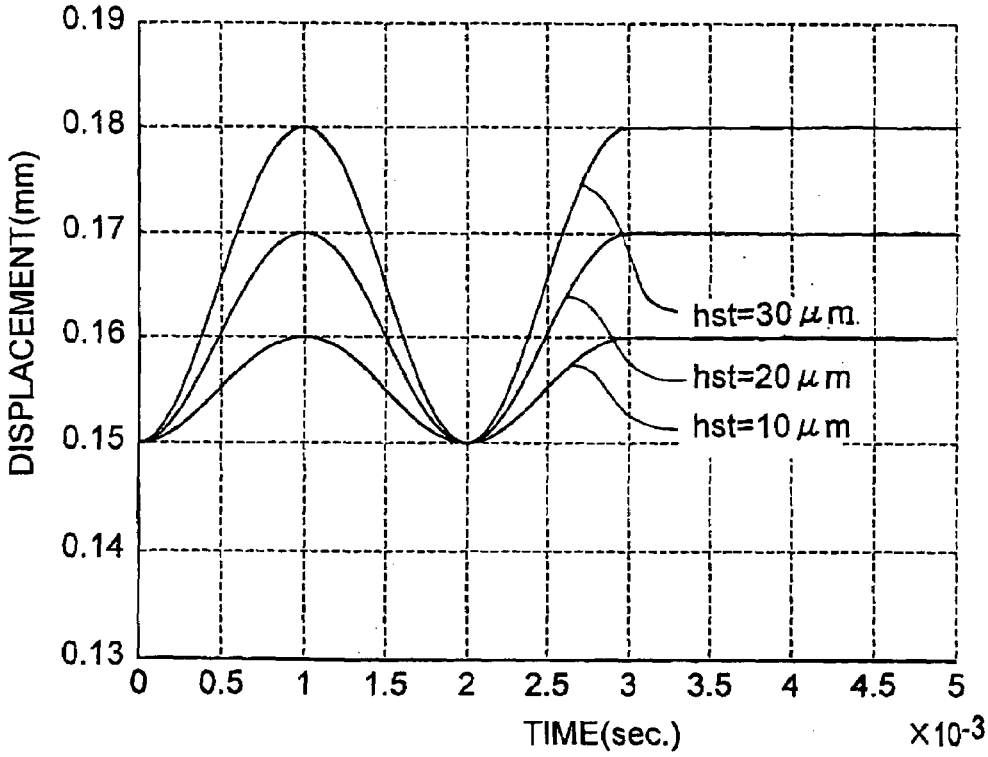
FIG. 4 is a graph showing an example of a piston displacement curve.
Figure 5:
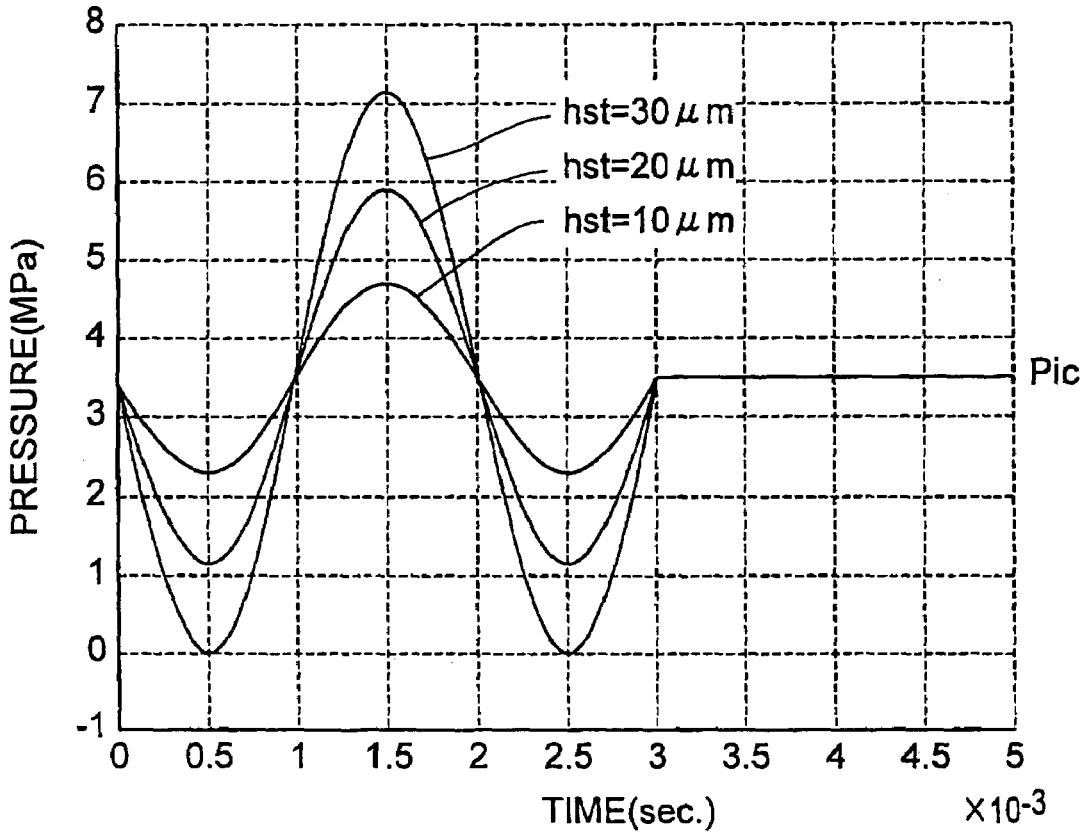
FIG. 5 is a graph of an analysis result of discharge pressure characteristics of the present invention.

(3) When the Minimum Gap $h_{min}$ of the Piston End Face and its Opposing Surface is Enough Large Given the conditions of Table 1 and the piston input waveform of FIG. 4, results of determining the pressure $P_i$ of the discharge nozzle opening by using Equation (11) are shown in FIG. 5, where a period of $0 \leqq t \leqq 2.0$ msec corresponds to one cycle as an intermittent discharging device.

It is noted that the input waveform of the piston was evaluated by changing the stroke in three cases (hst=10, 20, 30 μm) while the minimum gap between the piston end face and its opposing surface was maintained constant ($h_{min}$=150 μm).

Referring to FIG. 5, in any case of the above strokes, the pressure results in a waveform that fluctuates around $P_{ic}$=3.5 MPa.

Figure 6:
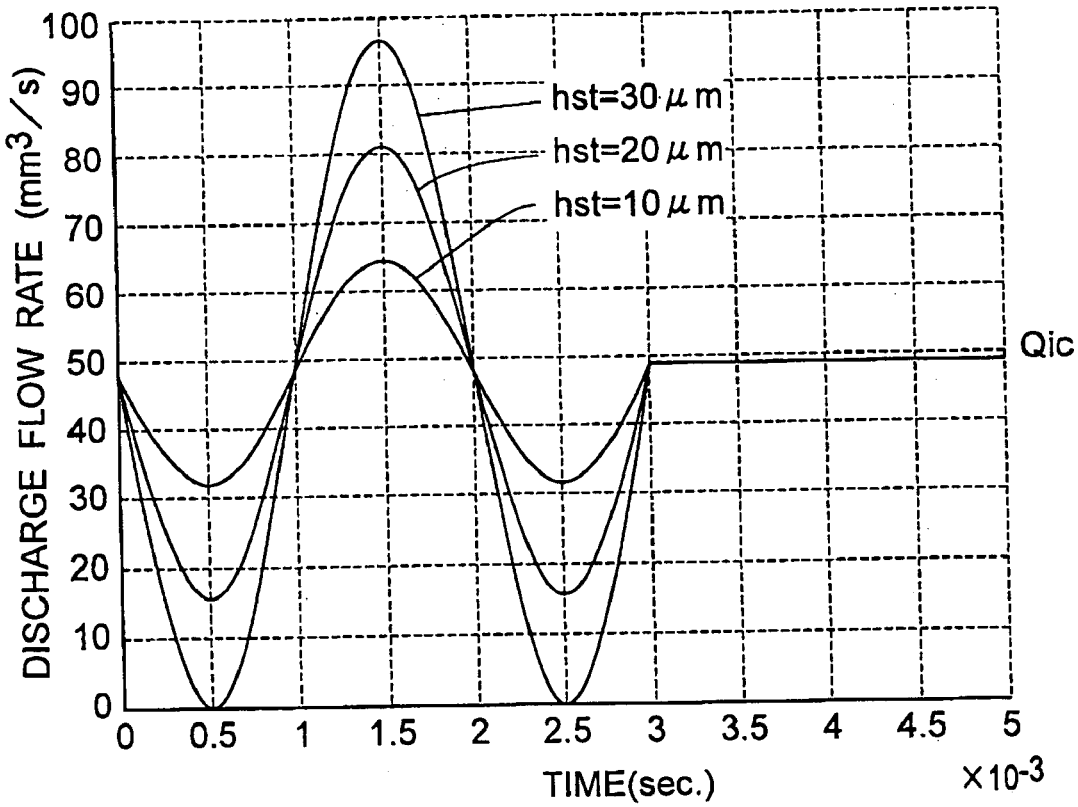
FIG. 6 is a graph of an analysis result of discharge flow rate characteristics of the present invention.

FIG. 6 shows analysis results of the flow rate $Q_i$ of the fluid passing through the discharge nozzle. When the discharge nozzle resistance is $R_n$, the flow rate $Q_i=P_i/R_n$. The flow rate $Q_i$, although differing in amplitude depending on the stroke, results in a waveform that fluctuates around $Q_{ic}$=49 mm$^3$/sec like the pressure waveform. Accordingly, it can be understood that the average flow rate does not depend on the extent of the piston stroke, and is determined by the working point (A in FIG. 8) that depends on thread groove pump characteristics and discharge nozzle resistance.

The reason of this is that if $h \to \infty$ in Equation (11), then primary squeeze pressure $P_{squ1} \to 0$ and $R_P \to 0$. Therefore, the following equation can be obtained:

$$P_i = \frac{R_n R_S}{R_n + R_S}\left[Q_{\max} - \pi(r_0^2 - r_i^2)\frac{dh}{dt}\right] \tag{17}$$

where $P_{s0} \approx P_{max}$, and $R_s = P_{max}/Q_{max}$.

The second term in Equation (17) corresponds to a geometrical capacity change of the piston end face portion 14 formed by the piston end face 8 and its opposing surface 9. The time differential (dh/dt) of the displacement h is a periodic function having positive and negative values alternately, and the time integral value in one cycle is 0.

That is, the secondary squeeze pressure $P_{squ2}$ fills the role of an A/D converter that converts a continuous flow rate (analog) of the thread groove to an intermittent flow rate (digital).

TABLE 1

| | Symbol | Specifications |
|---|---|---|
| Viscosity | μ | 3000 mPas (cps) |
| Thread groove pump performance | | |
| Max. Flow rate | $Q_{max}$ | 77.35 mm$^3$/sec |
| Max. Pressure | $P_{max}$ | 10 MPa |
| Piston outer diameter | $D_o$ | 3 mm |
| Min. gap of piston end face and its opposing surface | $h_{min}$ | 150 μm |
| Piston stroke | $h_{st}$ | FIGS. 4 to 6 |
| Period | T | 2 msec |
| Diameter of discharge nozzle | $r_n$ | 0.15 mm |
| Length of discharge nozzle | $l_n$ | 0.3 mm |

Figure 8:
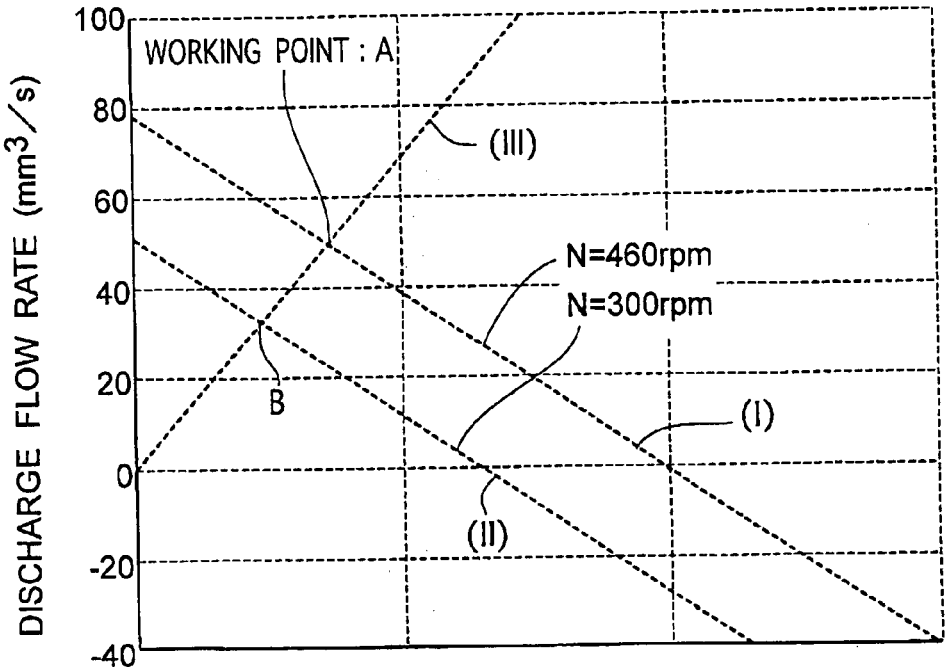
FIG. 8 is a view showing a relation between flow rate and pressure of a thread groove pump.

In FIG. 8, reference character (I) indicates a relation between the pressure and flow rate of the thread groove pump (which is called pressure-flow rate characteristic) at a number of rotations of N=460 rpm, where the maximum pressure is $P_{max}$=10 MPa (at Q=0) and the maximum flow rate is $Q_{max}$=77.35 mm$^3$/sec (at P=0). Character (III) indicates the flow resistance of the discharge nozzle, and the intersection point of (I) and (III) becomes a thread groove pump working point A ($P_{ic}$=3.5 MPa, $Q_{ic}$=49 mm$^3$/sec)

An example of the thread groove that can obtain the above pump characteristics is shown in Table 2.

The pressure of the X axis in the graph of FIG. 8 is defined as the differential pressure ($P_2-P_1$) between a pressure $P_2$ of the discharge-chamber end portion 13 and a pressure $P_1$ of a vicinity of the suction port 7. The thread groove pump is enabled to transport the largest flow rate of fluid when the differential pressure is at a minimum, i.e., when the piston 1 has ascended so that the pressure of the lower end portion of the thread groove 6 (discharge-chamber end portion 13) becomes $P_2$=−0.1 MPa (absolute vacuum). Therefore, in the graph of FIG. 8, although the maximum transport amount of the pump is the flow rate of Q≈80 $mm^3$/sec at P=−0.1 MPa, the maximum flow rate is assumed to be $Q_{max}$=77.35 $mm^3$/sec at P=0 MPa (atmospheric pressure) for convenience' sake, where there is no considerable error involved.

(4) Improvement of Sharpness

In the case where fluid lumps are continuously blown onto the substrate while the discharge head and the substrate are being moved relative to each other, the waveform of the discharge pressure is preferably such that the discharge pressure becomes a negative pressure immediately before the start of application, immediately thereafter shows generation of a positive pressure having an abrupt peak, and goes again a negative pressure. By the generation of the negative pressure after the discharge, the fluid at the top end of the discharge nozzle is sucked again into the nozzle inside, being separated from the fluid present on the substrate or the fluid that is flying. That is, by the cycle of "negative pressure→abrupt positive pressure→negative pressure," an intermittent application of extremely sharpness can be fulfilled.

None of the pressure waveforms in FIG. 5, where $P_i$>0 in every case, satisfies the conditions that allow-an intermittent application of good sharpness to be fulfilled. If the maximum value of the time differential (piston speed) dh/dt of displacement h is expressed as Vmax, then the condition for the pressure waveform to have a period in which the pressure becomes a negative pressure, $P_i$<0, is derived from Equation (17):

$$Q_{max} < \pi(r_0^2 - r_i^2)v_{max} \tag{18}$$

A $Q_{max}$ that satisfies Equation 18 can be obtained by changing the number of rotations of the thread groove pump if the thread groove pump is used as the fluid supply device. The smaller the value of $Q_{max}$, the longer the time during which a negative pressure is generated since the supply amount cannot follow the capacity increase of the squeeze pump.

Figure 7:
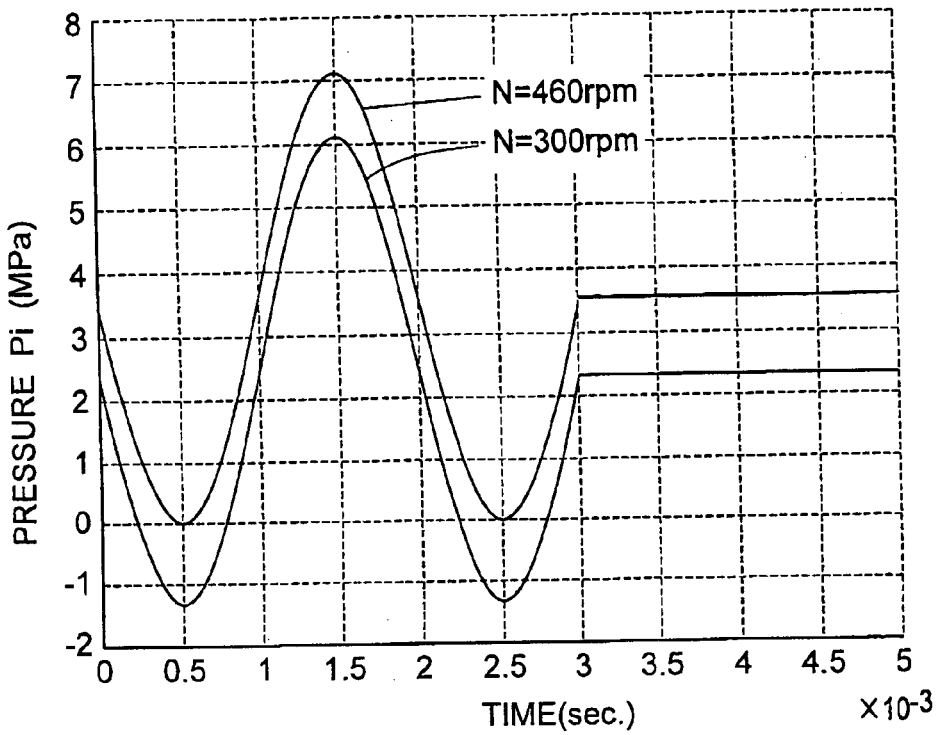
FIG. 7 is a graph of an analysis result of comparing discharge pressure characteristics with the number of rotations changed.

With a stroke of $h_{st}$=30 μm and under the conditions of Table 1, a waveform of discharge pressure resulting when the maximum flow rate is reduced as $Q_{max}$77.35→50 $mm^3$/sec with the reduction of the number of rotations of the thread groove as N=460→300 rpm is shown in FIG. 7, in comparison with the case of N=460 rpm. Pressure-flow rate characteristics of the thread groove pump at the number of rotations of N=300 rpm are shown in FIG. 8. The working point of the pump in this case moves from A to B. Referring to FIG. 7, the case of N=300 rpm ($Q_{max}$=50 $mm^3$/sec) satisfies Equation (18), where the waveform of discharge pressure is such that the discharge pressure becomes a negative pressure immediately before the start of application, then shows generation of an abrupt positive pressure, and goes again a negative pressure. The reason why a negative pressure is generated is that before and after the generation of a peak pressure, the magnitude of capacity change at the piston end face portion surpasses the maximum flow rate $Q_{max}$ that the thread groove pump can supply, as described before.

Whereas the minimum value of discharge pressure is $P_i$=−1.4 MPa, this is because the model of analysis is based on an assumption of incompressibility, and there does not exist actually any pressure not higher than −0.1 MPa when the atmospheric pressure is assumed as $P_i$=0.0 MPa (gauge pressure).

The setting of the level of the negative pressure generation may be controlled depending on the conditions of applied process, characteristics of coating material such as its spinnability, which refers to a difficulty in cutting off the coating line flowing out from the nozzle, and the like.

TABLE 2

| Parameter | Symbol | Specifications |
|---|---|---|
| Viscosity | μ | 3000 mPas (cps) |
| Number of rotations | N | 460 rpm |
| Depth of groove | hg | 0.15 mm |
| Gap | ΔR | 0.02 mm |
| Width of ridge | br | 0.5 mm |
| Width of groove | bg | 1.0 mm |
| Pump length | B | 36 mm |
| Groove angle | α | 20 deg. |
| Shaft diameter | $D_n$ | 8.0 mm |

In the foregoing application example of the embodiment of the present invention, as described above, generation of the primary squeeze pressure is suppressed as much as possible by setting a sufficiently large gap between the piston end face and its opposing surface, and by using the secondary squeeze pressure, a continuous flow of fluid supplied from the fluid supply source is converted into an intermittent flow, from analog to digital form, and thus intermittent application is performed. In this case, the application amount per dot does not depend on the stroke of the piston, and is determined only by the pressure-flow rate characteristic of the pump, which is one example of the fluid supply device, and the flow resistance of the discharge nozzle. Therefore, ① The discharge amount per dot is constant; and ② The cycle is constant.

The present application method and device provide an extremely effective method and device for application processes that are required to meet the above conditions of ① and ② at the same time.

For example, the method and device are effective for the case where fluorescent materials of R, G, and B are intermittently applied into independent cells (box-type ribs) of the rear side plate of a plasma display panel (PDP) for color display or other cases. In the case of PDP, independent cells are arranged geometrically symmetrically in a grid shape on the panel with high accuracy as described later in an embodiment of FIG. 15. In this case, this dispenser, which is capable of discharging a certain amount of material into the independent cells at high speed at equal time intervals, can fulfill an incomparable power.

In conclusion, the above-described application example of the embodiment of the present invention has realized a 0.002 sec. or less ultra-high speed intermittent application by focusing on the "geometric symmetry" of the coating object and by performing coating process with this symmetry replaced by "time periodicity."

In addition, in circuit formation or the like, for example, when solder, adhesive material, or the like is applied to a circuit board, the time interval of coating application is usually at random. In contrast, in the case of conventional air type dispensers, the application cycle is on the order of 0.05 to 0.1 sec. at most.

<2> Specific Working Examples

Figure 9:
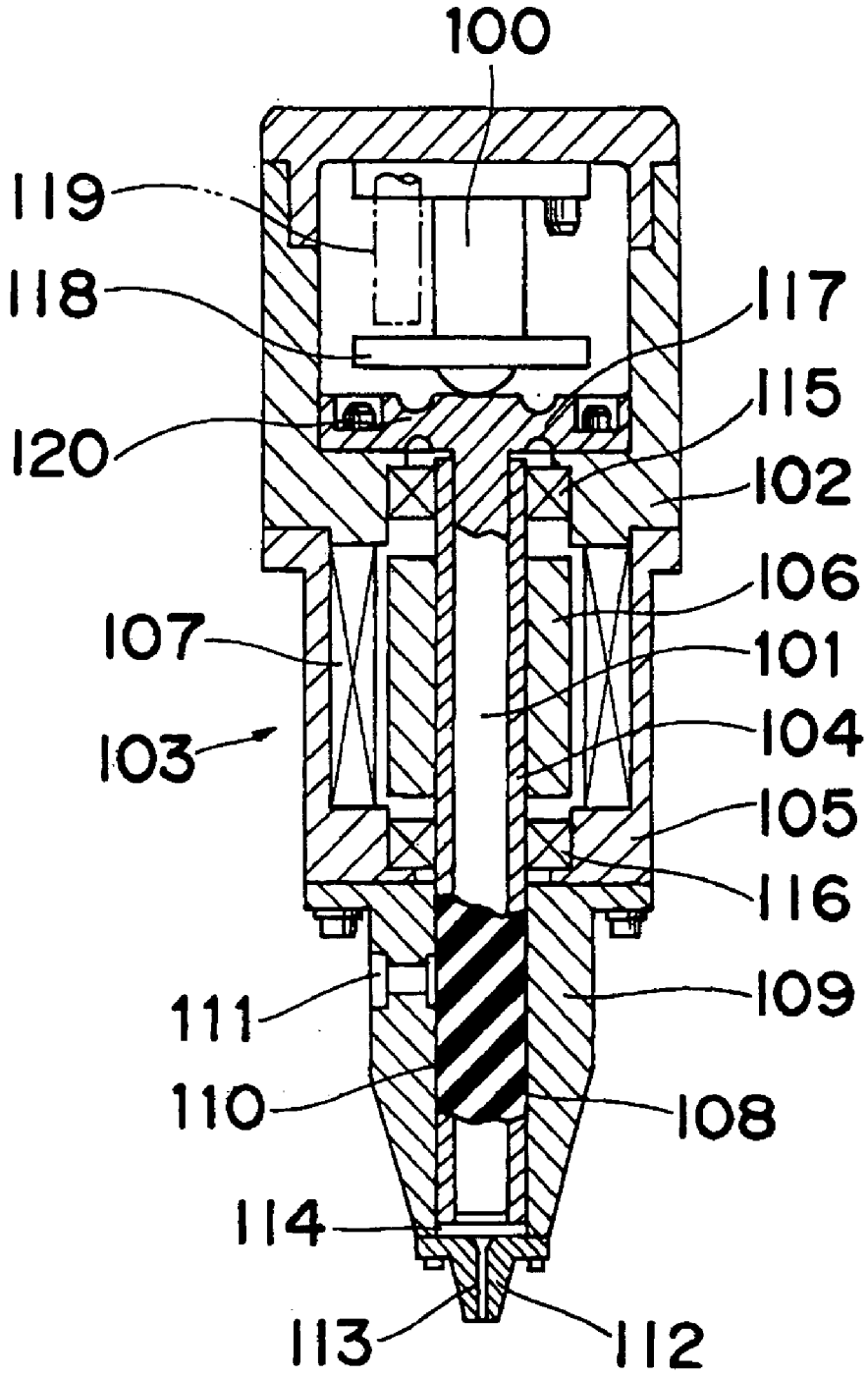
FIG. 9 is a sectional view showing a first working example of the present invention.

FIG. 9 shows a first specific working example of the dispenser structure to which the present invention is applied, showing a constitution where a central shaft (piston) extending through a hollow outer peripheral shaft is provided with an axial direction drive device. Reference numeral 100 denotes a first actuator, which is one example of the axial direction drive device, where an ultra-magnetostrictive element, a piezoelectric element, electromagnetic solenoid, or the like is used. In this first working example, a laminated piezoelectric actuator, which has excellent response and with which high response and large generated load can be obtained, is used.

Numeral 101 denotes a piston to be driven in the axial direction by the piezoelectric actuator 100, which is the first actuator. By the drive of this piston 101, a squeeze pressure described before is generated to the discharge-side end face (discharge chamber) of the piston 101. The first actuator 100 is disposed inside an upper cylinder 102. Numeral 103 denotes a motor as a second actuator, which provides a relative rotational motion between a sleeve 104 for housing the piston 101 and an intermediate cylinder 105. Numeral 106 denotes a rotor of the motor 103, and numeral 107 denotes a stator thereof.

Numeral 108 denotes a thread groove, which is one example of a fluid supply device for pressure-feed to the discharge side the fluid and which is formed on an outer surface of the sleeve 104. A thread groove pump chamber 110 for obtaining a pumping action by a relative rotation of the sleeve 104 and a lower cylinder 109 is formed between the sleeve 104 and the lower cylinder 109.

Furthermore, a suction hole 111 communicated with the thread groove pump chamber 110 is formed in the lower cylinder 109. Numeral 112 denotes a discharge nozzle attached to a lower end portion of the lower cylinder 109, and a discharge hole 113 is formed in its central portion. Numeral 114 denotes a discharge-side thrust end surface of the sleeve 104. Numerals 115 and 116 denote ball bearings for supporting the sleeve 104.

Furthermore, numeral 117 denotes a flange portion disposed on top of the piston 101, 118 denotes a disc portion attached to the piezoelectric actuator 100, 119 denotes a displacement sensor for detecting a position of the piston 101 in the axial direction, and 120 denotes a hinge portion formed so as to elastically deform the flange portion 117 in the axial direction. Dimensions of each member are determined so that an appropriate preliminary pressure is applied to the piezoelectric actuator 100 due to the elastic deformation of the hinge portion 120.

In this first working example, it is arranged that the piston 101 (central shaft) extends through the inside of the sleeve 104, and the piston 101 and the sleeve 104 are driven by independent actuators, respectively. That is, the piston 101 is driven only in the axial direction, and the sleeve 104 is driven only in the rotational direction.

As already proposed in Japanese Patent Application No. 2000-188899 by the present inventor, given a structure (two-degrees-of-freedom actuator structure) that while a linear motion is imparted to the shaft by using an ultra-magnetostriction element (or moving magnet), a rotational motion is also given to the shaft by a motor, it becomes possible to provide a single shaft into which the central shaft and the sleeve are integrated.

Figure 10:
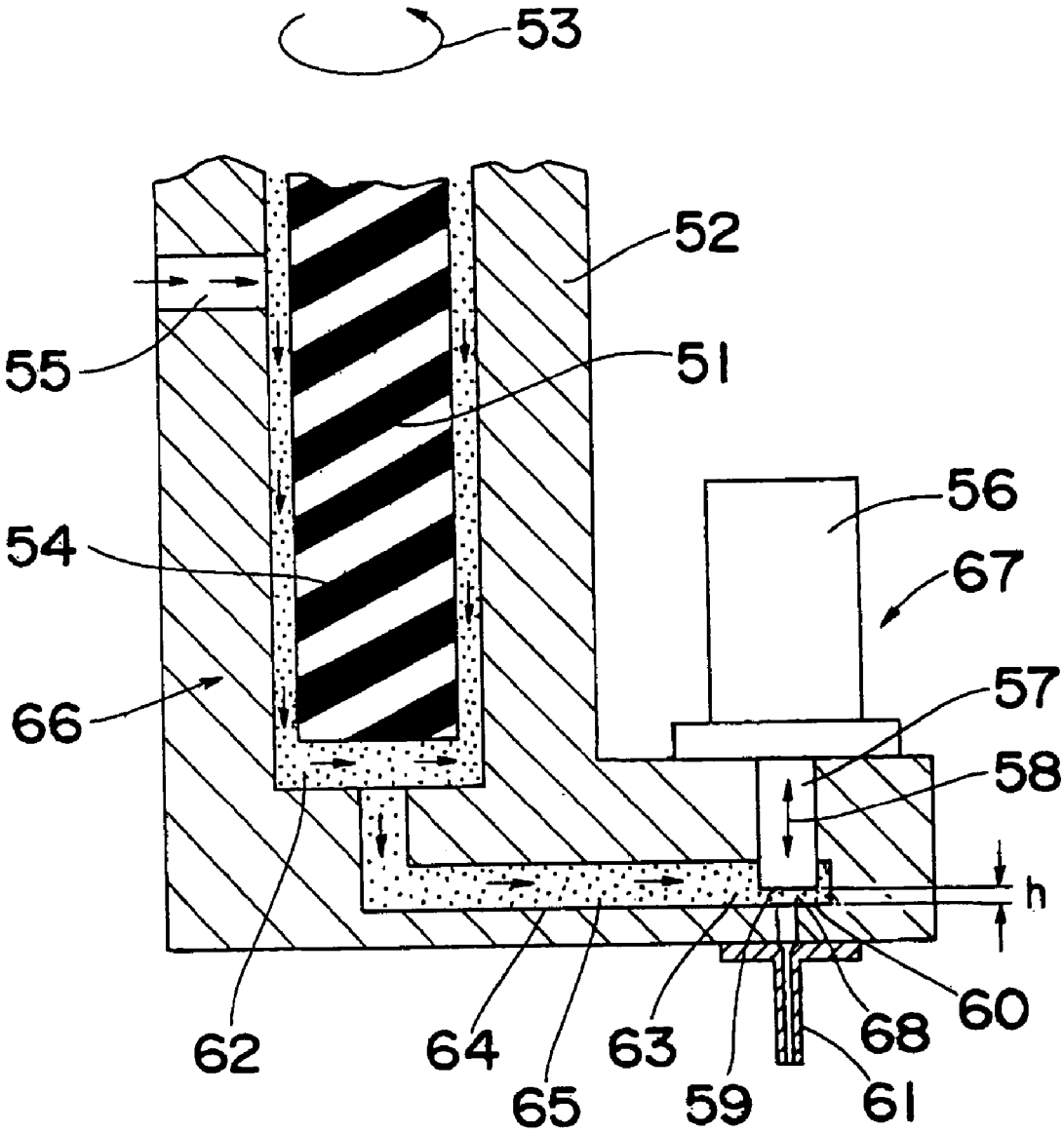
FIG. 10 is a partially sectional view of a model showing a case where the thread groove pump and the piston are separated away from each other, which is a second working example of the present invention.

FIG. 10 shows a second working example of the present invention, showing a case where the thread groove pump, which is one example of a fluid supply device, and the piston are disposed so as to be separate from each other. Reference numeral 51 denotes a main shaft, which is housed in a housing 52 so as to be movable in the rotational direction. The main shaft 51 is driven into rotation by a rotation transfer device (arrow 53) such as a motor. Numeral 54 denotes a thread groove (black solid portion in FIG. 10) formed in relatively moving surfaces of the (sleeve) main shaft 51 and the housing 52, and 55 denotes a suction port of a fluid. Reference numeral 56 denotes an axial direction drive device for moving a piston 57 in the axial direction (arrow 58), 59 denotes an end surface of the piston 57, 60 denotes its fixed-side opposing surface, and 61 denotes a discharge nozzle attached to the housing 52. The piston end surface 59 and the fixed-side opposing surface 60 serve as the two surfaces (discharge chamber) that move relative to each other in the gap direction. Numeral 62 denotes a main shaft end portion, 63 denotes a piston outer periphery, and 64 denotes a flow passage interconnecting the main shaft end portion 62 and the piston outer periphery 63. To the piston outer periphery 63, a coating fluid 65 is fed through the flow passage 64 at all times by the thread groove pump 54, which is one example of the fluid supply device. Numeral 68 denotes a discharge chamber formed between the end face 59 of the piston 57 and its fixed-side opposing surface 60. The axial direction drive device 56 imparts a change in axial-direction relative position between the piston 57 and the fixed-side housing 52. The arrangement that the gap "h" between the end surface 59 and its opposing surface 60 is changed by this axial direction drive device 56 is the same as in the first embodiment of FIG. 1. Similarly, the structural conditions of the thread groove pump and the piston 57 are:

① If the minimum value of the gap "h" between the piston end face and its opposing surface is $h=h_{min}$, then $h_{min}$ is enough large, for example, $h_{min}>50$ μm; and ② The thread groove is designed so as to be close to a constant rate pump, its internal resistance $R_s$ being enough large.

When the application device is so constructed that a pump portion 66, which is one example of the fluid supply device, and a portion for driving the piston by the axial direction drive device (piston drive portion 67) are provided so as to be separate from each other as shown in the second working example, there can be obtained a merit that the device as a whole can be simplified in construction to a large extent depending on the object to which the embodiment is applied. For example, when the piston drive portion is constructed by using a piezoelectric element as the axial direction drive device, the piezoelectric actuator portion can be made enough compact.

Figure 28:
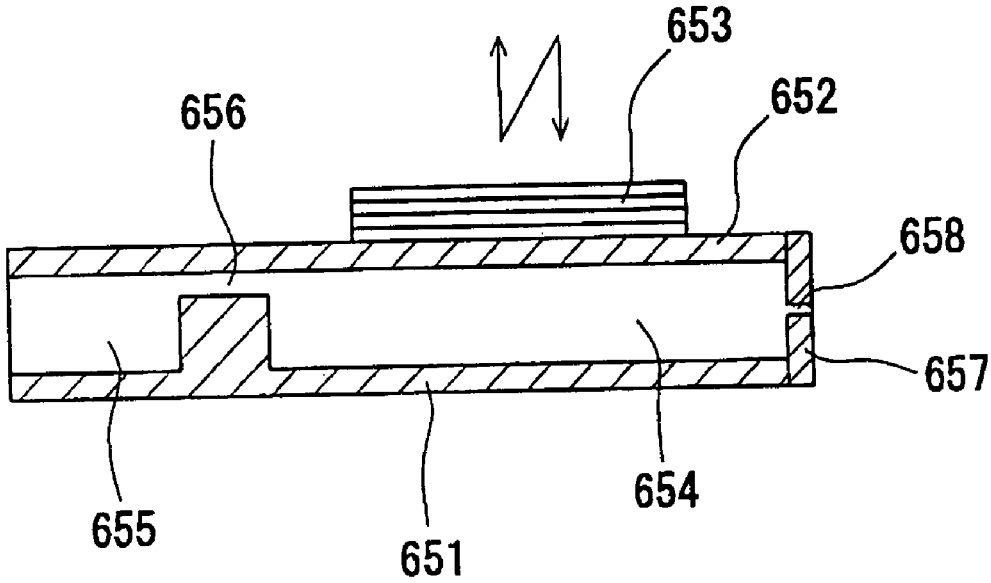
FIG. 28 is a partially sectional view showing a conventional ink jet.
Figure 29:
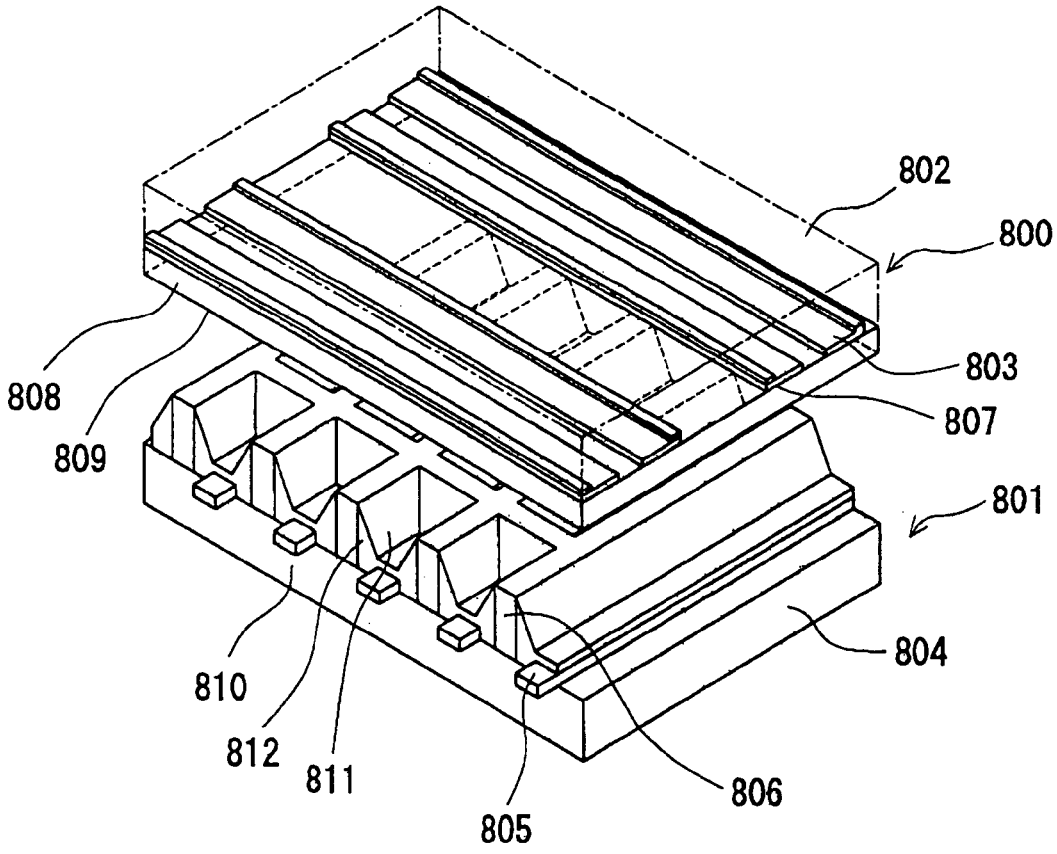
FIG. 29 is a perspective view showing a structure of a PDP panel (PDP).

Here is given a supplementary explanation about the principle of pressure generation of the present invention. Even without using the secondary squeeze pressure, forming a "throttle" on the flow passage between a "piston having a means or device for changing the gap" and a "fluid supply source" makes it possible to generate a pressure. For example, in the case of the conventional ink jet type, the portion indicated by numeral 656 of FIG. 28 corresponds to the throttle. In compression and discharge strokes of the conventional ink jet type, this throttle contributes to the pressure generation. However, in the suction stroke, this throttle becomes a fluid resistance to the supply of fluid from the supply source to the piston portion (discharge chamber). Because of this fluid resistance, especially when a high-viscosity fluid of poor fluidity is intermittently applied at high speed, it is impossible to fill the fluid to the piston portion in short time, which makes a limitation of intermittent application period.

In this second working example of the present invention, a thread groove pump is used, where it is when the differential pressure is at a minimum, i.e. during the suction stroke with the piston moved up, that the thread groove pump can transport the largest flow rate of fluid. The maximum flow rate $Q_{max}$ of the thread groove can be freely selected by the specifications, number of rotations, etc. of the thread groove, regardless of the fluid viscosity. Therefore, the dispenser of the embodiment of the present invention is free of the restrictions imposed on the intermittent period by the fluid filling time during the suction stroke. The role of the thread groove pump in the present invention may be regarded as a "unidirectional diode" that allows the fluid to easily flow forward (toward the discharge side) but not to easily flow backward.

<3> Multi-head Dispenser (1) Issues of Using a Multi-head Dispenser

In either case of the above embodiments or working examples of the dispenser, the dispenser is a single-head type dispenser in which the pump portion, which is one example of the fluid supply device, and the piston drive portion are provided in one pair.

Hereinbelow, measures for further improving the production cycle time of the head in the present invention are described.

As described before, there has been a great desire for realizing a direct patterning method using a dispenser in order to solve the above-described issues for forming the fluorescent-material layer on the PDP, i.e., the issues related to the screen printing method and the photolithography method. However, even in cases where the fluorescent-material layer is formed on the panel screen with a dispenser, there is a demand for a production cycle time equivalent to that of the screen printing method.

In the case where the present invention is applied to a process that a fluorescent material is intermittently applied into the independent cells, the following conditions are required in addition to the above-described conditions of application process, ① the discharge amount per dot is constant, ② the cycle is constant, and ③ ultra-high speed application:

④ the dispenser is a multi-head one; and

⑤ the flow rate of each head can be compensated.

The reason of the condition ⑤ is explained below. With the construction of the application device that the pump, which is one example of the fluid supply device, and the axial direction drive device for driving the piston are provided so as to be separate from each other as shown in the second working example, an application head having multiple nozzles can be realized by supplying the fluid in branches from one set of pump portion to a plurality of piston drive portions.

Figure 11:
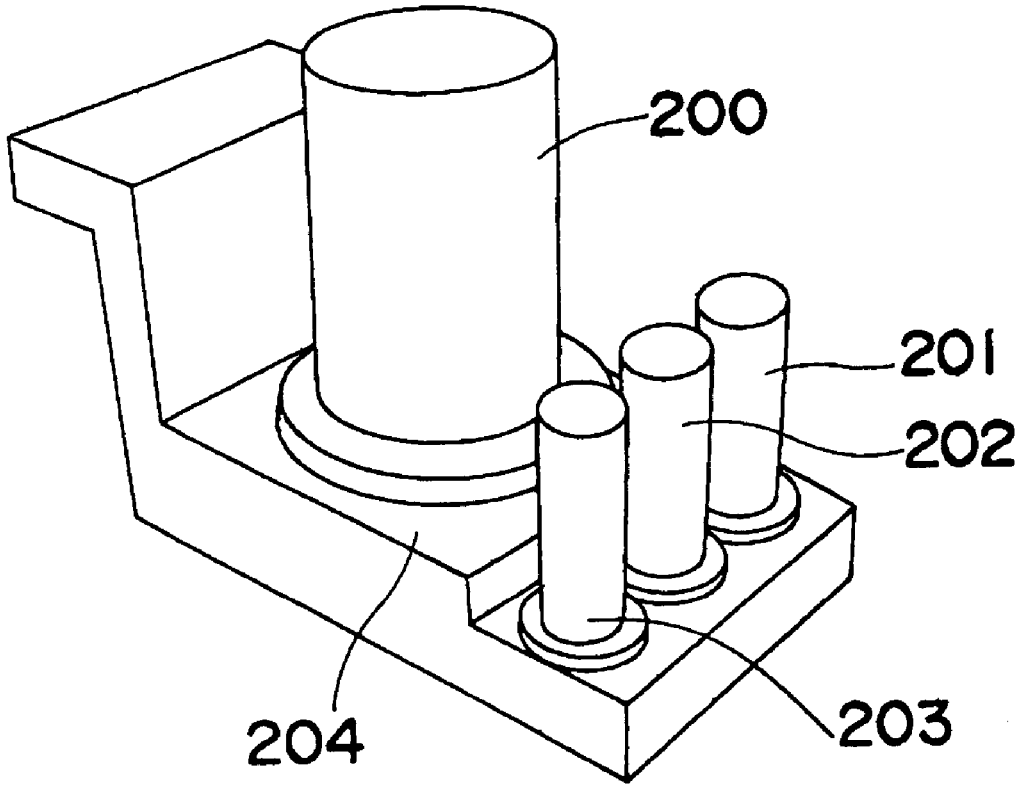
FIG. 11 is a perspective view showing a multi-head, which is a third working example of the present invention.

Referring to the perspective view of FIG. 11, reference numeral 200 denotes a pump portion, which is one example of the fluid supply device, numerals 201, 202, and 203 denote piston drive portions A, B, and C, respectively, each of which is made up of a piezoelectric actuator and a piston. Reference numeral 204 denotes a frame in which a flow passage (corresponding to 64 of FIG. 10) that connects the pump portion 200 and the piston drive portions to each other is formed.

Figure 12:
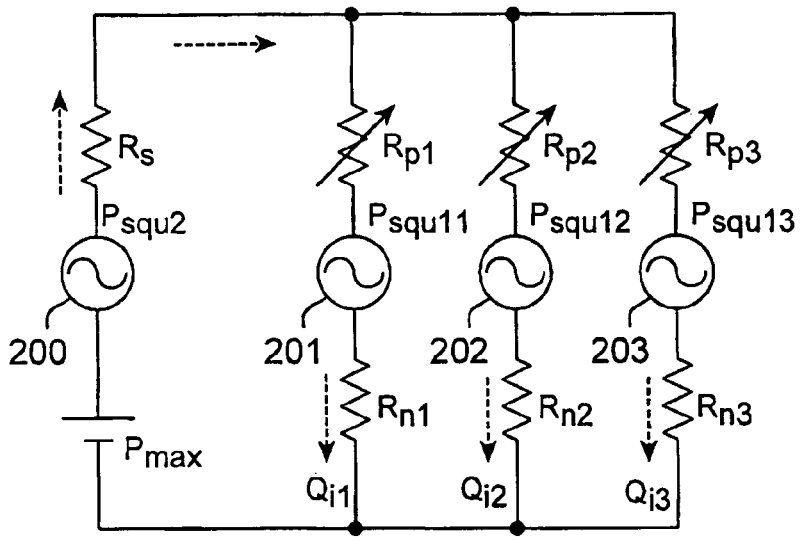
FIG. 12 is a view showing an equivalent electric circuit model in the case of a multi-head.

FIG. 12 shows an equivalent circuit model in the case of the multi-head dispenser. Reference characters $P_{squ11}$, $P_{squ12}$, and $P_{squ13}$ denote primary squeeze pressures of the piston drive portions, respectively, $R_{p1}$, $R_{p2}$, $R_{p3}$ denote fluid resistances of piston end faces in the radial direction, and $R_{n1}$, $R_{n2}$, and $R_{n3}$ denote nozzle resistances, respectively. The magnitude of $R_{p1}$–$R_{p3}$ is inversely proportional to the cube of the gap "h" as shown by Equation 16. $R_{p1}$–$R_{p3}$ represent "variable resistances" that allow the flow rate to be controlled without disassembling the application device.

In the foregoing working example, it has been arranged that the gap "h" between the piston end face and its opposing surface is set enough large so that the generation of the primary squeeze pressure is suppressed as much as possible, where the discharge amount per dot is determined only by the condition setting (e.g., number of rotations) of the pump portion. In the case where the fluid is supplied in branches from one set of pump portion to a plurality of piston drive portions, if the individual piston drive portions can be formed so as to be strictly equal thereamong in dimensional precision, flow passage resistance, and the like, then the fluid is supplied at an equal flow rate from the pump portion to the individual piston drive portions. Yet, for application objects such as displays that are required to meet such precision as a few percents of application amount, it is preferable that the flow rate precision can be finely controlled.

(2) Flow Rate Control Method

Now, discussion is returned again to the fundamental equation (Equation 11) that our study has derived.

Figure 13:
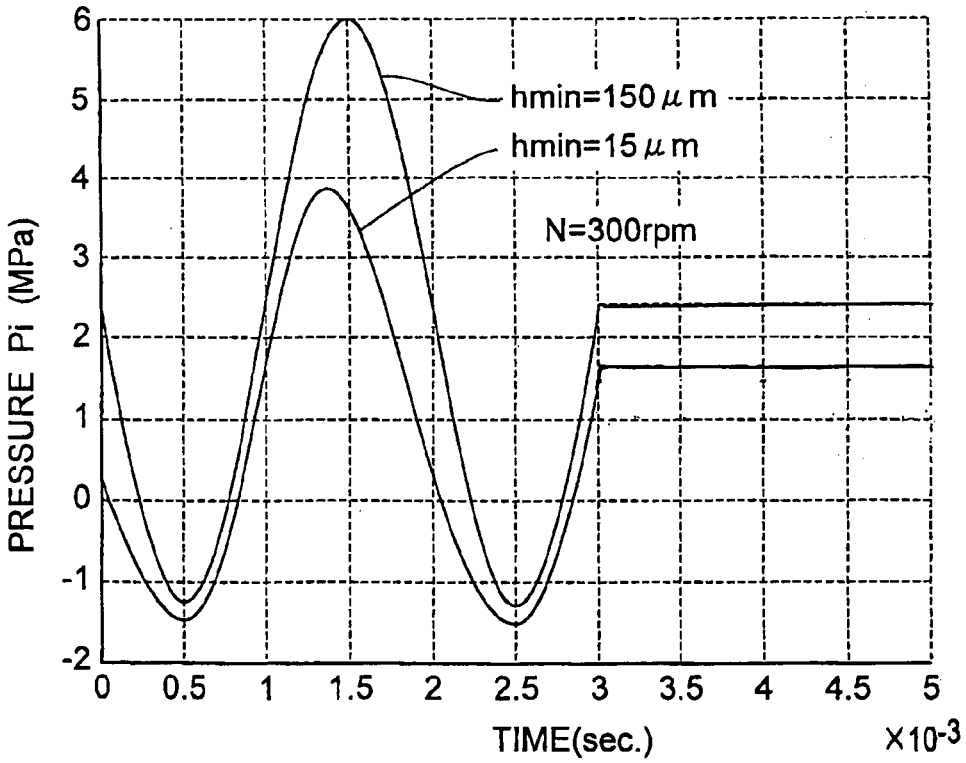
FIG. 13 is a graph of an analysis result of comparing discharge pressure characteristics with the piston minimum gap changed.

The graph of FIG. 13 shows a result of determining and comparing discharge pressure characteristics by using Equation (11) on cases where the piston's minimum gap $h_{min}$=15 μm and $h_{min}$=150 μm, under the condition that the number of rotations of the thread groove is N=300 rpm. On the contrary to an intuitive prediction, such a surprising result can be obtained from the comparison therebetween that as the minimum gap $h_{min}$ of the piston becomes larger, the amplitude of discharge pressure increases. The discharge amount per dot is larger at $h_{min}$=150 μm.

As the minimum gap $h_{min}$ of the piston increases, the primary squeeze pressure $P_{squ1}$ approaches zero ($P_{squ1}\rightarrow 0$). However, since the thrust fluid resistance $R_p$ of the piston end surface and its opposing surface approaches zero ($R_p\rightarrow 0$) concurrently, the partial pressure ratio ($=R_n/(R_s+R_p+R_n)$) increases (see Equation (13)).

Under these analytic conditions, since the effect of the increase in partial pressure ratio is larger than the effect of the approach of $P_{squ1}\rightarrow 0$, the amplitude of the pressure $P_i$ increases along with the increase of $h_{min}$.

Figure 14A:
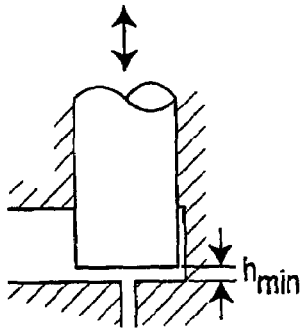
FIG. 14A is a partially sectional view of a model of a vicinity of the piston.
Figure 14B:
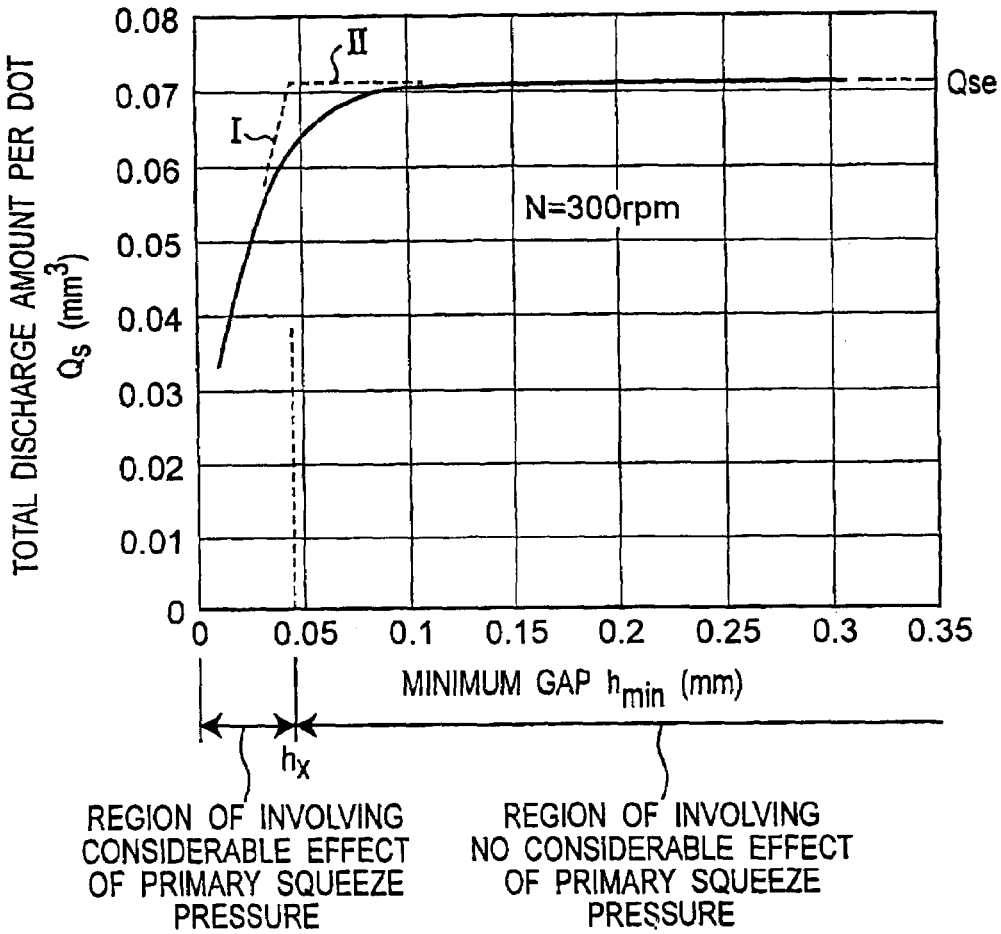
FIG. 14B is a graph showing a relation between the total discharge amount per dot and the minimum gap of the piston according to the present invention.

The graph of FIG. 14B shows a result of determining the discharge amount per dot versus the minimum gap $h_{min}$ of the piston under the condition of N=300 rpm in FIG. 14A. With the minimum gap beyond the neighborhood of $h_{min}$=0.1 mm, the discharge amount per dot $Q_s$ converges to a certain value as $Q_s\rightarrow Q_{se}$ without depending on $h_{min}$. The convergence value $Q_{se}$ of the discharge amount, as described before, is determined by the working point that depends on the pressure-flow rate characteristics of the pump, which is one example of the fluid supply device, and the pump load (discharge-nozzle fluid resistance $R_n$) irrespective of the piston stroke, minimum gap, and the like.

From the findings obtained from the above analyses, the flow rate control of each head may be given by selecting either one of the following:

① With large variations in flow rate among the heads, the minimum gap $h_{min}$ of the piston is set within a range of $0<h_{min}<h_x$, which is a region where a considerable effect of the primary squeeze pressure is involved, i.e., where an abrupt gradient of discharge amount relative to the gap is involved.

② With a desire for ensuring an extremely high accuracy of the application amount per dot, the minimum gap $h_{min}$ of the piston is set to a neighborhood of $h_{min} \approx h_x$ where a smooth gradient of discharge amount relative to the gap is involved.

It is assumed that the value of $h_x$ corresponds to an intersection point between an envelope (I) of a $Q_s$ curve against $h_{min}$ and a straight line (II) of $Q_s = Q_{se}$ in a region of $0 < h_{min} < h_x$.

As to the displacement of the piston, providing a displacement sensor for detecting an absolute position of the piston and performing a closed loop control makes it possible to fulfill any arbitrary positioning control. However, in the case where an electro-magnetostriction element such as a piezoelectric element, ultra-magnetostriction element, or the like is used, because of stroke limitations (0 to several tens of microns), the control of the minimum gap $h_{min}$ of the piston may be done by a combination of mechanical method and electronic-control method.

For example, after the piston position is first roughly determined in a mechanical manner, the piston position of each head may be compensated once again by using electronic control based on data as to flow-rate measurements.

Also, even in either case of foregoing ① or ② for flow-rate control, combinational use of an output-flow-rate setting method for the supply-source pump makes it possible to control the flow rate at points where the gap between the piston end surface and its opposing surface is sufficiently large. As an example, when the flow rate is so large that the minimum gap $h_{min}$ of the piston has to be set to a small one, decreasing the number of rotations of the thread groove pump allows $h_{min}$ to be set to a large one. This makes an advantage when powder and granular material is treated, as will be described later.

The above-described measure used for the compensation of flow-rate differences among the heads of the multiple head is applicable also to the case of a single head. In the case of a single head, with the minimum gap $h_{min}$ of the piston set to a proximity of $h_{min} \approx h_x$ or to a range of $0 < h_{min} < h_x$, the high-speed flow rate control can be performed by controlling $h_{min}$ instead of changing the motor rotation numbers of the pump. The responsivity of the motor rotation numbers control is at a level of 0.01 to 0.05 second at most and limitative, but the control responsivity of the piston that is driven by an electro-magnetostriction element is implementable at a level of 0.001 or less.

Other than the control of the flow rate by the minimum gap $h_{min}$ of the piston, it is also possible to control the flow rate by a mean value or a central value of an input displacement waveform of the piston.

With the piston minimum gap set to a proximity of $h_{min} \approx h_x$ or to a range of $0 < h_{min} < h_x$, for improvement of the sharpness of intermittent application, given a primary squeeze pressure of $P_{squ1} = P_{squ10}$ and a squeeze pressure of $P_{squ2} = P_{squ20}$ when the time differential of the gap "h" has a maximum value in Equation (13), it is appropriate to set the number of rotations of the motor, the piston stroke, the intermittent frequency, and the like so as to satisfy that $P_{s0} + P_{squ10} + P_{squ20} < 0$.

(2) Application Device and Application Method

As one example is shown in the perspective view of FIG. 11, with a construction that a plurality of piston drive portions are provided for one set of the pump portion, which is one example of the fluid supply device, the device as a whole can be downsized to a large extent. Although the pump portion, which is one example of the fluid supply device, usually has limitations in downsizing, the piston drive portion allows a small-diameter piezoelectric actuator or the like to be used therefor, where a multi-head construction, when adopted, allows the pitch between the individual nozzles to be enough small.

Further, it is also possible that with the multi-head shown in FIG. 11 used as a sub-unit, the application device has a plurality of the sub-units in combination.

Figure 15:
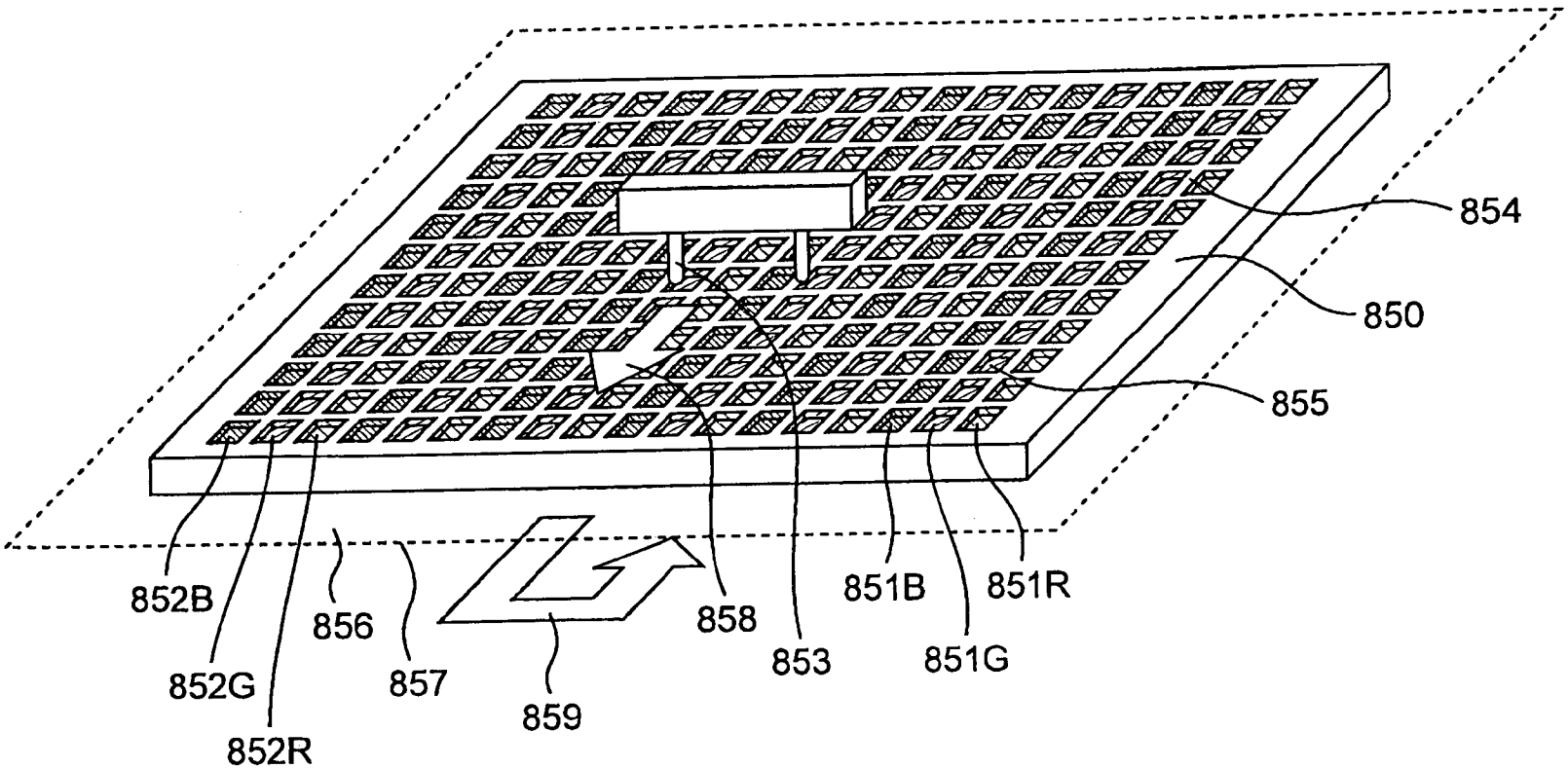
FIG. 15 is a perspective view showing a state that the fluorescent material is implanted into the independent cells of a PDP by a dispenser.

Now, as shown in FIG. 15, a process is assumed in which the fluorescent material is supplied on and on into the independent cells of a PDP while the dispenser of the embodiment or working example of the present invention having multiple nozzles keeps relatively moving above a substrate. Reference numeral 850 denotes a second substrate forming a rear side plate, and 851 denotes independent cells formed by barrier ribs. The independent cells 851 are composed of cells 851R, 851G, and 851B into which fluorescent materials of R, G, and B colors are supplied, respectively. As the fluorescent materials 852, a fluorescent material 852R of R color (red), a fluorescent material 852G of G color (green), and a fluorescent material 852B of B color (blue) are used. In FIG. 15, only the nozzle portion of the dispenser is described, and the dispenser main body is not shown.

Figure 16:
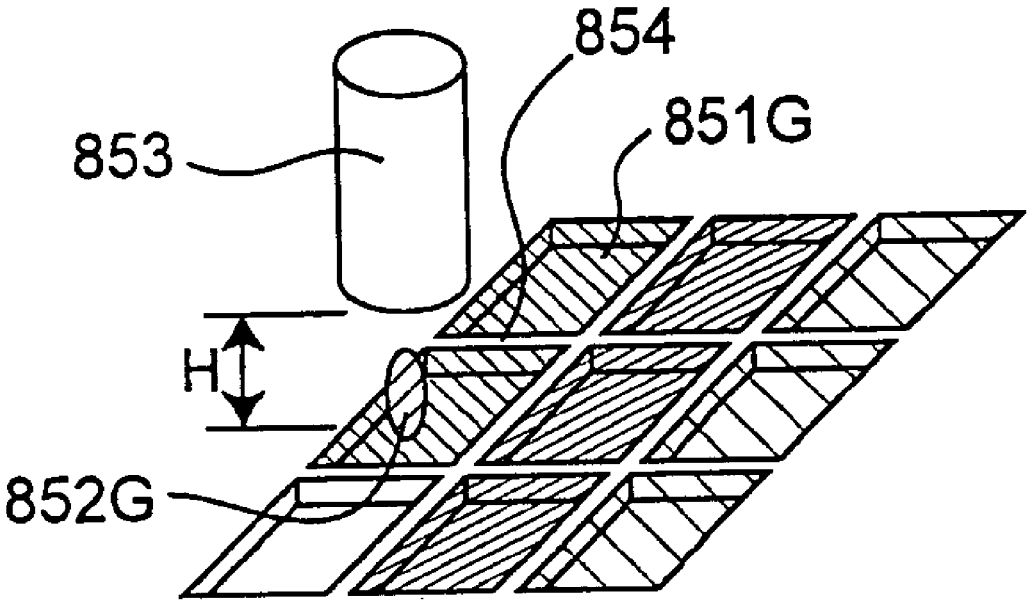
FIG. 16 is an enlarged perspective view of FIG. 15.

Now attention is focused only on one nozzle 853. In this method of making the fluorescent material flown from the dispenser and thereby supplied into the independent cells 851 on and on, a distance H between a tip end of the nozzle 853 and a top 854 of the barrier rib needs to be maintained as shown in the enlarged view of FIG. 16. The reason of this is as follows. The volume of a PDP independent cell is, e.g., in the case of this working example, V=0.65 mm long×0.25 mm wide×0.12 mm deep≈0.02 $mm^3$ or so, and the fluorescent material paste needs to be filled into the whole of this container. This is because through the filling and drying processes of fluorescent-material use coating liquid and after the removal of volatile components, a thick fluorescent material layer needs to be formed on the inner walls of the cell as described before.

At the stage that the fluorescent material paste is being supplied into the cell, a high-viscosity paste would not be filled promptly into the whole cell container because of its poor fluidity. Its meniscus would be so formed that while a shape swollen upper than the barrier rib top 854 is maintained, the paste is filled thereinto from above. Accordingly, even at the stage that the application into the targeted cell has been completed, the meniscus has not been flattened. In event that the discharge nozzle 853 has come into contact with this swollen fluorescent-material meniscus on the way of the application, the liquid would adhere to the nozzle top, so that the fluid having flown out from the nozzle would make causes of various troubles under the influence of the fluid aggregates at the nozzle tip. Therefore, it is necessary to maintain a sufficiently distance H between the tip end of the discharge nozzle 853 and the barrier rib top 854.

For the prevention of the liquid adhesion at the nozzle tip end, in this working example, it was necessary that $H \geqq 0.5$ mm at least. Further, in the case where $H \geqq 1.0$ mm, it was enough to prevent the liquid adhesion, where an intermittent application of high reliability for long time was able to be achieved.

It is the dispenser of each of the embodiments and the working examples of the present invention which has made it possible to implement the method of aiming and blowing the fluid into a specified "independent cell" while the gap H between the tip end of the discharge nozzle 853 and its opposing surface is maintained enough large and while a high-viscosity powder and granular material is being flown, with a gap of the flow passage maintained enough larger than the particle size of the powder material.

Figure 26:
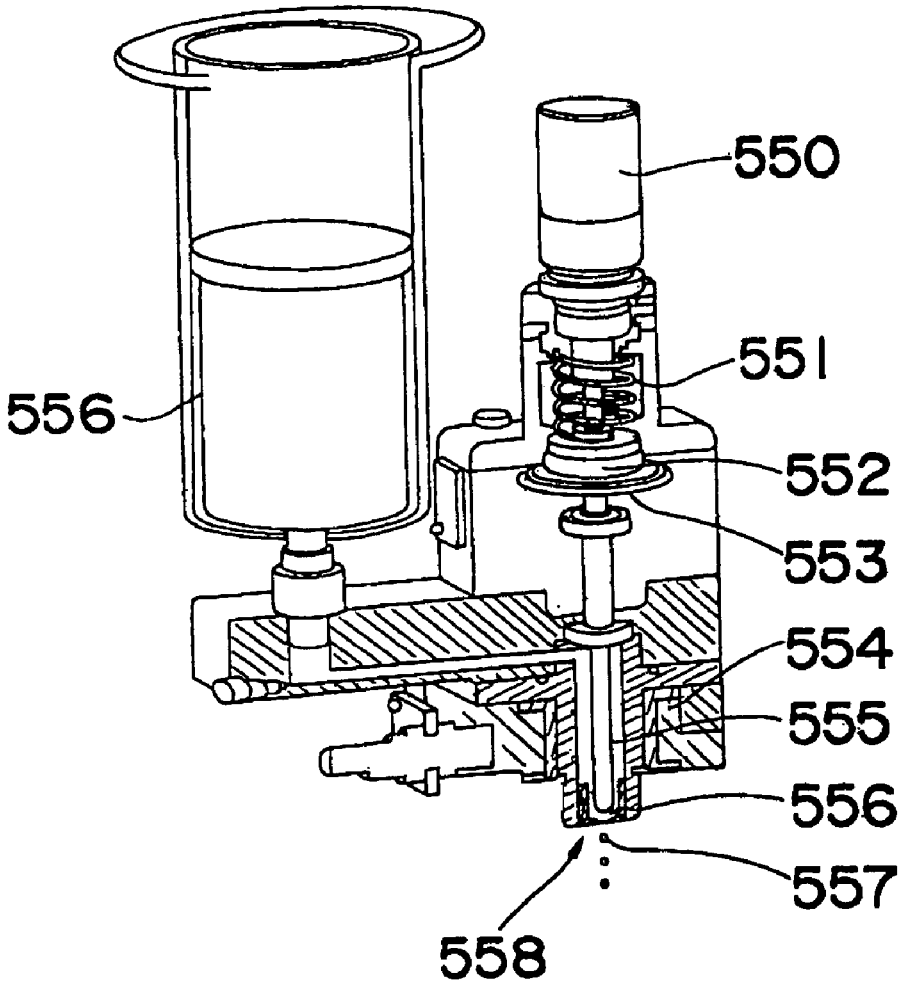
FIG. 26 is a partially sectional view showing a conventional jet type dispenser.

In the case of conventional methods, in both cases of the "jet type dispenser" (FIG. 26) and the "ink jet type" (FIG. 28), it has been possible to make the coating fluid flown.

However, as described before, in the case of the "jet type dispenser," because of the presence of a zero-gap mechanical sliding portion between the relatively moving members, it is difficult to use powder and granular material having fluorescent-material fine particles or the like for a long time. Also, for the "ink jet type," it is difficult for its principle and structural reasons to treat high-viscosity fluids of 100 mPa·s or higher, as well as powder and granular material having particle sizes of several microns. Consequently, the features of the application device using the present invention can be summarized that the device is:

(1) capable of treating high-viscosity fluids of the order of several thousands to several tens of thousands mPa·s (cps);

(2) free from generation of clogging even with coating materials having powder size of several μm more;

(3) capable of performing even with the intermittent application at short cycle on the order of msec or lower;

(4) capable of making the coating fluid flown to a large distance from a point 0.5 to 1.0 mm distant from the discharge nozzle;

(5) capable of ensuring an application amount per dot with high precision; and (6) capable of easily implementing a multi-head construction and simple in structure.

These points (1) to (6) are also necessary conditions for achieving the fluorescent-material layer of the independent cell system by direct patterning with the use of the dispenser, instead of the conventional screen printing method or photolithography method. Hereinbelow, the reasons why the points (1) to (6) are the necessary conditions, as well as the reasons why this dispenser has those features are additionally explained.

The reason why the point (1) is required in forming the fluorescent-material layer is that, as described before, a high-viscosity pasty fluid with a reduced amount of solvent needs to be used as the coating material containing the fluorescent material in order to obtain a fluorescent-material layer of about 10 to 40 μm swollen thick on the rib wall surfaces after the coating and drying processes. Also, one of the reasons why the present invention is applicable to high-viscosity fluids of the order of several thousands to several tens of thousands mPa·s (cps), more specifically, of the order of 5,000 to 100,000 mPa·s, is that, with the thread groove pump used as one example of the fluid supply device in this working example of the present invention, a pumping pressure for pressure-feeding the high-viscosity fluid to the piston side (discharge chamber) can be easily obtained by this thread groove pump. Further, with a high-viscosity fluid used, since the squeeze pressure is proportional to the viscosity, a large discharge pressure is generated. Given a generated pressure of $P_i$=10 MPa and given a piston diameter of, for example, $D_0$=3 mm from Table 1, then an axial load f to be applied to the piston is f $0.0015^2 \times n \times 10 \times 10^6 \approx 70$N. In this working example, an electro-magnetostriction actuator of large withstanding load capable of enduring the above load is used on the piston side.

The reason why the point (2) is required in forming the fluorescent-material layer is that, as described before, fluorescent-material fine particles having particle sizes of the order of several microns are usually most suitable in order for the display to obtain high brightness. Also, the reason why the dispenser of the present invention is less liable to occurrence of clogging within the flow passage is that since the secondary squeeze pressure can be utilized, the minimum value $h_{min}$ of the gap between the piston and its opposing surface, where the clogging would be most likely to occur, can be set enough larger than the particle size of the powder, for example, to $h_{min}$=50–150 μm, or more.

The reason why the point (3) is required in achieving the fluorescent-material layer of the independent cell system by direct patterning is as follows. That is, for example, in the case of a 42-inch wide PDP, if the number of pixels is 852RGB longitudinal×480 lateral, then the number of independent cells is 3×408960 1,230,000 pcs. Assuming that the time $T_P$=30 sec is allowed for the application process of the fluorescent material and that 100 nozzles are mounted on the application device, then the time per shot is $T_S$=30×100/123,0000=0.0024 sec. This value is not more than 1/100 of the responsivity of the conventional air type dispenser or thread groove type dispenser. Therefore, in consideration of mass productivity, a fast-response dispenser far beyond the conventional types is required.

One of the reasons why the dispenser of the present invention can fulfill the point (3) is that since the gap $h_{min}$ between the piston end face and its opposing surface can be set to a large one, for example, 50–150 μm or more, so that the fluid resistance of the flow passage leading from the supply-source pump to the discharge chamber (indicated by 14 in FIG. 1 and 68 in FIG. 10) in the fluid filling process (suction process with the piston moved up) can be made as small as possible. Since the fluid resistance of the radial flow passage leading to the discharge nozzle is small, the filling time can be made short even in the case of high-viscosity fluids of poor fluidity.

Also, in this dispenser, an electro-magnetostriction actuator employing a piezoelectric element, ultra-magnetostriction element or the like having high responsivity of, for example, 0.1 msec or less can be effectively used. Whereas the stroke of the electro-magnetostriction actuator is limited to about 30 to 50 μm as a practical-use level, this dispenser, by virtue of its using the secondary squeeze pressure, can produce a large pressure even in the state of a large gap $h_{min}$. The secondary squeeze pressure, as can be seen from Equation (12), depends only on the differential dh/dt (velocity) of the gap without depending on the absolute value of the gap "h". Accordingly, by taking advantage of an electro-magnetostriction actuator capable of obtaining a large velocity dh/dt, a discharge pressure having a high peak of 5 to 10 MPa or more at an acute, short cycle can be easily obtained.

Figure 27A:
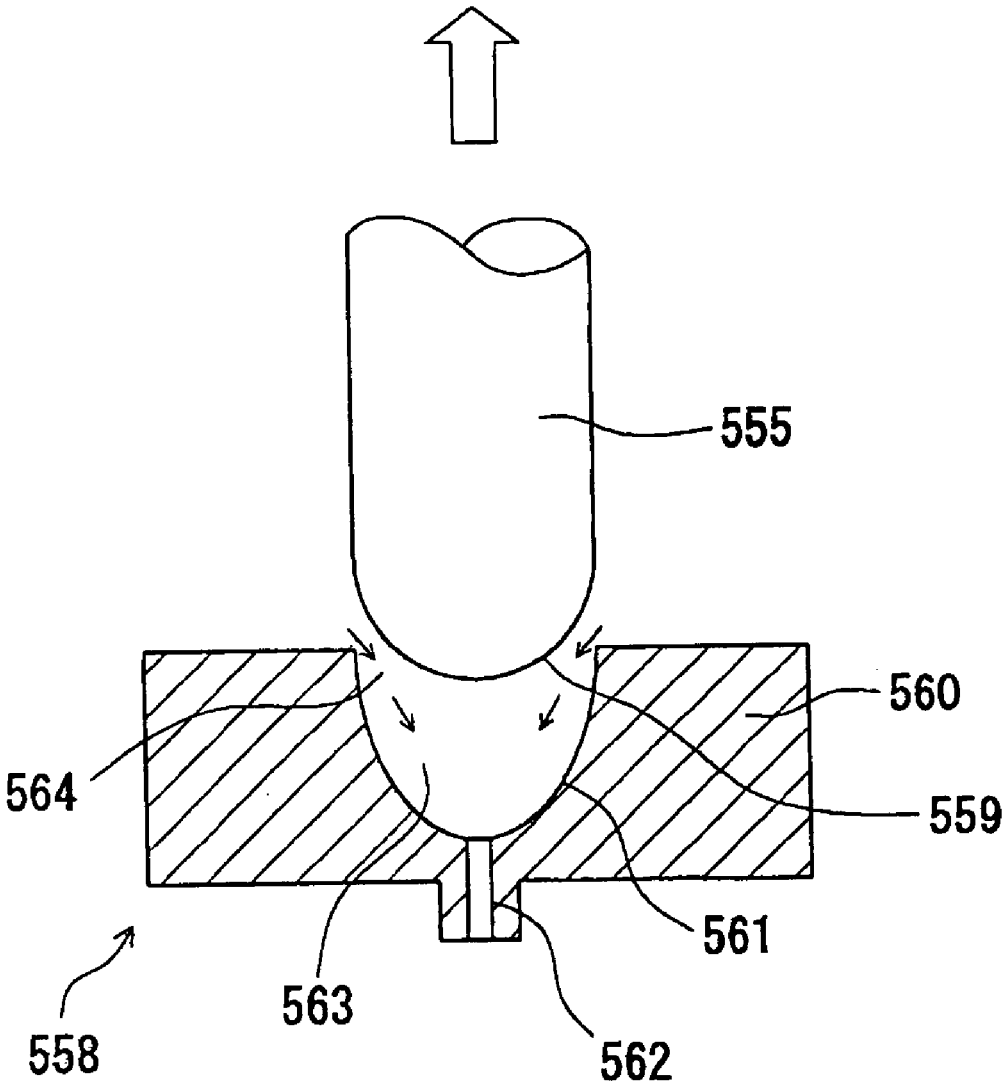
FIG. 27A is a partially sectional view of a model showing a suction process of a conventional jet type dispenser.
Figure 27B:
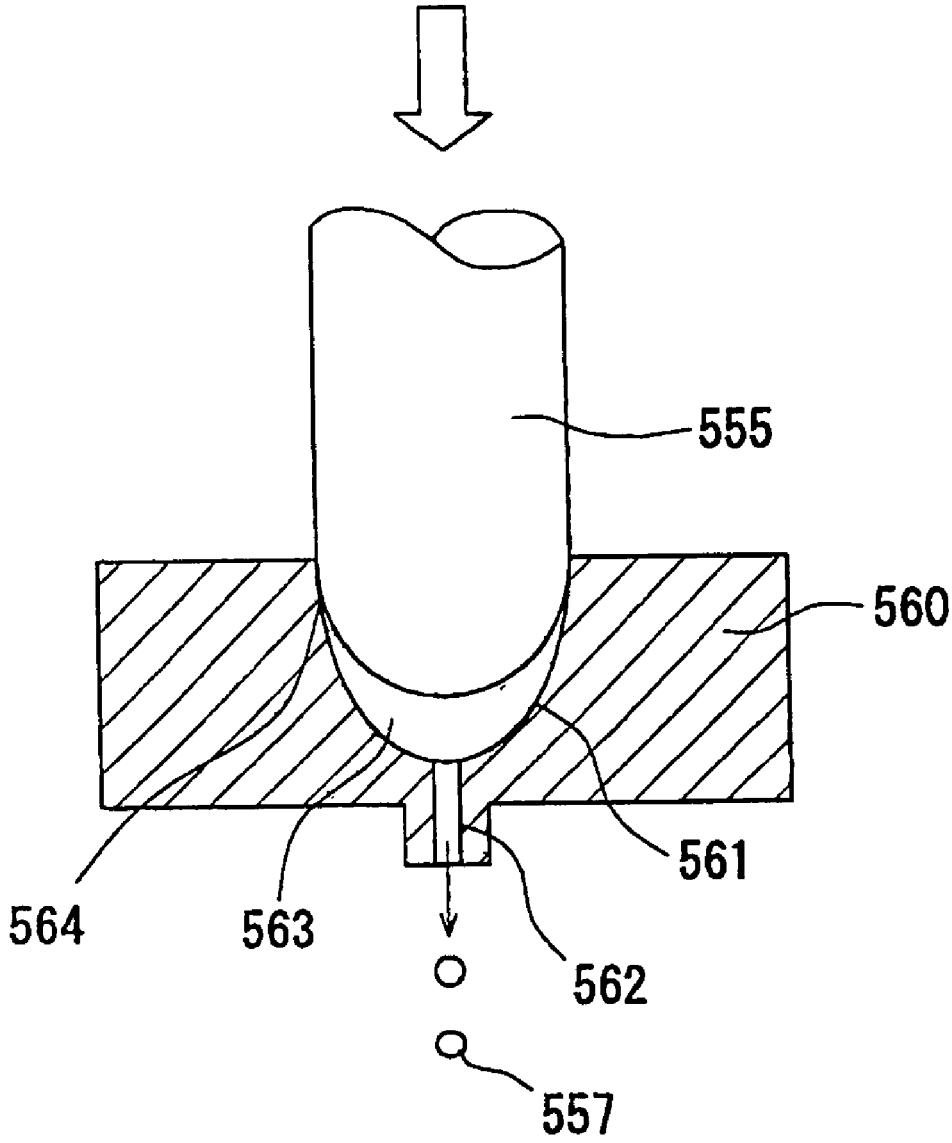
FIG. 27B is a partially sectional view of a model showing a discharge process of the conventional jet type dispenser.

In the case of the conventional "jet type dispenser" (FIG. 26), it is considered easy to substitute an electro-magnetostriction actuator for the mechanism that drives the needle 555. In this case, however, in the suction process of FIG. 27A, the gap of the suction portion 564 formed between the convex portion 559 and the concave portion 561 of the spherical shape can only be several tens of μm at most under the condition of the stroke of the electro-magnetostriction actuator. As a result, mainly in the case of a high-viscosity fluid, since time is required to fill the fluid into the pump chamber 553, advantage is not taken of the good use of the electro-magnetostriction actuator having fast response.

The reason why the point (4) is required in forming the fluorescent-material layer by direct patterning is that, as described before, the contact between the fluorescent-material meniscus, which is swollen upper than the barrier rib top, and the tip end of the discharge nozzle needs to be prevented on the way of application process. Further, the reason why the point (4) can be fulfilled is that, as described before, this dispenser can easily obtain a discharge pressure having an acute, high peak of 5 to 10 MPa or more by making use of the fast response of the electro-magnetostriction actuator. Use of the high peak that overcomes the surface tension of the nozzle tip end allows even a high-viscosity fluid to be flown over a far distance.

The reason why the point (5) is required is that the accuracy for the fluorescent-material filling amount in the independent cell needs to be, for example, about ±5%. The reason why the point (5) can be fulfilled is that the application amount per dot in the intermittent application of this dispenser is, in principle, determined only by the "pressure—flow rate characteristics of the supply-source pump and the flow rate at the working point of the discharge nozzle fluid resistance" and the number of applications per unit time, without depending on the piston stroke, absolute position, or the viscosity of the coating fluid. More concretely, with a thread groove pump used as the supply-source pump, a specified application amount per dot can be set only by changing the intermittent frequency and the number of rotations of the thread groove shaft.

In the case of a conventional type dispenser, since any of the piston stroke, absolute position, and the viscosity of the coating fluid would largely affect the discharge amount, there is a need for strict control therefor. For example, in the case of an air type dispenser, the discharge amount is inversely proportional to the fluid viscosity. In the jet type, the discharge amount is proportional to the stroke. In this dispenser, on the other hand, the number of rotations of the thread groove shaft may be controlled by using a DC servomotor so that a constant number of rotations is maintained, where there are scarce factors for impairing the precision of the intermittent application amount.

The reason why the point (6) is required is that in the case of direct patterning, there is a need for mounting at least several tens of heads on the application device. In order to substitute for the conventional methods, the method is required to have maintenance properties comparable to the screen printing method or the photolithography method.

The reason why the point (6) can be fulfilled is that this application device, as in the case of the above (5), can make the application amount per dot in intermittent application less responsive to the piston stroke and absolute position, so that the piston drive portion (indicated by 67 of FIG. 10) can be made simple in construction. That is, this dispenser is less required to meet the process control conditions such as high-precision machining of the relatively moving members (57 and 52 of FIG. 10) in the piston drive portion, the correct positional alignment among members in assembly, and the ensured obtainment of the absolute accuracy of the piston stroke, which are those required for conventional dispensers. Accordingly, the multi-head as a whole that drives a plurality of pistons independently of one another can be greatly simplified.

(3) Diaphragm Type Head Structure

FIGS. 17A to 17D show a third embodiment of the present invention, showing a case where a discharge chamber (corresponding to 14 of FIG. 1 and 68 of FIG. 10) is formed by a diaphragm and its opposing surface, and this diaphragm is driven directly by a piezoelectric actuator so that the gap between the diaphragm and its opposing surface is varied. A thread groove pump, which is one example of the fluid supply device, and a piston for generating squeeze pressure are provided so as to be separate from each other as in the case of the second working example.

Figure 17A:
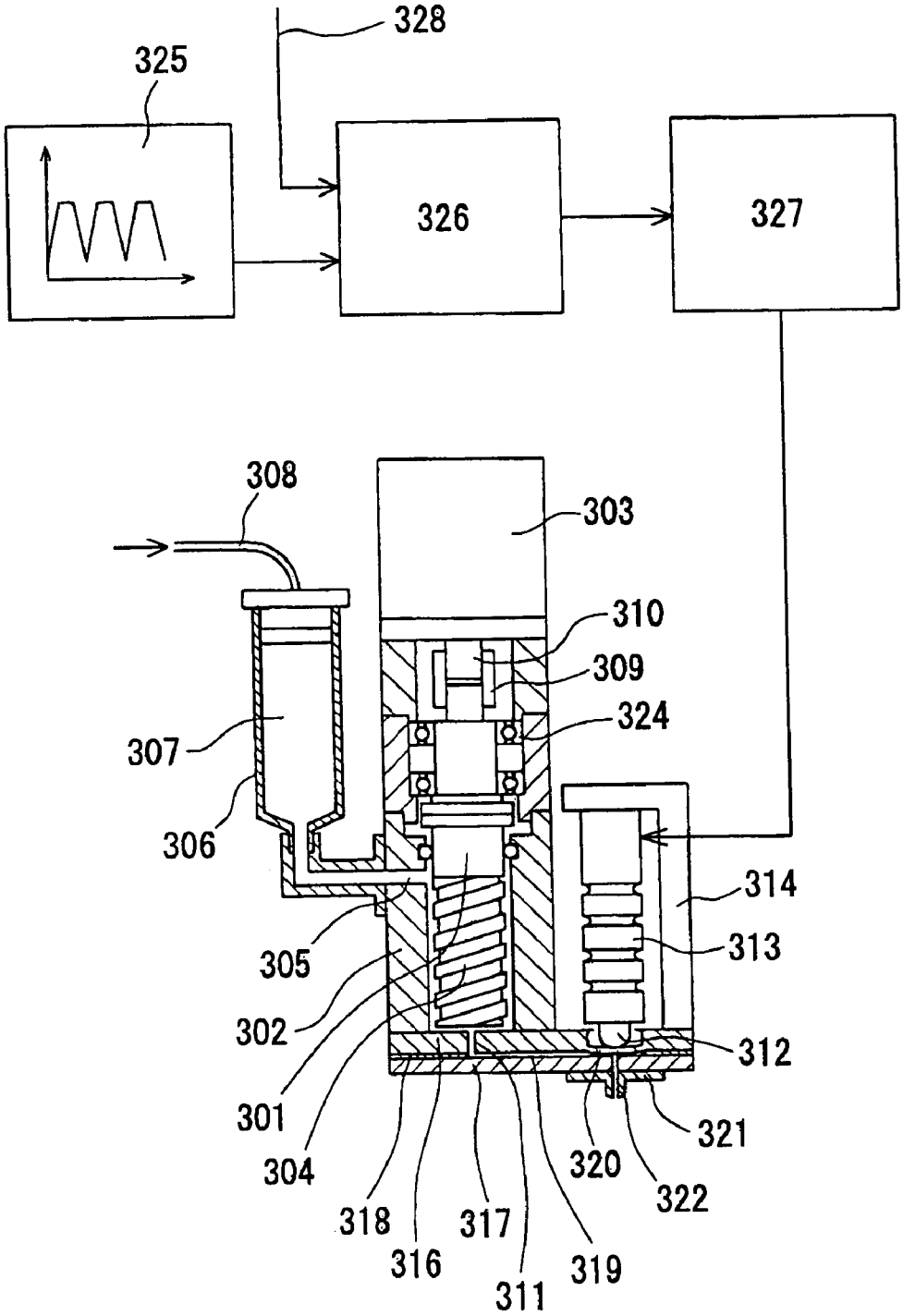
FIG. 17A is a front partially sectional view showing a third embodiment of the present invention.
Figure 17B:
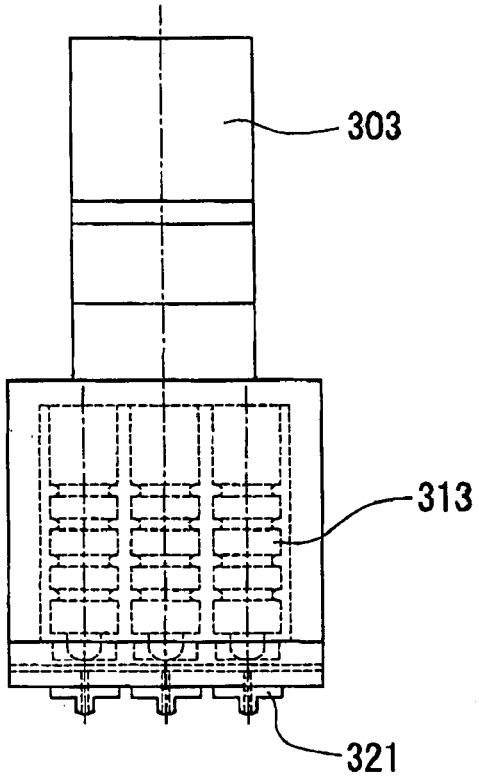
FIG. 17B is a side view of the third embodiment.
Figure 17C:
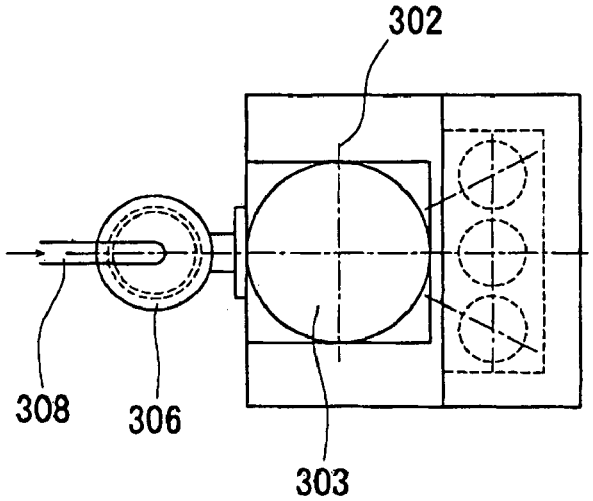
FIG. 17C is a top view of the third embodiment.
Figure 17D:
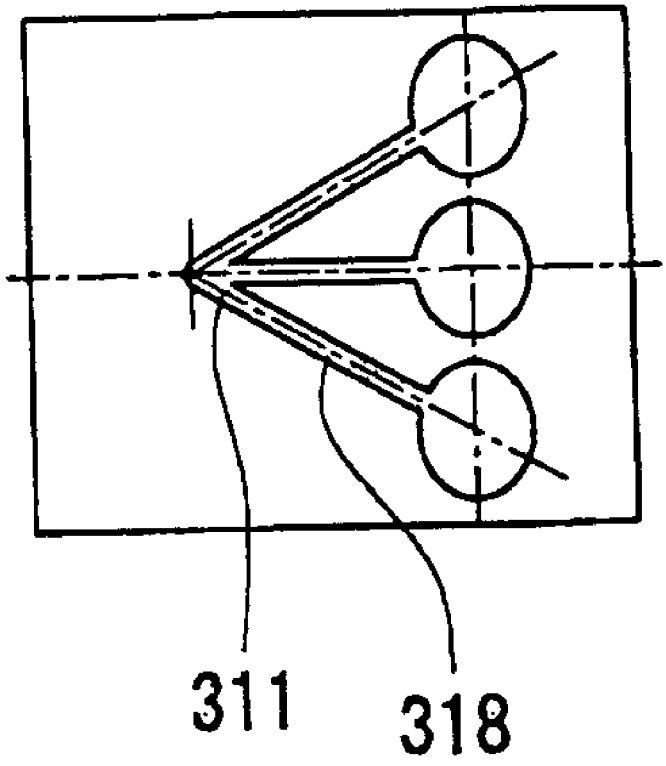
FIG. 17D is a view showing only a flow passage formed by an upper bottom plate and a lower bottom plate in the third embodiment.
Figure 17E:
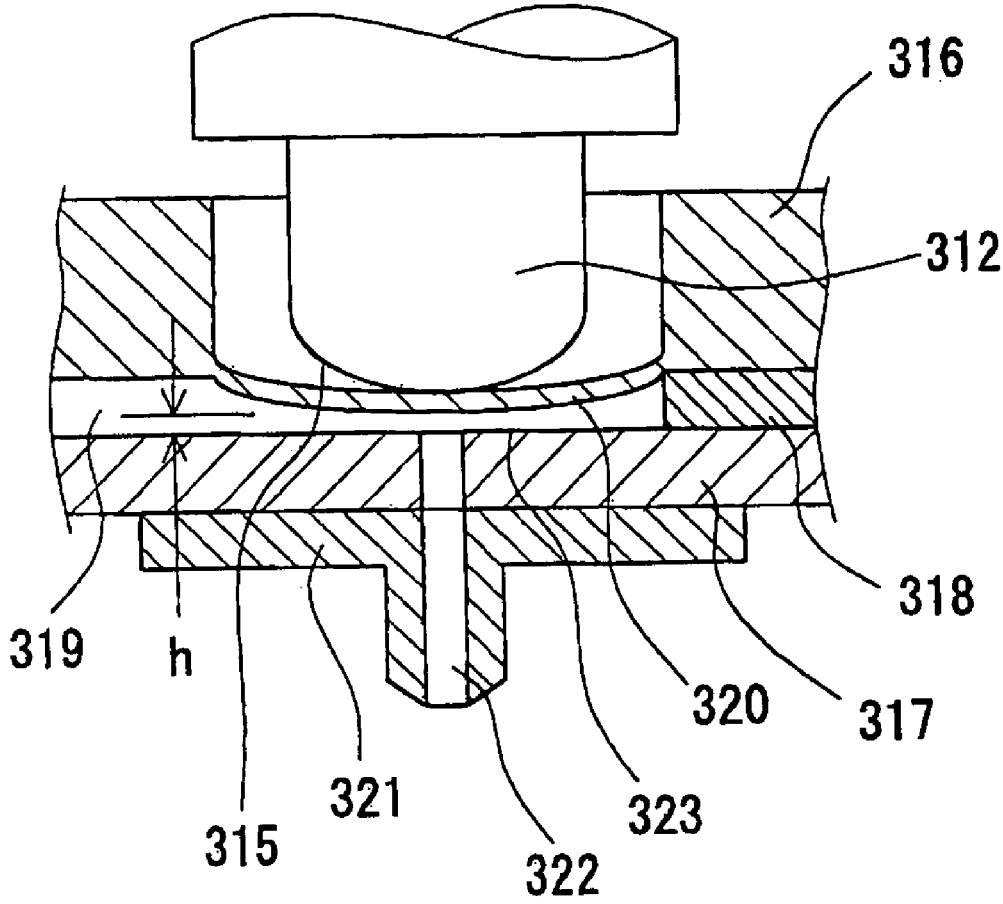
FIG. 17E is an enlarged partially sectional view of the diaphragm portion of FIG. 17A.

FIG. 17A is a front partially sectional view, FIG. 17B is a side view, FIG. 17C is a top view, FIG. 17D is a view showing a flow passage formed by an upper-part bottom plate and a lower-part bottom plate, and FIG. 17E is an enlarged partially sectional view of the diaphragm portion.

Reference numeral 301 denotes a main shaft, which is housed in a housing 302 so as to be movable in a rotational direction. The main shaft 301 is driven into rotation by a motor 303, which is one example of a rotation transfer device. Numeral 324 denotes a bearing for holding the main shaft 301. Numeral 304 denotes a thread groove formed in relatively moving surfaces of the main shaft 301 and the housing 302, numeral 305 denotes a suction port of a fluid, 306 denotes a syringe for accommodating a coating (application) material 307 therein, and 308 denotes air piping for supplying an auxiliary air pressure. Numeral 309 denotes a coupling for coupling a motor output shaft 310 and the main shaft 301, and 311 denotes a discharge port having a sufficiently large thread-groove-pump side flow-passage diameter (about several millimeters) formed on the upper-part bottom plate.

Reference numeral 312 denotes a piston, 313 denotes a piezoelectric actuator which is one example of an axial direction drive device for moving the piston 312 in the axial direction, 314 denotes a piezoelectric-actuator use housing for fixing an upper end portion of the piezoelectric actuator 313, and 315 denotes an end face of the piston 312. Numeral 316 denotes an upper-part bottom plate, 317 denotes a lower-part bottom plate, 318 denotes an intermediate sheet, and 319 denotes a flow passage formed between the upper-part bottom plate 316 and the lower-part bottom plate 317 by utilizing the thickness of the intermediate sheet 318. Numeral 320 denotes a diaphragm formed by reducing the thickness of the upper-part bottom plate 316, and 321 denotes a discharge nozzle fitted to the lower-part bottom plate 317. A discharge port 322 is formed in the lower-part bottom plate 317 and the discharge nozzle 321.

The diaphragm 320 and its fixed-side opposing surface 323 serve as the two surfaces that move relative to each other along the gap direction. The piezoelectric actuator 313, which is one example of the axial direction drive device, changes axial-direction relative positions of the diaphragm 320 and the fixed-side opposing surface 323 therebetween. The gap "h" (see FIG. 17E) between the relatively moving surfaces is changed by the axial direction drive device, as in the embodiment and the working examples of FIG. 1 and FIG. 10.

By the head structure of this working example, the flow passage leading from the exit of the thread groove pump to the discharge port can be put into a completely sealed state. Thus, the need for the seal of the piston portion has been eliminated.

Also, since the electro-magnetostriction actuator can be driven with its output end pressed in direct contact against the diaphragm, it becomes possible to reduce the mass of the mechanical operating part. That is, the part corresponding to the piston 57 in the structure of FIG. 10 can be reduced in size, the inertial load of the electro-magnetostriction actuator can be reduced. As a result, it has become implementable to preferable the intermittent application at higher frequencies.

FIG. 17A shows a simplified view of an example of the control block diagram of this application device.

Reference numeral 325 denotes an instruction signal generator for giving a drive method for the piezoelectric actuator 313, 326 denotes a controller, 327 denotes a driver, which is a drive power supply for the piezoelectric actuator 313, and 328 denotes positional information derived from a linear scale provided on a stage. Through the controller 326, the piezoelectric actuator 313 is driven by the driver 327 based on instruction signals as to predetermined rise and fall waveforms, intermittent cycle, amplitude, minimum gap, and the like of the piston, as well as on the information 328 derived from the linear scale that detects relative speed and relative position between the application device and the substrate.

As one example of the axial direction drive device for the piston 312, although the piezoelectric actuator 313 is used in the working example, yet an ultra-magnetostriction actuator, which is one of electro-magnetostriction actuators, may also be used.

(4) Other Methods for Flow Rate Control

Figure 18A:
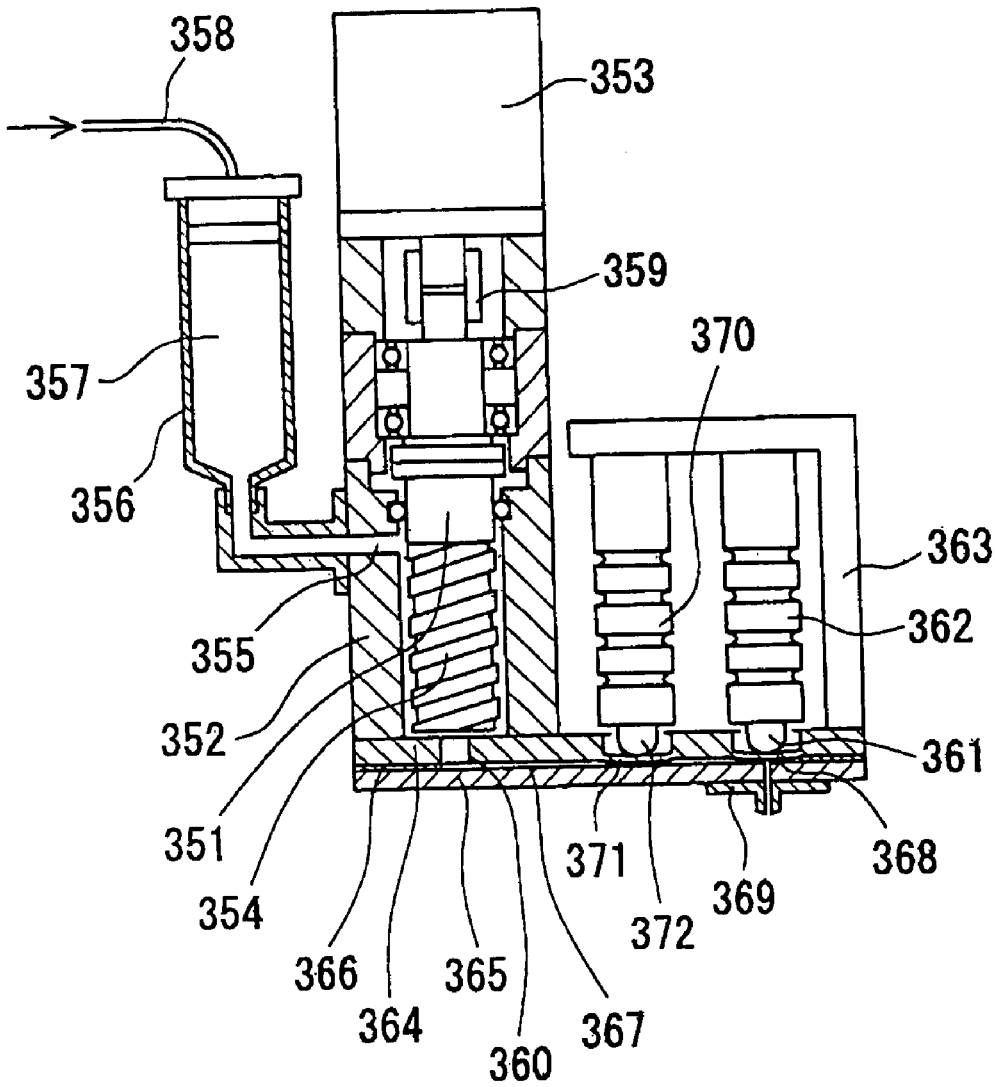
FIG. 18A is a front partially sectional view showing a fourth embodiment of the present invention.
Figure 18B:
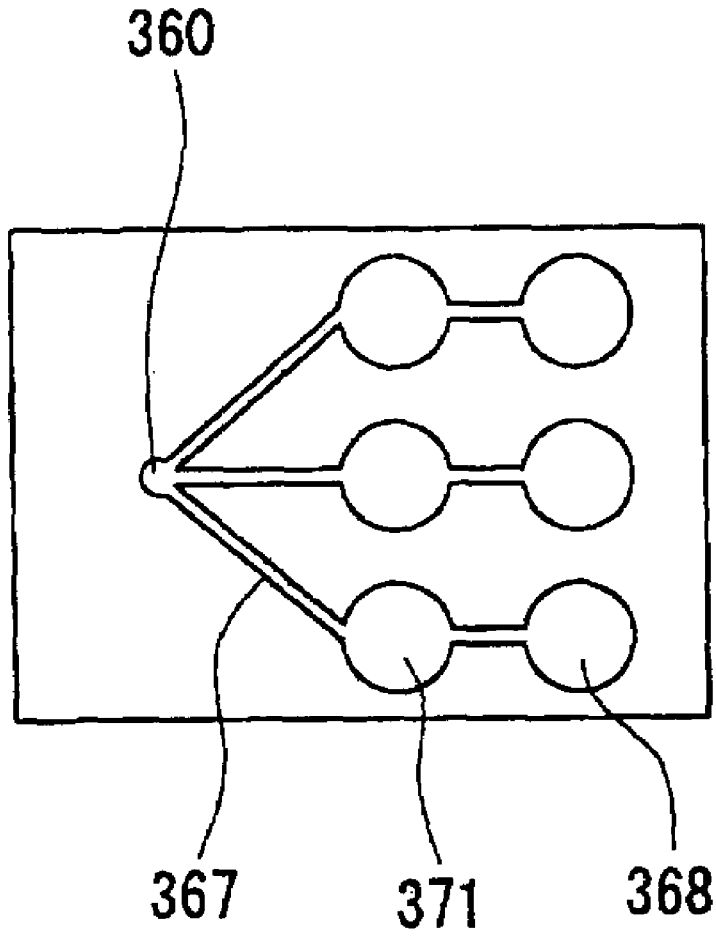
FIG. 18B is a model view showing a flow passage connecting the thread groove pump and the diaphragm.

FIGS. 18A and 18B show a fourth embodiment of the present invention, showing a case where not that variations in flow rate among heads are compensated by the setting of the minimum gap $h_{min}$ of the piston (312 of FIG. 17) that generates primary squeeze pressure and secondary squeeze pressure, but that a flow-rate compensating function (device) is additionally provided on the way of the flow passage leading from the thread groove pump to each nozzle. FIG. 18A is a front partially sectional view, and FIG. 18B is a view showing a flow passage that connects the thread groove pump and the diaphragm to each other. Reference numeral 351 denotes a main shaft, 352 denotes a housing, 353 denotes a motor, 354 denotes a thread groove, 355 denotes a suction port, 356 denotes a syringe of a coating material 357, and 358 denotes an air piping. Numeral 359 denotes a coupling, 360 denotes a thread-groove-pump side discharge port having a sufficiently large flow-passage diameter (about several millimeters), 361 denotes a main piston, 362 denotes a piezoelectric actuator which is one example of an axial direction drive device, 363 denotes a piezoelectric-actuator use housing, 364 denotes an upper-part bottom plate, 365 denotes a lower-part bottom plate, 366 denotes an intermediate sheet, 367 denotes a flow passage formed between the upper-part bottom plate 364 and the lower-part bottom plate 365. Numeral 368 denotes a main-piston use diaphragm formed by reducing the thickness of the upper-part bottom plate 364, and 369 denotes a discharge nozzle. Numeral 370 denotes a flow-rate compensating piezoelectric actuator, and 371 denotes a flow-rate compensating diaphragm formed by reducing the thickness of the upper-part bottom plate 365. The main-piston use diaphragm 368 and its fixed-side opposing surface serve as the two surfaces that relatively move to each other along the gap direction, as in the third working example. However, in this case, the minimum gap $h_{min}$ of the main piston is set to a sufficiently large one, for example, to $h_{min}$>150 μm.

A gap $h_s$ between the flow-rate compensating diaphragm 371 and its opposing surface can be controlled by changing the displacement of an output shaft (sub-piston) 372 of the flow-rate compensating piezoelectric actuator 370. Once the gap $h_s$ is determined, a state that a constant voltage is normally applied to the flow-rate compensating piezoelectric actuator 370 is held from this onward so that the determined gap $h_s$ is maintained.

Referring to the equivalent circuit model of the multi-head of FIG. 12, the magnitude of $R_{p1}$–$R_{p3}$ is inversely proportional to the cube of the gap "h" as shown by Equation (16). Since $h_{min}$ is enough large, $R_{p1}$–$R_{p3}$ for the main piston are that $R_{p1}$–$R_{p3}$→0. This is replaced by $R'_{p1}$–$R'_{p3}$ (not shown) for flow rate compensation. Although $h_s$ for this flow rate compensation is set to 50 μm or less in the working example, yet $h_s$ for flow rate compensation may also be experimentally determined by actually measuring flow rates from the individual nozzles in a state that the fluid is actually intermittently applied at high speed. Although a piezoelectric actuator is used as the flow-rate compensating piezoelectric actuator 370 in the working example, yet mechanical compensation device may also be used. For example, a manually operated type one in which the output shaft of a micrometer is used as the sub-piston may be adopted.

(5) Start- and Terminal-end Control Method

Here is described a start- and terminal-end control method in the case where independent cells of a PDP are intermittently coated by using the present invention. Reverting now to FIG. 15, a process is assumed in which the fluorescent material is supplied on and on into the independent cells of a PDP while a dispenser having multiple nozzles keeps relatively moving above a substrate grid. Now attention is focused only on one nozzle 853.

It is assumed here that the panel screen has a "display area" 855 over which a fluorescent-material layer is formed, and a "non-display area" 856 which is located on outer periphery of the display area 855 and over which no fluorescent-material layer is formed. An outer-periphery boundary portion of the "non-display area" 856 is shown by a dotted line 857.

The nozzle 853 that has run over the display area 855 of the panel screen at high speed along a direction of an arrow 858 while intermittently applying the fluid, then at a time point when the last intermittent application is completed, enters the non-display area 856 simultaneous with the interruption of the discharge of the dispenser. In this non-display area 856, the nozzle 853, after making a U-turn like an arrow 859 and then passing through an approach interval, enters the display area 855 again, where the dispenser resumes the intermittent discharge.

Figure 19A:
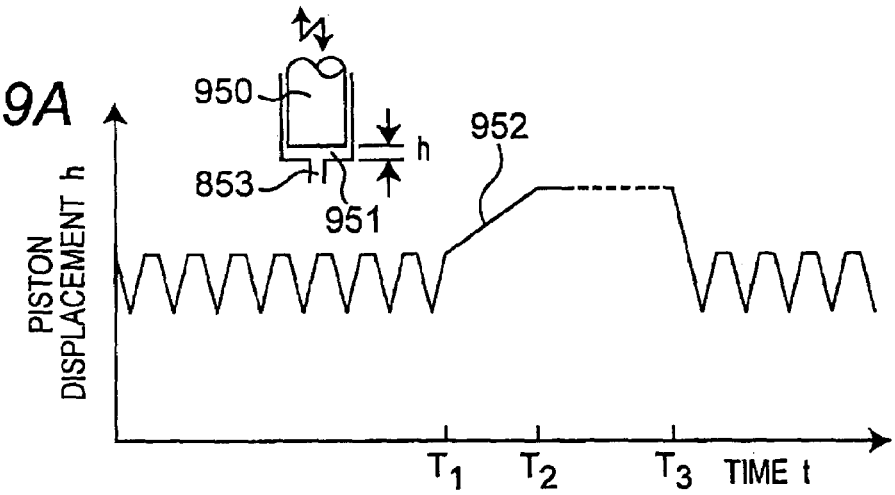
FIG. 19A is a chart showing a displacement curve h of the piston relative to time t.
Figure 19B:
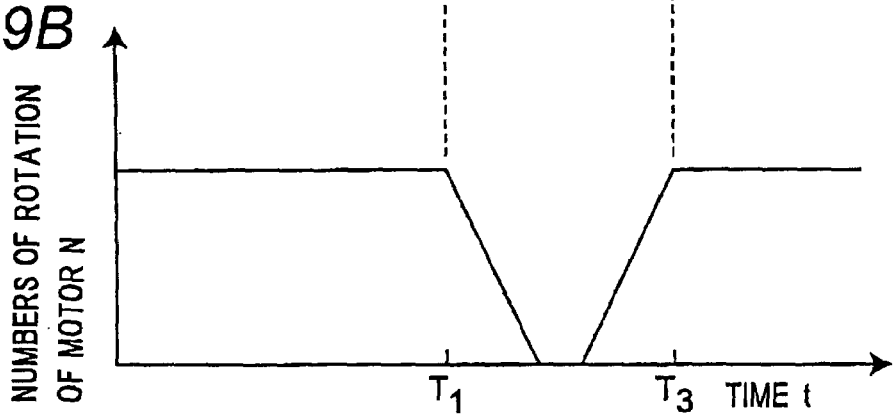
FIG. 19B is a chart showing a number of rotations N of the motor relative to time t.

The graph of FIG. 19A shows a displacement curve of the piston relative to time, where reference numeral 950 denotes a piston and 951 denotes a discharge chamber (corresponding to 14 of FIG. 1). FIG. 19B shows the number of rotations N of the motor relative to time t. After the nozzle 853 has supplied the coating material into cells of an end portion of the display area 855, the piston 950 ascends by a steady displacement pattern. At this stage, i.e., at time $t=T_1$, the nozzle 853 starts running toward the non-display area 856, while the piston 950 simultaneously starts ascending again to draw a gentle inclination angle 952. Given that a volume increment of the discharge chamber 951 per unit time due to the piston 950 ascent is $Q_P$ and the maximum flow rate of the thread groove pump is $Q_{max}$, if $Q_P>Q_{max}$, then the discharge holds an interrupted state (see Equation (18)). At time $t=T_1$, the motor rotation numbers of the thread groove pump is simultaneously set as N→0. When this occurs, more preferably, the auxiliary air pressure (308 in FIG. 17A) as well is interrupted. The responsivity of motor control and air pressure control is about two-digit lower than that of electro-magnetostriction devices, where the rise and fall time is about T=0.05 sec. at most. The piston stroke and the piston diameter are so set that the relation of $Q_P>Q_{max}$ holds and the piston 950 is allowed to keep ascending during the time T.

When the nozzle 853 runs in the U-turn zone (non-display area 856) of the end face of the panel, relative speeds between the nozzle 853 and the panel becomes an extremely low at or around zero. If the material continues flowing out from the nozzle in this zone, material discharges from a plurality of nozzles are overlapped so that the material would be deposited on the substrate (non-display area 856). As a result, there would arise such troubles as adhesion of the deposited material to the tip end of the discharge nozzle. Therefore, it is preferable that a discharge-interrupted state is maintained in the U-turn zone. The discharge is resumed at time $t=T_3$, where the motor may be started to rotate in advance in consideration of the time $T_m$ required for the start-up of the motor. When the application amount immediately after the start of discharge is unstable, it is appropriate that the nozzle is set at a position of the non-display area 856, and after one to two times of idle supplying operations, the coating application into the independent cells is started.

The method for fast moving from the application state to the interrupted state, for example, a method that the piston is turned to an ascent to interrupt the discharge at the time when the discharge nozzle moves from the "display area" to the "non-display area" on the substrate, is applicable also to continuous-line coating application. Further, the method that the number of rotations of the motor is decreased or zeroed simultaneously with the piston ascent is also applicable to continuous-line coating application.

For example, in the case of continuous-line coating, after a continuous line is drawn in the "display area," the discharge nozzle is U-turned in the "non-display area" while keeping a discharge-interrupted state, and then the continuous-line coating is started simultaneously when the discharge nozzle enters the "display area" once again. In this case also, since the secondary squeeze pressure that the present invention found out can be utilized, it is possible to adopt the application method and the dispenser structure explained in the foregoing sections <1>–<3>. For example, assuming that the minimum value of the gap "h" between the piston end face and its opposing surface is $h=h_{min}$, the value of $h_{min}$ can be set to a sufficiently large one, e.g. $h_{min}=150$ μm or so, so as to satisfy that $h_{min}>h_x$. Therefore, even if the gap "h" has fluctuated by several microns due to thermal expansion of the members, there is only a scarce effect that may cause fluctuations of the flow rate of continuous coating application. Further, the method of determining $h_x$, the method of compensating the multi-head flow rate, and the like are also usable as those are described above except that the intermittent flow rate is replaced by the continuous flow rate.

<4> Other Supplementary Explanations

<4-1> Method for Reducing the Weight of the Piston Drive Portion

Figure 20:
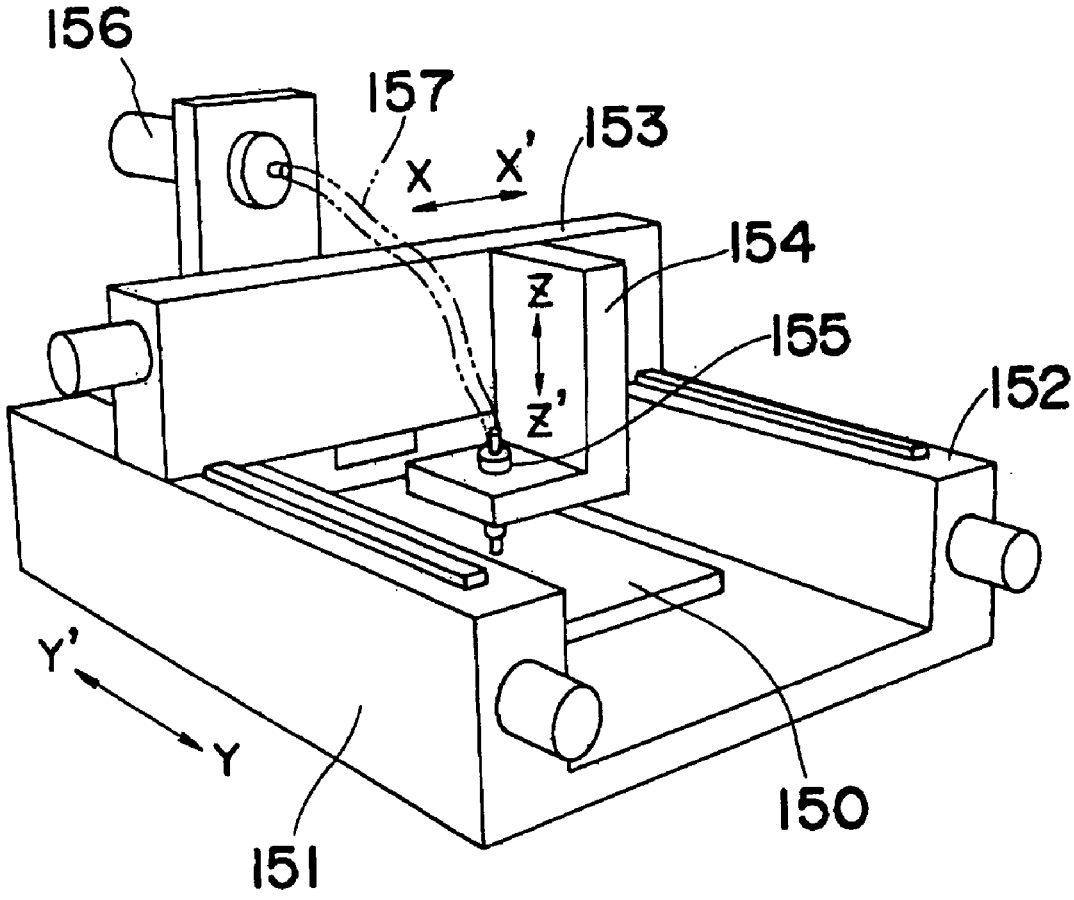
FIG. 20 is a perspective view showing a fifth embodiment of the present invention.

FIG. 20 is a perspective view showing a fifth embodiment of the present invention, where a pump portion, which is one example of the fluid supply device, and a piston drive portion are coupled with each other by a fixable pipe, and where the pump portion is disposed on the fixed side and the piston drive portion is disposed on the high-speed-running stage side. In this case, since the piston drive portion may be a lightweight one, there is an advantage for the high-speed speed-control and positioning control of the discharge nozzle tip end relative to the panel.

Reference numeral 150 denotes a panel, on both sides of which are provided a pair of Y-axis direction conveyor units 151, 152. Also, an X-axis direction conveyor unit 153 is mounted on the Y-axis direction conveyor units 151, 152 so as to be movable in a Y–Y' direction. Further, a Z-axis direction conveyor unit 154 is mounted on the X-axis direction conveyor unit 153 so as to be movable in an arrow X–X' direction. On the Z-axis direction conveyor unit 154 is mounted a piston drive portion 155 which is composed of a piezoelectric actuator and a piston.

Numeral 156 denotes a pump portion which is one example of the fluid supply device and which is placed on the fixed side. Numeral 157 denotes a fixable pipe which is a flow passage for connecting the pump portion 156 (ex. corresponding to the pump portion 66 in FIG. 10) and the piston drive portion 155 (ex. corresponding to the piston drive portion 67 in FIG. 10) with each other. In the case where the compressibility by the elasticity of the fixable pipe matters in implementing high-speed intermittent application, the present device may appropriately be made up with the minimum gap $h_{min}$ of the piston enough small.

<4-2> Method of Providing Application-halt Period

Figure 21A:
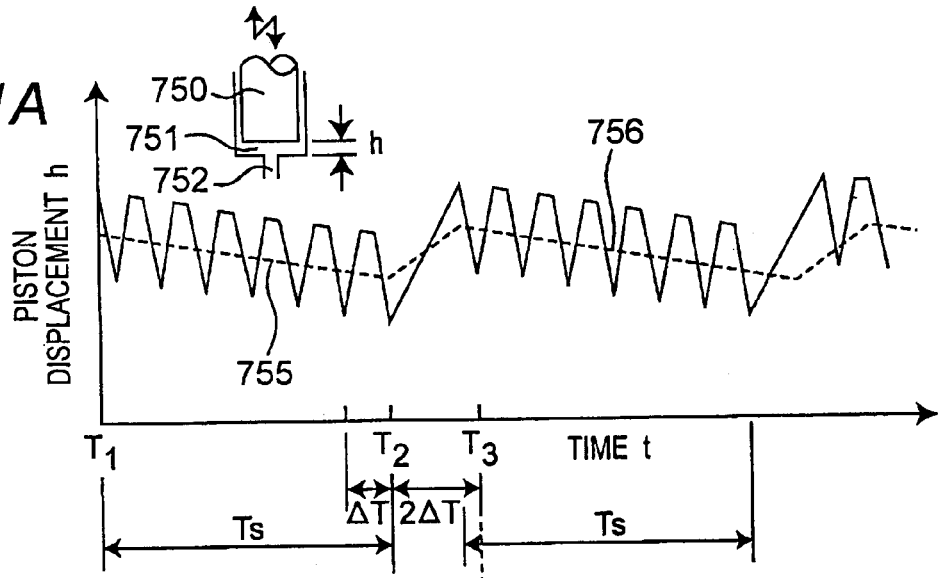
FIG. 21A is a view showing a displacement waveform of the piston in a case where an "application halt period" is provided in intermittent application.
Figure 21B:
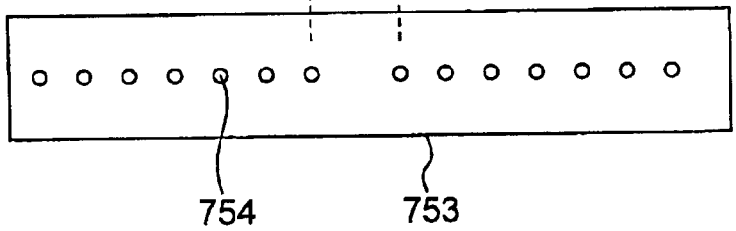
FIG. 21B is a view showing dots applied on the substrate.

FIGS. 21A and 21B show a working example in which an "application-halt period" is provided in the intermittent application. More specifically, in this application method, after n equal-quantity dots are supplied at equal time intervals, the application is halted by one dot, and then the operation of supplying n equal-quantity dots at equal time intervals is repeated again. For example, this method corresponds to a case where, in the chip component bonding process for circuit formation, one dot requires bonding with a different kind of adhesive material so that application needs to be halted only for this portion.

FIG. 21A is a graph showing a displacement curve of the piston relative to time, where reference numeral 750 denotes a piston, 751 denotes a discharge chamber (corresponding to 14 of FIG. 1), and 752 denotes a discharge nozzle. In FIG. 21B, numeral 753 denotes a substrate, and 754 denotes dots applied onto the substrate 753.

With the time $t=T_1$ as a start point, the piston 750 performs intermittent application for n dots, while repeating ascent and descent of an equal amplitude, on a straight line 755 that slopes down gently. At time $t=T_2$, the piston 750 makes an ascent larger than that of the steady course. The value of the start point of a straight line 756 at a start time point of intermittent application is equal to the value of the straight line 755 at $t=T_1$. If the period of the piston 750 in the steady state is $\Delta T$, then the time duration from the large ascent to the next descent is $2\Delta T$. After $t=T_3$, the piston 750 repeats intermittent application, while again repeating ascent and descent of an equal amplitude, on the gently sloping-down straight line 756. At the time point when the intermittent application for n dots has been completed, the value of an end point of the straight line 756 is equal to the value of the straight line 755 at $t=T_2$.

During the time interval from time $t=T_2$ to time $t=T_3$, its time width being $2\Delta T$, a total application flow rate of fluid for two-time operations is filled from the thread groove pump into the discharge chamber 751. However, in the intermittent application at $t=T_3$, the piston makes only a descent of a steady-state amplitude, and therefore only a steady-state flow rate of fluid is applied. In this case, the characteristic of the present invention that the discharge pressure does not depend on the absolute value of the minimum gap $h_{min}$ in the case where the minimum gap $h_{min}$ of the piston is large is exploited.

The fluid accumulated in the discharge chamber 751 in excess by one-time quantity is then discharged on and on while equally distributed in the intermittent application for n dots. Accordingly, using this method makes it possible to perform the intermittent application of an equal application amount per dot for every section having an application-halt portion.

This method is effective for coating processes in the case where the time interval of intermittent application is set to a constant value, for example, a case where the dispenser is fixed and the conveyor on which a substrate is mounted runs at a constant speed.

<4-3> Method for Changing Intermittent Application Amount at a Certain Spot

Here is described a case where the intermittent application amount is changed for a certain spot.

For example, after a start of coating application, if an n-th application amount per dot is twice the quantity of the others, the following steps are taken. It is assumed here that a time interval between (n−2)th and (n−1)th applications is $\Delta T_{n-1}$, a time interval between (n−1)th and n-th applications is $\Delta T_n$, and further a time interval between n-th and (n+1)th applications is $\Delta T_{n+1}$. Here is set that $\Delta T_n=2\times\Delta T_{n-1}$ and that $\Delta T_{n-1}=\Delta T_{n+1}$. The total flow rate of fluid discharged and filled from the thread groove pump to the discharge chamber at the (n−1)th application is $Q_n=\Delta T_{n-1}\times Q_{max}$, and the total flow rate of fluid discharged and filled from the thread groove pump to the discharge chamber at the n-th application is $Q_n=\Delta T_n' Q_{max}=2\times\Delta T_{n-1}\times Q_{max}$. Accordingly, $Q_n=2\times Q_n-1$. When the total flow rate of fluid discharged into the discharge chamber from the thread groove pump is proportional to the application amount per dot of fluid flowing out from the discharge nozzle, the n-th application amount is a double that of the others. However, the piston stroke is preparatorily set enough large for the section ($\Delta T_n$) from a discharge end to a discharge start so as to enable the discharge chamber to maintain a sufficient negative pressure state. Although the above description has been made on a case where only the n-th application amount is a double that of the others, yet for a case where only the n-th application amount is decreased to one half that of the others conversely, it is appropriate to set that $\Delta T_n=\Delta T_{n-1}/2$ and that $\Delta T_{n-1}=\Delta T_{n+1}$. Under such a concept, this dispenser is enabled to set any arbitrary application amount at each spot.

Whereas conventional dispensers are designed to control the application amount per dot by mechanical displacement (stroke) of the piston, this dispenser is enabled to control the application amount by controlling the time interval.

<4-4> Method for Determining an Inflection Point $h_x$ of a Discharge Amount $Q_s$ Curve Relative to the Minimum Gap $h_{min}$ As described before, the setting of the minimum value $h_{min}$ for the gap between the piston end face and its opposing surface is of great importance for the present invention. Setting that $h_{min}>h_x$ makes it possible to implement a stable intermittent application that does not depend on any fluctuation (drifts) of the piston stroke and the absolute position of the piston. Setting that $h_{min}\approx h_x$ makes it possible to fulfill subtle flow-rate compensation among multiple heads. Among methods for determining this inflection point $h_x$ are:

(1) Empirical Method

With the minimum value $h_{min}$ of the gap between piston end face and its opposing surface set, while intermittent discharge is performed, a total discharge amount per dot $Q_s$ is determined. Measured values of $Q_s$ versus $h_{min}$ are plotted, and an inflection point $h_x$ is determined.

(2) Theoretical Method

① Stringent Method

Given an input waveform h(t) of piston displacement, a flow rate $Q_i$ is determined by using Equation (14).

The flow rate $Q_i$ in the discharge process section is integrated by time t to determine a total discharge amount $Q_s$ per dot. Theoretical values of $Q_s$ versus $h_{min}$ are plotted, and an inflection point $h_x$ is determined. The graph of FIG. 14B is one determined by this method.

② Simple Method

A method for determining the inflection point $h_x$ more simply is explained below.

As described above, when the minimum gap $h_{min}$ is enough large, the flow rate $Q_i$ results in a waveform which fluctuates around a center of the working point $Q_{ic}$, although the amplitude differs depending on the stroke size $h_{st}$.

That is, the mean flow rate, without depending on the size of the piston stroke, is determined by a working point (e.g., A of FIG. 8) that depends on thread groove pump characteristics and discharge nozzle resistance. That is, under the condition of a constant period, a comparison among total discharge amounts per dot $Q_s$ may be made by a comparison of the levels of continuous flow rate at a stroke size $h_{st}$ of 0.

Referring to Equation (14), if $h_{st}=0$, then $P_{squ1}\rightarrow 0$ and $P_{squ2}\rightarrow 0$. Since $P_{S0}$ does not depend on the gap "h", the inflection point $h_x$ can be determined by plotting values of $\phi$ with versus h by using the following function $\phi$ of the gap "h":

$$\phi = \frac{1}{R_n + R_p + R_S} \tag{19}$$

When a thread groove pump is used as one example of the fluid supply device, the internal resistance is $R_s=P_{max}/Q_{max}$. There are many cases where the maximum flow rate $Q_{max}$ and the maximum pressure $P_{max}$ of the pump can be determined theoretically. However, if it is hard to do so, pressure-flow rate characteristics corresponding to the graph of FIG. 8 may be determined empirically by the following method.

For the maximum flow rate $Q_{max}$, while continuous discharge is kept ongoing with the discharge nozzle separated off, a total flow rate per unit time is measured. For the maximum pressure $P_{max}$, a jig fitted with a pressure sensor instead of the discharge nozzle is mounted, and the pressure can be measured in a zero flow rate state. In the case where a pump other than thread groove pumps is used as one example of the fluid supply device, if the pressure-flow rate characteristics are not of a linear relation, the relation can be linearized about the working point and thus, the internal resistance $R_s$ can be determined by using its resultant inclination angle.

As in another method of flow rate control shown in FIGS. 18A and 18B (fourth embodiment of the present invention), in the case where a flow-rate compensating function (device) is provided, or a throttle is present, on the way of the flow passage leading from one example of the fluid supply device (e.g., thread groove pump) to each nozzle, a fluid resistance $R_x$ of this portion may be added to the $R_s$ to obtain an apparent internal resistance ($R_s+R_x\rightarrow R_s$) of one example of the fluid supply device.

The fluid resistances $R_n$, $R_p$ can usually be determined from a well-known theoretical formula (e.g., Equations (15), (16)). Otherwise, with complex configurations involved, those fluid resistances may be determined by numerical analysis or by empirical process. In the case of an orifice whose length of its throttle portion is shorter against its inner diameter, although the equation of linear resistance (e.g., Equation (15)) does not hold, yet linearization around the working point may be applied in this case to obtain an apparent fluid resistance.

A description of characteristics of the discharging device (dispenser) to which the present invention is applied is added hereinbelow.

(i) The discharge amount $Q_s$ is less affected by the viscosity of the coating fluid.

Referring to Equation (14), the fluid resistances $R_n$, $R_p$, and $R_s$ are proportional to the viscosity μ. Also, given that supply-source pressure $P_{S0}$≈thread-groove maximum pressure $P_{max}$, then $P_{S0}$ is proportional to the viscosity μ.

Accordingly, the viscosities μ of the denominator and the numerator of Equation (14) are canceled. Therefore, the discharge amount of this dispenser is less dependent on the viscosity. Generally, the viscosity of fluid largely varies logarithmically against temperature. The property of being insensitive to such temperature variations comes to an extremely advantageous characteristic in making up the application system.

(ii) High application precision can be obtained and the structure is simple.

When the dispenser of the present invention is applied to, for example, intermittent application of a PDP, the application amount per dot in the intermittent application is determined by the "pressure-flow rate characteristics of the supply-source pump and the flow rate at the working point of the discharge-nozzle fluid resistance" and the "intermittent frequency," as described before. For example, with a thread groove pump used as one example of the supply-source pump, if the discharge nozzle is mounted on the device, the application amount per dot is determined only by the number of rotations N of the thread groove pump and the intermittent-application frequency f.

Since the application amount is insensitive to the stroke of the piston, the absolute-position precision of the piston, and the viscosity of the coating fluid, the construction of the piston drive portion (ex. 67 of FIG. 10) can be made simple.

Now, how the application amount per dot is determined in conventional dispensers is explained below.

Figure 25:
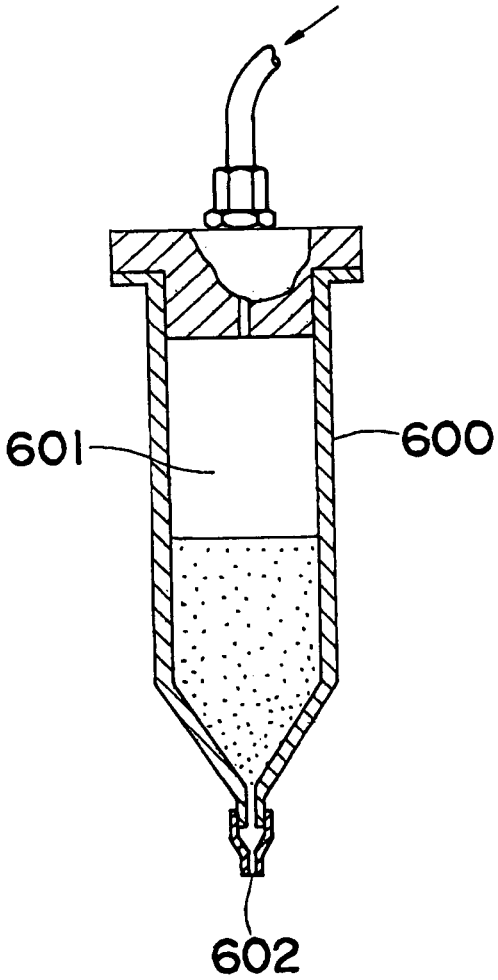
FIG. 25 is a partially sectional view showing a conventional air pulse-type dispenser.

In an air-type dispenser, a constant quantity of air fed from a constant-pressure source is applied in a pulsed manner to a container (inside 600 of FIG. 25), so that a constant quantity of liquid corresponding to an increment of the internal pressure of the container is discharged from a nozzle 602. As a result, there would be involved (1) nonuniformities in discharge amount due to discharge pressure pulsation, (2) nonuniformities in discharge amount due to water level differences, (3) changes in discharge amount due to changes in liquid viscosity, and the like, which are factors that may cause nonuniformities of performance.

The reason of the point (2) is that since the capacity of the void portion 600 inside the cylinder differs depending on the liquid residual quantity H, feeding a constant quantity of high-pressure air would cause the degree of pressure change inside the void portion 600 to largely change due to the H. A decrease in the liquid residual quantity would cause an issue that the application amount would decrease by, for example, about 50 to 60% as compared with the maximum value. For this reason, it has been practiced to take measures such as detecting the liquid residual quantity H for each discharge and then adjusting the time width of the pulse so that the discharge amount is maintained uniform.

The point (3) occurs, for example, when the material containing a large amount of solvent has changed in viscosity with time. Measures for this have been taken by programming tendencies of viscosity changes on the time base preliminarily in a computer and then adjusting, for example, the pulse width so that any effects of viscosity changes are compensated.

In the case where intermittent application is performed with a conventional thread-groove type dispenser, it has been the case to employ such methods as (1) interposing an electromagnetic clutch between the motor and the thread groove to connect or release this electromagnetic clutch for turn-ON or -OFF of discharge, and (2) using a DC servomotor to perform a rapid rotation start or a rapid stop. However, in either case, since the responsivity is determined by the time constant of a mechanical system, there have been constraints on high-speed intermittent operation. Also, since many uncertainty factors are involved in the rotational characteristics at the times of transient response (times of rotation start and stop) of the pump shaft, it has been difficult to strictly control the flow rate, with the result of limitations also in application precision.

In the case of a jet-type dispenser (FIG. 26), as described before, there is a need that a spherical-shaped convex portion formed at an end portion of the needle 555 and a spherical-shaped concave portion formed on the discharge side are engaged with each other at high precision.

In the case of an ink jet type dispenser (FIG. 28), the oscillation plate 652 is deformed in the thicknesswise direction by the piezoelectric element 653 so that the capacity of the ink chamber 654 is decreased to cause a pressure increase, thus making the fluid discharged.

In all the application methods described above, the capacity of a space directly connected to the discharge nozzle is changed by some means, where the control of the application amount is performed based on the concept of "capacity variation of the space=application amount per dot." In the case of the dispenser of the present invention, as described before, the capacity change of the space by the piston is not to determine the application amount, but to fulfill the role as an A/D converter for converting a continuous flow rate (analog) of the supply-source pump to an intermittent flow rate (digital). Therefore, this dispenser is greatly simplified in process control to meet high-precision machining of the relatively moving members in the piston drive portion, the correct positional alignment among members in assembly, the ensured obtainment of the absolute accuracy of the piston stroke, and the like, which are conditions required for conventional dispensers.

Accordingly, the multi-head as a whole that drives a plurality of pistons independently of one another can be greatly simplified in construction.

(iii) The reliability against clogging of powder and granular material within the flow passage is high.

When the present invention is applied, it become allowable to set a large opening area for the flow passage leading from the suction port of the pump to the discharge nozzle, so that a high reliability to powder and granular material can be obtained.

In particular, since the gap "h" between the piston end face and its opposing surface, which is the flow passage leading to the discharge nozzle, can be set to a sufficiently large one, there can be provided a great advantage to prevention against the clogging of powder material (e.g., those having a particle size of 7 to 9 μm for fluorescent material).

For example, in the case where a multi-head construction is adopted and the flow rate for each head is finely controlled, with the combinational use of an output-flow-rate setting method (where the flow rate is controlled by number of rotations) for the supply-source pump, the minimum gap may appropriately be set to a proximity to $h_{min} \approx h_x$ (ex. $h_{min}$=50 μm in FIG. 15) where the gradient of the discharge amount versus the gap is smooth. This numerical value of 50 μm is enough large, compared with powder material diameters (several microns to several tens of microns) which are generally in common use. When the fine control of flow rate is performed in the way of the fourth embodiment (FIG. 18), or when the component precision of each component member is so successful that flow-rate differences among the heads are negligible, the minimum gap $h_{min}$ may be set to 150 to 200 μm or more.

The piston end face portion (ex. discharge chamber 68 in FIG. 10) that directly connects to the flow passage of the discharge nozzle is a portion where the direction of the flow passage largely changes. This is a place where, with powder and granular material treated, such troubles as clogging are most likely to occur. The point that a sufficiently large gap of the flow passage can be secured at this place is one of the greatest characteristics of the present invention. In addition, in the case of coating with powder and granular material, such as fluorescent material and adhesive material, in which fine particles are contained, the minimum gap $\delta_{min}$ of the flow passage may be set larger than the fine particle size $\phi d$.

$$\delta_{min} > \phi d \tag{20}$$

Hereinabove, a thread groove pump has been used as one example of the fluid supply device in the embodiments or working examples of the present invention. For implementation of the present invention, pumps of types other than the thread groove type are also applicable. However, the thread groove type is advantageous in that the maximum pressure $P_{max}$, the maximum flow rate $Q_{max}$, and the internal resistance $R_s$ ($=P_{max}/Q_{max}$) can be freely selected by changing various parameters (radial gap, thread groove angle, groove depth, groove to ridge ratio, etc.) constituting the thread groove.

Also, since the flow passage can be formed so as to be completely contactless, the thread groove type is advantageous in treating any powder and granular material.

Further, the pump as one example of the fluid supply device in the present invention is not limited to the thread groove type, and other types of pumps are also applicable. Among those applicable are, for example, Mono type called snake pump, gear type, twin-screw type, syringe type pumps, and the like. Otherwise, pumps that serve only to pressurize the fluid with high-pressure air may also be used.

Figure 22:
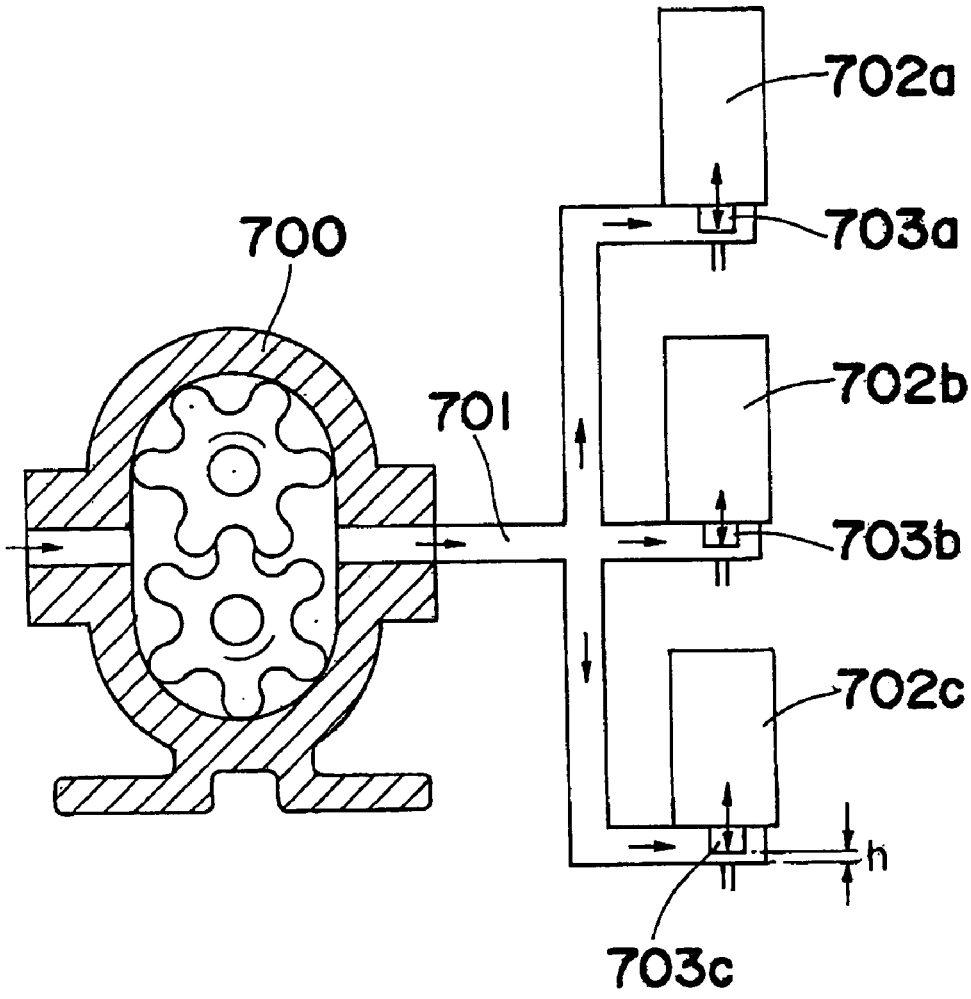
FIG. 22 is a partially sectional view of a model in a case where a gear pump is used as fluid supply means of the present invention.

FIG. 22 is a model view in a case where a gear type pump is used as one example of a fluid supply device in the present invention. Reference numeral 700 denotes a gear pump, 701 denotes a flow passage, 702*a*, 702*b* and 702*c* denote one example of an axial direction drive device implemented by, for example, a piezoelectric actuator, and 703*a*, 703*b*, and 703*c* denote pistons, respectively.

The piston and its opposing surface constituting the piston drive portion may be other than circular shaped. The piston may be rectangular shaped, in which case the radius of a circle having an equivalent area size is assumed to be a mean radius.

The foregoing embodiments or working examples, in every case, has a structure of one nozzle for one head. However, only if the component precision can be ensured, n nozzles for one head may be mounted. In this case, for example, the above-described fundamental equations for determining the flow rate per dot may be calculated for n nozzles. For instance, for nozzles of identical specifications, the calculation is done with a substitution of $R_n \rightarrow R_n/n$. When fluorescent material as an example is intermittently applied into the independent cells, providing a plurality of nozzle holes lengthwise of the rectangular independent ribs makes it possible to apply the material all over the interiors of the cells, thus effective for preventing the coating liquid from overflowing from the ribs. In the case of the working examples, the configuration of the PDP independent cell was set to 0.65 mm long×0.25 mm wide. In this case, for example, with the size 0.65 mm divided into four, nozzle holes may be formed two at right-and-left two places including a central portion (totally three places) Moreover, in the case where nozzle holes to which a fluorescent material of identical color is to be applied are formed so as to be directed perpendicular to the running direction of the stage, and where the fluorescent material is applied into a plurality of independent cells, the productivity is further improved.

The pump of this embodiments or examples for working with micro-small flow rates only needs piston strokes on the order of several tens of microns at most, in which case stroke limits do not matter even if an electro-magnetostriction element such as ultra-magnetostriction element or piezoelectric element is used.

Further, in the case where a high-viscosity fluid is discharged, occurrence of a large discharge pressure due to the squeeze action could be predicted. In this case, since the axial direction drive device that drives the piston is required to exert a large thrust against a high fluid pressure, it is preferable to apply an electro-magnetostriction type actuator that can easily exert a force of several hundreds to several thousands N. The electro-magnetostriction element, having a frequency responsivity of several MHz or higher, is capable of putting the piston into rectilinear motion at high responsivity. Therefore, the discharge amount of a high-viscosity fluid can be controlled at high response with high precision.

If the responsivity is sacrificed, a moving-magnet type or moving-coil type linear motor, or an electromagnetic solenoid, or the like may be used as one example of the axial direction drive device that drives the piston. In this case, constraints on the stroke are dissolved.

As can be understood from Equation (11) or the graphs of FIGS. 4 and 5, generated pressure and flow rate due to a squeeze effect result in such a waveform that the phase is advanced by $\Delta\theta=\pi/2$ over the displacement input waveform of the gap between the piston end face and its opposing surface. That is, the fluid is discharged during sections in which the piston is descending ($dh/dt<0$). For example, in the case where the intermittent application is performed while the substrate to be coated is being moved by the stage, in order that coating application is achieved at high positional precision by aiming at coating places, it is appropriate to set a coincident timing for both the stage and the displacement input signal Sh by taking into consideration that the phase of coating application is advanced by $\Delta\theta=\pi/2$ over the displacement input signal Sh of the piston gap. For example, the stage may be moved while the piston is ascending, and after a stop, the piston may be lowered and then the coating application is performed on an object substrate.

Figure 23A:
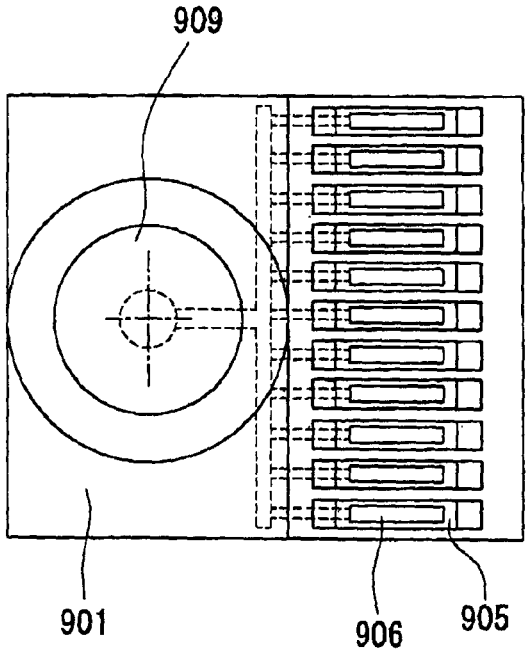
FIG. 23A is a top view showing an application example of the present invention using a bimorph type piezoelectric element.
Figure 23B:
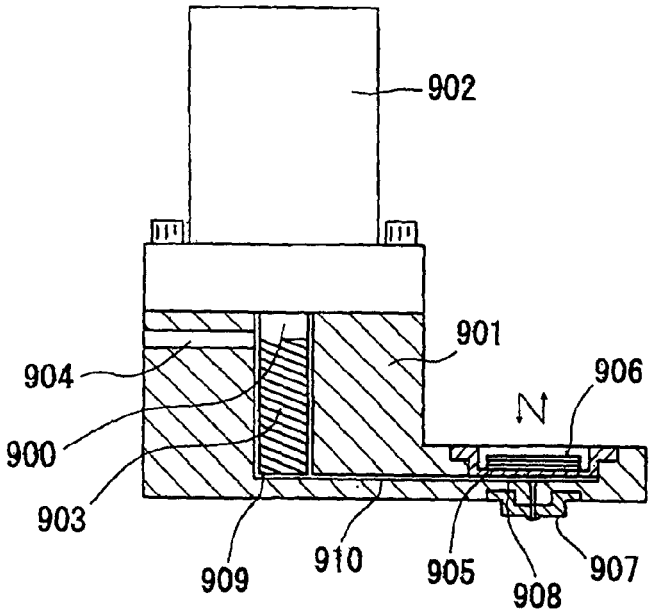
FIG. 23B is a front partially sectional view of the same application example.
Figure 24:
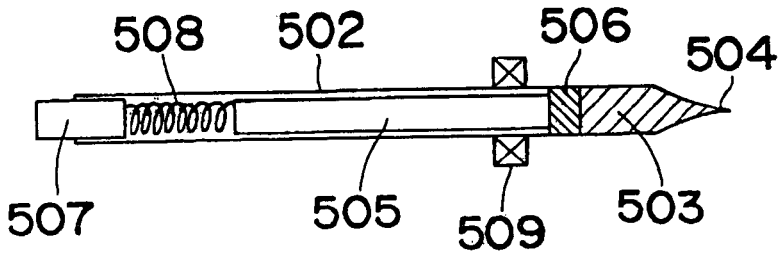
FIG. 24 is a partially sectional view showing a conventional design example for the injection device using an ultra-magnetostriction element.

FIGS. 23A and 23B show an example to which the present invention is applied in a case where a bimorph type piezoelectric element which is used in printers or the like. The bimorph type piezoelectric element is used to make up relatively moving surfaces, and communicates a discharge chamber, which is defined between these two surfaces, and a thread groove pump, which is one example of a fluid supply device, with each other.

Reference numeral 900 denotes a main shaft which is housed in a housing 901 so as to be movable in the rotational direction. The main shaft 900 is driven into rotation by a motor 902. Numeral 903 denotes a thread groove formed in relatively moving surfaces of the main shaft 900 and the housing 901. In this application example, the supply-source pump as one example of the fluid supply device is given by using a thread groove pump in which the groove 903 is formed on the surface of the extremely-small-diameter main shaft 900 or on an inner surface of the housing 901 that houses this main shaft 900. This micro thread groove pump serves as one example of a common fluid supply device for supplying the fluid to a plurality of discharge chambers. Numeral 904 denotes a suction port of a fluid, 905 denotes a thin-plate diaphragm, 906 denotes a bimorph type piezoelectric element for deforming the diaphragm 905 in the thicknesswise direction (one example of a drive device in the gap direction), and 907 denotes a discharge nozzle fitted to the housing 901. A discharge-side end face of the diaphragm 905 and its fixed-side opposing surface serve as the two surfaces that relatively move to each other along the gap direction, and a space defined by these two surfaces is a discharge chamber 908. Numeral 909 denotes a main shaft end portion, and 910 denotes a flow passage that connects the main shaft end portion 909 and the discharge chamber 908 to each other. Whereas the piezoelectric actuator is available in several fashions according to the form of use in which the piezoelectric element is modified, yet this application example employs a fashion in which oscillation plates and piezoelectric members are stacked so that flexure of the oscillation plates due to planar-directed expansion and contraction of the piezoelectric members is utilized. In this case, since a large number of multi-heads can be integrated in one application unit depending on high-density nozzle arrays, the productivity is greatly improved. Further, in this application example, there is no throttle (corresponding to 656 of FIG. 28) on the flow passage 910 that connects one example of the fluid supply device and the discharge chamber 908 to each other, as would be necessary in the case of conventional ink jet type. By virtue of the absence of the throttle that could cause filling delays in the suction of the high-viscosity fluid into the discharge chamber, it become allowable to use high-viscosity fluids, as compared with the conventional ink jet type. For example, as compared with the conventional ink jet type that has been limited to viscosities around 100 mPa·s, it become feasible to treat more than ten times higher viscosity fluids. In order to compensate flow-rate variations among the individual heads, a flow-rate compensating function (device) may also be provided on the way of the flow passage leading from the thread groove pump to each nozzle, as shown in the fourth embodiment. However, even in this case, the fluid resistance of a throttle required for the flow rate compensation can be made small enough to keep the high-speed intermittent application from troubles.

In this application example, the principle of generation of discharge pressure includes not only the primary and secondary squeeze pressures but also a pressure due to elastic waves propagated in the liquid. However, in this case also, the high internal resistance of the thread groove pump prevents backflow of the fluid, thereby producing an effect that the fluid is let to efficiently flow out from the discharge nozzle, similarly.

The more the piston, or the diaphragm equivalent to this piston, is driven at higher frequencies, the more the intermittent application limitlessly approaches the continuous application. This intermittent application may be exploited for pseudo-continuation so as to depict a continuous line.

In this case, for the control of flow rate as a continuous line, a method similar to that for the control of application amount per dot can be applied.

Further, as a time delay factor, a small-diameter, long pipe may be fitted on the discharge side, and with a construction that the discharge nozzle is provided at a tip end of the pipe, the pseudo-continuation becomes implementable at even lower frequencies.

The present invention, which allows micro-small quantities of fluid to be intermittently discharged at high speed and high precision, can be applied to various uses without being limited to the coating technique. For example, the present invention is applicable also as method and device for manufacturing micro lenses which are used for DVD-use optical pickups, cameras, printers, or the like, instead of conventional glass molding process.

Although the above description has been made only on the intermittent application, yet the constitution of the application devices disclosed in <2> Specific embodiments or working examples, or <3> Multi-head dispenser can also be applied to continuous application. In this case, the flow rate may be controlled by varying the gap between the piston end face and its opposing surface. Otherwise, the start- and terminal-end of the application line can be controlled by utilizing the generation of squeeze pressure due to ascent and descent of the piston.

By the method and device for discharging fluid according to the present invention, the following working effects can be obtained. That is, the fluid discharge method and device are:

(1) capable of treating high-viscosity fluids of the order of several thousands to several tens of thousands mPa·s (cps);
(2) free from generation of clogging even with fluid discharging materials having powder size of several μm more;
(3) capable of performing even the intermittent fluid discharge at short cycle on the order of msec or lower;
(4) capable of making the to-be-discharged fluid flown to a large distance from a point 0.5 to 1.0 mm distant from the discharge nozzle;
(5) capable of ensuring a fluid discharge amount per dot with high precision; and
(6) capable of easily implementing a multi-head construction and simple in structure.

When the present invention is used, for example, for fluorescent-material coating of PDPs and CRT displays, the formation of electrodes, dispensers for surface mounting, the molding of micro-lenses, and so forth, its merits can be fully exhibited, and immense effects can be obtained.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A method for discharging fluid, comprising:

feeding fluid from a fluid supply device to a gap formed by two opposing surfaces of two members, while keeping the two members moving relative to each other along a gap direction of the gap;

intermittently discharging the fluid by utilizing a pressure change made by changing the gap, and controlling a fluid discharge amount per dot depending on pressure and flow rate characteristics of the fluid supply device; and setting the gap to have a minimum value $h_0$ such that the intermittent discharging is performed while $h_0>h_1$, wherein:

an intermittent discharge amount per dot is generally proportional to the minimum value $h_0$ when $h_0$ is set in the range of $0<h_0<h_x$, the intermittent discharge amount per dot is generally constant independent of the minimum value $h_0$ when $h_0>h_x$, the intermittent discharge amount per dot relative to $h_0$ is represented by a curved line when $h_0$ is set in the range of $0<h_0<h_x$, and a first straight line is tangent to the curved line at a portion near $h_0=0$, the intermittent discharge amount per dot is generally constant and represented by a second straight line when $h_0>h_x$, and an intersection between the first straight line and the second straight line is defined as $h_0=h_x$.

2. The method for discharging fluid according to claim 1, further comprising:

setting the pressure and flow rate characteristics of the fluid supply device by changing a number of rotations of the fluid supply device.

3. The method for discharging fluid according to claim 1, wherein a fluid pressure generated in inverse proportion to a size of the gap between the opposing surfaces of the two members and in proportion to a rate at which the size of the gap changes is a primary squeeze pressure, a fluid pressure generated in proportion to the rate at which the size of the gap changes and in proportion to an internal resistance of the fluid supply device is a secondary squeeze pressure, and the intermittent discharge is performed by action of the secondary squeeze pressure with $h_0$ set to a range of $h_0>h_x$.

4. The method for discharging fluid according to claim 1, wherein assuming that a fluid pressure generated in inverse proportion to a size of the gap between the opposing surfaces of the two members and in proportion to time differential of the gap is a primary squeeze pressure, and that a fluid pressure generated in proportion to the time differential of the gap and in proportion to an internal resistance of the fluid supply device is a secondary squeeze pressure, and further that a minimum value or a mean value of the gap is $h_0$, the intermittent discharge is performed with the gap $h_0$ set to a value of $h_0 \approx h_x$ or to a range of $0<h_0<h_x$, where a setting range of the gap $h_0$ over which an intermittent discharge amount per dot is generally proportional to the gap $h_0$ is $0<h_0<h_x$, and where a setting range of the gap $h_0$ over which the intermittent discharge amount is generally constant independent of the gap $h_0$ is $h_0>h_x$, and where $h_x$ is an intersection point between an envelope of the intermittent discharge amount per dot relative to $h_0$ in a region $0>h_0>h_x$, and a value of a portion of the region $h_0>h_x$ over which the intermittent discharge amount per dot is generally constant independent of $h_0$.

5. The method for discharging fluid according to claim 1, wherein a fluid internal resistance of the fluid supply device is $R_s$ (kgsec/mm$^5$), a radial fluid internal resistance of the opposing surfaces of the relatively moving two members that depends on the gap $h_0$ of the opposing surfaces of the two members is $R_P$ (kgsec/mm$^5$), a fluid resistance of the discharge port is $R_n$ (kgsec/mm$^5$), and a function $\Phi$ is defined as $$\phi = \frac{1}{R_n + R_p + R_S},$$

then $h_x$ is a value of an intersection point between an envelope of a curve $\Phi$ relative to h in a region 0h>hx, and a portion of the region $h_0>hx$ over which the curve $\Phi$ is independent of $h_0$ and generally constant.

6. The method for discharging fluid according to claim 1, wherein if a maximum value of time differential of the gap is $V_{max}$, a mean radius of outer peripheries of the two members is $r_0$ (mm), a mean radius of a discharge opening for connecting the gap and outside of the device is $r_i$ (mm), and if a maximum flow rate of the fluid supply device is $Q_{max}$, then $$Q_{max}>\pi(r_0^2-r_i^2)V_{max}.$$

7. The method for discharging fluid according to claim 1, wherein the feeding of fluid to the gap includes supplying fluid through branches to a plurality of sets of the two members that are relatively moved to each other along a gap direction, wherein each set of the two members includes an independent axial direction drive device.

8. The method for discharging fluid according to claim 7, wherein each discharge amount is controlled by setting the gap between opposing surfaces of respective two members to a proximity to $h_0 \leqq h_x$ or to a range of $0<h_0<h_x$.

9. The method for discharging fluid according to claim 1, wherein an equal discharge amount per dot of fluid is intermittently discharged for coating periodically at equal time intervals while discharge nozzles and a substrate are kept moving relative to each other by making use of a property that a coating-object surface of the substrate is geometrically symmetrical.

10. The method for discharging fluid according to claim 9, wherein the coating-object surface is a surface of a display panel.

11. The method for discharging fluid according to claim 1, wherein fluid is supplied to opposing surfaces of two members that are relatively moved to each other along a gap direction by a fluid supply device, and wherein given a gap h (mm) of the two opposing surfaces, time differential dh/dt of the gap h, a mean radius $r_o$ (mm) of outer peripheries of the two opposing surfaces, a mean radius $r_i$ (mm) of a discharge opening for connecting the gap and outside, a viscosity coefficient $\mu$ (kgsec/mm$^2$) of the fluid, a fluid internal resistance $R_s$ (kgsec/mm$^5$) of the fluid supply device, a radial fluid resistance $R_p$ (kgsec/mm$^5$) of the two opposing surfaces, a fluid resistance $R_n$ (kgsec/mm$^5$) of the discharge opening, a sum $P_{s0}$ of a maximum pressure and a supply pressure of the fluid supply device, and given a frequency f (1/sec) of intermittent discharge, it holds that $P_{S0}+P_{squ10}+P_{squ20}>0$, where a primary squeeze pressure $P_{squ1}$ and a secondary squeeze pressure $P_{squ2}$ are defined as $$P_{squ1} = -\frac{3\mu}{h^3}\frac{dh}{dt}\left\{(r_0^2 - r_i^2) + 2r_i^2 \ln\frac{r_i}{r_0}\right\}$$

$$P_{squ2} = -R_S\pi\frac{dh}{dt}(r_0^2 - r_i^2)$$

and where a primary squeeze pressure $P_{squ1}$ and a secondary squeeze pressure $P_{squ2}$ resulting when the time differential dh/dt of the gap h has a maximum value are $P_{squ1}=P_{squ10}$ and $P_{squ2}=P_{squ20}$, respectively.

12. The method for discharging fluid according to claim 1, wherein in an application process in which coating is performed as the discharge while a coating-object surface and a discharge nozzle for connecting to the gaps are being relatively moved to each other, given a displacement input signal Sh that gives the gap between the two opposing surfaces, relative positions of the coating-object surface and the discharge nozzle and a timing of the displacement input signal Sh are adjusted by taking into consideration that a phase of coating is advanced by generally $\Delta\theta=\pi/2$ over the displacement input signal Sh.

13. The method for discharging fluid according to claim 1, wherein the two members are relatively moved by an electro-magnetostriction element.

14. The method for discharging fluid according to claim 1, wherein an amplitude immediately before a halt of coating of the two members that are relatively moved to each other along the gap direction is larger than an amplitude of steady intermittent application.

15. The method for discharging fluid according to claim 1, wherein while a dispenser for discharging the fluid through the gap is being relatively moved to a substrate on which independent ribs each surrounded by a barrier rib are formed geometrically symmetrical, fluorescent-material paste is intermittently discharged so that the fluorescent-material paste is applied to interiors of the independent cells one by one, by which a fluorescent-material layer of a plasma display panel is formed.

16. The method for discharging fluid according to claim 15, wherein the fluorescent-material paste is flown from the discharge nozzle so as to be applied while a distance H between a crest of the barrier rib and a tip end portion of the discharge nozzle is maintained at 0.5 mm or more.

17. The method for discharging fluid according to claim 16, wherein the distance H is 1.0 mm or more.

18. The method for discharging fluid according to claim 1, wherein the two opposing surfaces of the two members that are relatively moved to each other along a gap direction by independent axial direction drive devices are provided in a plurality of sets, and the fluid is supplied by one set of fluid supply device in branches to gaps between these sets of two members, and wherein each discharge amount is controlled by a flow-rate compensation device which is provided on a flow passage that connects the fluid supply device and the two opposing surfaces of the relatively moving two members to each other and which is capable of changing a flow passage resistance.

19. The method for discharging fluid according to claim 1, further comprising: in a coating process of intermittent application performed while the gap between the opposing surfaces of the relatively moving two members is varied at an amplitude $h_1$, increasing the gap between the opposing surfaces of the two members at an amplitude $h_2$ larger than the amplitude $h_1$ to interrupt the discharge; and thereafter performing intermittent application a plurality of times at the amplitude $h_1$ so that a central value of the gap after the interruption becomes gradually equal to a central value of the gap immediately before the interruption.

20. The method for discharging fluid according to claim 1, wherein the minimum value $h_0$ of the gap is 0.05 mm.

21. The method for discharging fluid according to claim 1, wherein assuming that a time at an end of an (n−1)th application from a start of an application is $T_{nn-1}$, a time at a start of an n-th application is $T_n$, and a time interval is $\Delta T=T_n-T_{n-1}$, then an n-th application quantity per dot is controlled by setting a value of the $\Delta T$.

* * * * *

UNITED STATES PATENT AND TRADEMARK OFFICE

CERTIFICATE OF CORRECTION

PATENT NO. : 7,131,555 B2
APPLICATION NO. : 10/673495
DATED : November 7, 2006
INVENTOR(S) : Teruo Maruyama et al.

It is certified that error appears in the above-identified patent and that said Letters Patent is hereby corrected as shown below:

Claim 1
Column 45, line 7, change "$h_0>h_1$," to --$h_0>h_x$,--.

Claim 4
Column 45, line 58, change "$0>h_0>h_x$," to --$0<h_0<h_x$,--.

Claim 5
Column 46, line 6, change "0h>hx," to --0<h<hx,--.

Claim 6
Column 46, line 16, change "$Q_{max}>\pi(r_0^2-r_i^2)V_{max}$" to --$Q_{max}<\pi(r_0^2-r_i^2)V_{max}$--.

Claim 8
Column 46, line 26, change "$h_0 \leq h_x$" to --$h_0 \approx h_x$--.

Claim 11
Column 46, line 62, change "$P_{S0}+P_{squ10}+P_{squ20}>0$," to --$P_{S0}+P_{squ10}+P_{squ20}<0$,--.

Claim 21
Column 48, line 30, change "$T_{nn-1}$," to --$T_{n-1}$,--.

Signed and Sealed this

Twentieth Day of February, 2007

JON W. DUDAS
*Director of the United States Patent and Trademark Office*